US007159641B2

(12) United States Patent
Yamamura et al.

(10) Patent No.: US 7,159,641 B2
(45) **Date of Patent: *Jan. 9, 2007**

(54) COOLING DRUM FOR THIN SLAB CONTINUOUS CASTING, PROCESSING METHOD AND APPARATUS THEREOF, AND THIN SLAB AND CONTINUOUS CASTING METHOD THEREOF

(75) Inventors: Hideaki Yamamura, Futtsu (JP); Naoya Hamada, Futtsu (JP); Tadahiro Izu, Hikari (JP); Yasushi Kurisu, Futtsu (JP); Isao Suichi, Hikari (JP); Masafumi Miyazaki, Hikari (JP); Kazumi Seki, Futtsu (JP); Eiichi Takeuchi, Himeji (JP); Mamoru Yamada, Hikari (JP); Hideki Oka, Hikari (JP); Yasuo Maruki, Futtsu (JP); Eiichiro Ishimaru, Hikari (JP); Mitsuru Nakayama, Hikari (JP)

(73) Assignee: Nippon Steel Corporation, Tokyo (JP)

( * ) Notice: Subject to any disclaimer, the term of this patent is extended or adjusted under 35 U.S.C. 154(b) by 54 days.

This patent is subject to a terminal disclaimer.

(21) Appl. No.: 11/044,561

(22) Filed: Jan. 26, 2005

(65) Prior Publication Data

US 2005/0126742 A1 Jun. 16, 2005

Related U.S. Application Data

(63) Continuation of application No. 10/031,349, filed as application No. PCT/JP01/03965 on May 11, 2001, now Pat. No. 6,896,033.

(30) Foreign Application Priority Data

| | | |
|---|---|---|
| May 12, 2000 | (JP) | 2000-140315 |
| Jun. 12, 2000 | (JP) | 2000-175850 |
| Sep. 22, 2000 | (JP) | 2000-288425 |
| Oct. 5, 2000 | (JP) | 2000-306711 |
| Oct. 5, 2000 | (JP) | 2000-306753 |
| Oct. 5, 2000 | (JP) | 2000-306764 |
| Feb. 8, 2001 | (JP) | 2001-073101 |

(51) Int. Cl.
*B22D 11/06* (2006.01)

(52) U.S. Cl. ..... 164/428

(58) Field of Classification Search ..... 164/479, 164/480, 428, 429
See application file for complete search history.

(56) References Cited

U.S. PATENT DOCUMENTS

| | | | | |
|---|---|---|---|---|
| 4,887,662 | A | 12/1989 | Tanaka et al. | 164/427 |
| 5,227,251 | A | 7/1993 | Suichi et al. | 428/687 |
| 5,368,088 | A | 11/1994 | Furuya et al. | 164/415 |
| 5,807,444 | A | 9/1998 | Paradis et al. | 148/542 |
| 6,431,256 | B1 | 8/2002 | Ferretti et al. | 164/428 |
| 6,491,089 | B1 | 12/2002 | Poirier et al. | 164/480 |
| 6,896,033 | B1 * | 5/2005 | Yamamura et al. | 164/428 |

FOREIGN PATENT DOCUMENTS

| | | |
|---|---|---|
| JP | 52-112895 | 9/1977 |

(Continued)

*Primary Examiner*—Kevin P. Kerns
(74) *Attorney, Agent, or Firm*—Kenyon & Kenyon LLP

(57) ABSTRACT

A cooling drum for metal cast strip by continuous casting has dimples 40 to 200 μm in average depth and 0.5 to 3 mm in diameter of circle equivalent formed on a plated peripheral surface of the cooling drum, adjacent to each other at rims of the dimples; and a film, containing oxides of at least one member selected from the group consisting of Ni—W, Ni—Co—W, Cr, Ni—Fe and Ni—Al, is formed on the peripheral surface.

4 Claims, 27 Drawing Sheets

FOREIGN PATENT DOCUMENTS

| | | |
|---|---|---|
| JP | 60-180686 | 9/1985 |
| JP | 60-184449 | 9/1985 |
| JP | 61-283486 | 12/1986 |
| JP | 1-83342 | 3/1989 |
| JP | 1-298113 | 12/1989 |
| JP | 2-165849 | 6/1990 |
| JP | 3-174956 | 7/1991 |
| JP | 4-238651 | 8/1992 |
| JP | 4-238654 | 8/1992 |
| JP | 5-7997 | 1/1993 |
| JP | 5-261487 | 10/1993 |
| JP | 5-318150 | 12/1993 |
| JP | 5-329588 | 12/1993 |
| JP | 6-297110 | 10/1994 |
| JP | 6-328204 | 11/1994 |
| JP | 6-344087 | 12/1994 |
| JP | 7-96147 | 10/1995 |
| JP | 7-290192 | 11/1995 |
| JP | 8-155506 | 6/1996 |
| JP | 08206791 A | 8/1996 |
| JP | 8-281385 | 10/1996 |
| JP | 8-309571 | 11/1996 |
| JP | 9-103849 | 4/1997 |
| JP | 9-103850 | 4/1997 |
| JP | 9-136145 | 5/1997 |
| JP | 09253803 A | 9/1997 |
| JP | 10-137903 | 5/1998 |
| JP | 10-263855 | 10/1998 |
| JP | 11-57948 | 3/1999 |
| JP | 11-179494 | 6/1999 |
| JP | P3027695 | 1/2000 |
| WO | 98/55251 | 12/1998 |
| WO | 99/24193 | 5/1999 |

* cited by examiner (a)

(b)

SURFACE
APPEARANCE

DRUM ROTATION
DIRECTION

X15

SURFACE APPEARANCE

DRUM ROTATION DIRECTION

×50

SURFACE APPEARANCE

DRUM ROTATION DIRECTION

X15

SURFACE
APPEARANCE

DRUM ROTATION
DIRECTION

×50

(a)

(b)

(a)

(b)

(a)

(b)

(a)

(b)

(c)

COOLING DRUM FOR THIN SLAB CONTINUOUS CASTING, PROCESSING METHOD AND APPARATUS THEREOF, AND THIN SLAB AND CONTINUOUS CASTING METHOD THEREOF

This application is a continuation application under 35 U.S.C. §120 of prior application Ser. No. 10/031,349 filed Jan. 11, 2002, now U.S. Pat. No. 6,896,033, which is a 35 U.S.C. §371 of PCT/JP01/03965 filed May 11, 2001, wherein PCT/JP01/03965 was filed and published in the Japanese language. The entire disclosure of prior application Ser. No. 10/031,349 which is a 35 U.S.C. §371 of PCT/JP01/03965 is considered part of this continuation application and is hereby incorporation by reference.

TECHNICAL FIELD

The present invention relates to a cooling drum used in a single drum type continuous caster or a twin drum type continuous caster for directly casting a thin slab out of molten plain carbon steel, stainless steel, alloy steel, silicon steel, or other steel, alloy, or metal, and relates to a processing method and an apparatus therefor. The present invention further relates to a thin slab continuously cast by using the cooling drum stated above and a continuous casting method thereof.

BACKGROUND ART

A technology has been developed in which a thin slab (hereunder occasionally referred to as "slab") 1 to 10 mm in thickness is continuously cast by a twin drum type continuous caster equipped with a pair of cooling drums (hereunder occasionally referred to as "drums") or a single drum type continuous caster equipped with one cooling drum.

For example, a twin drum type continuous caster is made up of, as major component members, a pair of cooling drums 1, 1' installed in close and parallel relation to each other with their axes horizontally directed and rotating in opposite directions to each other and side weirs 2 firmly contacting with both end faces of the cooling drums 1, 1', as shown in FIG. 1.

A sealed chamber 4 is provided above a molten steel pool 3 formed by the cooling drums 1, 1' and side weirs 2, and an inert gas is supplied to the interior of the sealed chamber 4. When molten steel is continuously supplied from a tundish 5 to the molten steel pool 3, the molten steel solidifies along its parts in contact with the cooling drums 1, 1' to form solidifying shells. The solidifying shells move down with the rotation of the cooling drums 1, 1' and are pressure-bonded to each other at a kissing point 6 to form a thin slab C.

As the cooling drums 1, 1' are used for cooling molten steel during their rotation to produce solidifying shells, they are usually formed of Cu, or a Cu alloy of high thermal conductivity. The cooling drums 1, 1' keep direct contact with molten steel while forming the molten steel pool 3, but they are out of contact with the molten steel after they pass the kissing point 6 until they again form the molten steel pool 3. Thus, they are sometimes heated by heat held by the molten steel and sometimes cooled by cooling water within the cooling drums 1, 1' and by the air.

The cooling drums 1, 1' repeatedly receive a frictional force caused by a relative slip between the thin slab C and the surfaces of the cooling drums 1, 1' when they pressure-bond the solidifying shells together to form the thin slab C.

Therefore, in the event that the surface layers of the cooling drums 1, 1' are made of Cu or Cu alloy, the peripheral surface layers d are heavily worn away with the progress of casting and do not maintain their surface shape, thus becoming unable to perform casting at an early stage.

With the purpose of preventing such early wear of the surface layer of a drum, a drum structure is known which has a Ni plated layer about 1 mm thick formed on the surface of a cooling drum.

In the event that continuous casting is performed by using cooling drums having the drum structure stated above, there occurs unevenness in a gas gap due to unevenness in adhesion of molten steel to the drums, unevenness in the starting position of solidification due to turbulence in the surface of molten steel, or unevenness in deposited substances on the drum surfaces. As a result, a problem occurs that solidification becomes uneven to cause cracks that impair slab quality.

As this technology is used for producing a thin slab having a shape and thickness close to those of a final product, this technology is indispensably required to make it possible to produce a thin slab completely free from surface defects such as cracks and crevices in order to finally obtain a final product having a required level of quality at a high yield rate.

As a sheet product of stainless steel, in particular, is required to have a high-quality surface appearance, it is a major challenge to cast a thin slab without pickling unevenness.

It is known that the surface defects stated above are formed based on unequal heat contraction stresses developed owing to unevenness in the formation of solidifying shells on the surfaces of the cooling drums, that is, owing to unevenness in the manner in which molten steel solidifies by being quickly cooled, in the course of thin slab casting. Until now, a variety of peripheral surface structures and/or peripheral surface materials for cooling drums have been suggested for cooling and solidifying molten steel in such a manner that unequal heat contraction stresses remaining in the interior of a slab are reduced to the utmost.

For example, a technology is disclosed, by Japanese Unexamined Patent Publication No. S60-184449, in which a Ni plated layer formed on the peripheral surface of a cooling drum is provided with a large number of dimples by shot blasting, photoetching, laser processing or the like, in order to prevent the generation of surface cracks. According to the technology stated above, gas gaps acting as heat insulating layers are formed by these dimples between the cooling drum and a solidifying shell to cause molten steel to be slowly cooled and, also, transferred humps are formed on the surface of a slab by letting the molten steel get into the dimples to an appropriate extent to cause its solidification to start from the peripheries of the transferred humps, thereby equalizing the thickness of the solidifying shell.

Also, a method is disclosed, by Japanese Examined Patent Publication No. H4-33537, wherein a large number of circular or oval dimples are formed on the peripheral surface of a cooling drum, a method is disclosed, by Japanese Unexamined Patent Publication No. H3-174956, wherein the peripheral surface of a cooling drum is roughened by knurling or sandblasting, and a method is disclosed, by Japanese Unexamined Patent Publication No. H9-136145, wherein dimples are formed so as to satisfy maximum diameter≦average diameter+0.30 mm on the peripheral surface of a cooling drum by shot blasting. In any of these methods, an air layer is introduced between a cooling drum and molten steel by forming a large number of dimples or humps on the peripheral surface of a cooling drum, the effective contact area of the peripheral surface of the cooling drum with the molten steel is thereby reduced to relax the cooling of a solidifying shell, and stresses due to heat contraction are relieved to prevent cracks and crevices from being generated due to quick cooling, thus aiming to obtain a thin slab of sound surface appearance.

When either of the methods disclosed by the Japanese Examined Patent Publication No. H4-33537 and by the Japanese Unexamined Patent Publication No. H3-174956 is used, however, molten steel is inserted into dimples formed on the peripheral surface of a cooling drum to form humps on the surface of a slab, and therefore rolling defects such as rolled-in scales and linear scabs are generated in a stage of processing such as rolling in the subsequent processes. In the case of the cooling drum described in the Japanese Unexamined Patent Publication No. H9-136145, dimples of 0.5 to 2.0 mm in diameter, 30 to 70% in area ratio, 60 μm or more in averaged depth, and 100 mm or less in maximum depth are given to the drum by shotblasting, but actually, fine surface defects are still generated on a slab. As the reason for this, it is considered that the distances between adjoining dimples are made excessively large in the stage of shot blasting for forming dimples of the size stated above, their contact surface areas with molten steel are made excessively large because these portions have the shape of a trapezoid, and therefore excessively-cooled portions and slow-cooled portions together exist in a solidifying shell when it is formed, thus generating slab cracks.

As a cooling drum to cope with such a problem, Japanese Unexamined Patent Publication No. H4-238651 discloses a cooling drum wherein dimples 50 to 200 μm in depth are formed with an area ratio of 15 to 30% and, along with this, dimples 10 to 50 μm in depth are formed with an area ratio of 40 to 60% on the peripheral surface of the cooling drum. Further, Japanese Unexamined Patent Publication No. H6-328204 discloses a cooling drum wherein dimples 100 to 300 μm in diameter and 100 to 500 μm in depth are formed with an area ratio of 15 to 50% and, along with this, dimples 400 to 1,000 μm in diameter and 10 to 100 μm in depth are formed with an area ratio of 40 to 60% so that each of the dimple side faces makes an angle of 45° to 75° with a line perpendicular to a peripheral surface tangent on the peripheral surface of the cooling drum.

These cooling drums can suppress the generation of surface cracks and crevices on the surface of a slab while they can suppress the generation of pickling unevenness, the other typical surface defect, and therefore they produce a noticeable effect on the production of a stainless steel sheet product without uneven luster.

Further, Japanese Unexamined Patent Publication No. H11-179494 discloses a cooling drum wherein a large number of humps (preferably, 20 μm or more in height, 0.2 to 1.0 mm in diameter, and 0.2 to 1.0 mm in shortest distance between them) are formed on the peripheral surface of the drum by a means such as photoetching or laser material processing. This cooling drum can suppress surface defects to an extent of nearly zero.

With respect to the cooling drums stated above, however, nothing is specified on the quality of material used for the surface of the cooling drums.

It is apparent that the quality of material used for the surface of a cooling drum affects the surface appearance of a thin slab.

As stated above, a Ni plated layer is usually assumed to be a material for the peripheral surface layer (d in FIG. 1) of a cooling drum. Since the Ni plated layer has lower thermal conductivity than that of a drum base material (Cu, Cu alloy) and a satisfactory bonding property to the drum base material, it is less liable to generate crevices or flakes. Also, it has higher hardness than the base material has and is relatively excellent in abrasion resistance and deformation resistance. However, it is not provided with abrasion resistance or deformation resistance on the level that stably maintains the surface shape of the drum for a long time in actual casting. It has been ascertained that the shape of the peripheral surface layer of a cooling drum changes when it is continuously used for a long time and the change in the shape can become the primary factor of surface cracks on a thin slab.

In view of this, as a cooling drum solving the problem stated above, Japanese Unexamined Patent Publication No. H9-103849 discloses a cooling drum wherein a Ni layer and a Co layer 10 to 500 μm in thickness are formed in this order on the peripheral surface of the drum, the sum of thicknesses of the Ni layer and Co layer being 500 μm to 2 mm, with dimples 30 to 150 μm in average depth formed on the surface of the Co layer. Also, Japanese Unexamined Patent Publication No. H9-103850 discloses a cooling drum wherein a Ni layer is formed on the peripheral surface of the drum, dimples 10 to 50 μm in average depth are provided on the Ni layer by shot blasting, and then an electroplated layer 10 to 500 μm in thickness is provided thereon, thereby causing the average depth of the dimples to be 30 to 150 μm.

These cooling drums are aimed at suppressing the generation of cracks on a thin slab and extending the service life of the drums by improving and devising the peripheral surface structure and peripheral surface material quality of the drums, and they show a noticeable effect.

As stated above, with respect to technologies for continuously casting a thin slab 1 to 10 mm in plate thickness, great success has been achieved in suppressing surface defects including pickling unevenness by improving and devising the peripheral surface structure and/or peripheral surface material quality of a cooling drum.

In operation, however, it is unavoidable that a considerable amount of scum floats and coagulates on the surface of molten steel because of inclusions or mixed-in slag floating up from within the molten steel, even if the generation of scum is suppressed to the greatest possible extent by covering, with an inert atmosphere, a molten steel pool formed by cooling drums and side weirs contacting with both sides thereof for accepting molten steel therein (see the sealed chamber 4 in FIG. 1). When the scum is entrapped between the cooling drums and the molten steel, pickling unevenness appears on a surface of a thin slab.

The portion of such pickling unevenness appears as "uneven luster" on a final sheet product, thus lowering its value as material for a product. Therefore, in order to further enhance the quality and yield rate of a final sheet product, in addition to the suppression of scum generation, it is necessary to take some measures that can inhibit pickling unevenness from being generated on a thin slab even if scum entrapment happens when the thin slab is continuously cast, and if possible, that can eradicate the generation thereof.

In order to find such measures, the present inventors made a close examination into thin slabs on which pickling unevenness appeared. As a result, it was discovered that "a crack" in a form different from the already known "surface crack" was generated in the proximity of a boundary between an area where "pickling unevenness" appeared and an area without it. This "crack" (hereunder referred to as "pickling-unevenness accompanying crack") is shown in FIG. 2.

As is apparent from FIG. 2, the "pickling-unevenness accompanying crack" is of a nature different, as a matter of course, in origin, position, form and the like from the "surface crack" (hereunder occasionally referred to as "dimple crack") generated on a portion where no pickling unevenness is generated.

Accordingly, it is difficult to prevent the generation of the "pickling-unevenness accompanying crack" of a different nature as stated above by using conventional means.

As described above, in addition to the task of suppressing the generation of "dimple crack" and "pickling unevenness," the task of suppressing the generation of "pickling-unevenness accompanying crack" has been newly posed in the continuous casting of a thin slab.

As means for forming dimples on the peripheral surface of a cooling drum, there are shot blasting, photoetching, laser material processing and the like (see Japanese Unexamined Patent Publication No. S60-184449). For an example of laser material processing, Japanese Patent No. 2067959 discloses a method wherein pulsed laser light 0.30 to 1.07 μm in wavelength is used to form holes 500 μm or less in diameter and 50 μm or more in depth, with hole pitches not less than 1.05 times and not more than 5 times the hole diameter. Referring to the example according to this method, four YAG lasers of 500 Hz in pulse repetition frequency are used to form holes with hole pitches of 200 to 250 μm. Assuming that the shape of a cooling drum is of 1 m in diameter and 1 m in width and that holes with pitches of 200 μm are formed on the peripheral surface of the cooling drum, about 80 million holes have to be formed in total. A pulse-light emitting flash lamp is generally used to excite a YAG laser for hole forming and the service life of a flash lamp is 1 to 10 million pulses. Accordingly, even if four YAG lasers are used for hole forming, it is impossible to complete hole forming all over the peripheral surface of the cooling drum within the service life of the flash lamps and therefore the forming work must be stopped to change the lamps.

In such a case, discontinuity of forming appears in portions where the forming is stopped. If a cooling drum having such discontinuity of forming is used in casting, a problem arises that cracks are generated at the discontinuous portions. In this method, if the number of lasers is increased from four, for example, to ten, the problem stated above can be solved. On the other hand, however, a problem arises that an apparatus for forming becomes large-scaled and complicated.

As processing methods using a Q-switched $CO_2$ laser, generally adopted in order to cope with the problems described above, a method of dulling a roll for cold rolling is disclosed by Japanese Patent No. 3027695, and a method of processing a copper alloy by Japanese Unexamined Patent Publication No. H8-309571. In these material processing methods, Q-switched $CO_2$ laser pulses having an initial spike and a pulse tail, with the total pulse width being up to 30 μsec, are used to realize hole forming and the upper limit of hole depth is on the order of 40 μm in any case. Meanwhile, with respect to a cooling drum, it is necessary to form holes, in some cases, 50 μm or more in depth in order to prevent surface cracks and uneven luster. Because of this, there is a problem that the use of the publicly known methods stated above can not realize the hole forming conforming to the expected object of the present invention.

When a metallic material, for example, the peripheral surface of a cooling drum, is processed with laser light for hole forming, a molten substance produced in a boring process is discharged as spatters from holes to the exterior by the vaporizing reaction of the metal itself or by the back pressure of an assist gas and it is often redeposited as dross on the peripheries of the holes. In general, such dross impairs the smoothness of a surface, and hence a means to prevent this is required. In this context, various means of removing or suppressing dross have, so far, been proposed.

A means has been used relatively frequently, up to now, wherein a solid mask layer is provided on the surface of a material to be processed, holes are formed in the material together with the mask, and finally the mask is removed, thereby providing a smooth surface. Since this method requires a process for sticking the mask onto the surface prior to hole forming and a process for removing the mask after laser material processing, it presents, as a whole, problems in terms of work efficiency and cost.

A technique of actively removing dross deposited on a processed surface is disclosed, by Japanese Unexamined Patent Publication No. H10-263855, wherein a "spatula" or a rotary motor-driven grinder is provided adjacent to a processing head for forming fine holes on a work roll for cold rolling as a means for equalizing the distribution of the deposit on the surface of the roll.

Since dross is the deposit of molten substance re-solidified on a processed surface, however, it is difficult to completely remove the dross by using a mechanical means such as "spatula." Further, in the event that fine holes of the order of 10 to 100 μm in depth are formed, it is difficult to remove only dross by a rotary motor-driven grinder because of its mechanical accuracy, and in some cases, a problem arises that the depth of the holes is decreased by over-grinding. If a method of more actively removing deposited dross is employed, another problem arises that apparatus size is increased by an accessory apparatus added to a laser material processing head.

Meanwhile, various methods have been proposed for cleaning surface appearance after processing by previously coating a surface to be processed with a liquid material typified by oils and fats. For example, a coating method using a viscous material transparent to laser light is disclosed by Japanese Unexamined Patent Publication No. S52-112895, and an oil coating method by Japanese Unexamined Patent Publication No. S60-180686. Although material processing by melting with laser light is taken into account in these methods, the characteristics of coating substance are not described in these Publications. When any of oils and fats is used as coating substance, the transmittance of the coating substance relative to laser wavelength greatly affects surface appearance after processing (which is apparent from experimental research and study made by the present inventors). These Publications have no description suggesting knowledge relating to the present invention, and there is a problem that the suppression of dross deposition can not be realized with good reproducibility in forming holes on a metallic material with laser by the methods stated in the Publications.

With respect to the characteristics of coating substances, a coating method using one of oils and fats with a boiling point of 80° C. or higher is disclosed by Japanese Unexamined Patent Publication No. S58-110190, and the specification of the composition of coating material is disclosed by Japanese Unexamined Patent Publication No. H1-298113. In these disclosures, the former specifies only the boiling point of a coating material as the characteristic specification thereof, and has no disclosure on transmittance relative to the wavelength of the laser light used for hole forming. According to the experimental research done by the present inventors, there is a problem that dross generation can not be suppressed when oil or fat with large absorption is used even if its boiling point is 80° C. or higher. The latter discloses detailed composition and its basic concept is to specify a coating material that fulfills the function of enhancing the absorptivity relative to laser light, that is, of lowering the transmittance relative to laser light. In forming holes on a metallic material, a problem arises that the depositing property of dross is rather worsened if laser light absorption in a coating material is too large, thus failing to obtain an effective technique for dross suppression.

DISCLOSURE OF THE INVENTION

An object of the present invention is to realize a technology enabling a thin slab to be stably cast over a long period of time by simultaneously suppressing the generation of surface cracks and uneven luster, two major types of defects in a sheet product explained as problems in conventional technologies, and the present invention provides a cooling drum for thin slab continuous casting to fulfill the object and a method of continuous casting using the cooling drum.

Also, the present invention provides a cooling drum for stably producing a slab not having slab cracks, crevices or the like and excelling in surface appearance by giving not only conventional dimples but also finer unevenness in a duplicate manner and/or fine humps to the peripheral surface of the cooling drum.

Further, the present invention provides a cooling drum for stably producing a thin slab not having high transferred humps, slab cracks, crevices or the like and excelling in surface appearance by further giving fine unevenness and also fine humps formed by causing grit fragments to bite thereinto in each ordinary dimple, thereby dispersing solidification starting points more finely than ordinary dimples, and a method of continuous casting using the cooling drum.

Also, the present invention provides a cooling drum enabling a slab, not having slab cracks, crevices or the like and excelling in surface appearance, to be stably produced by reducing trapezoidal portions between adjoining dimples with respect to the dimples formed on the peripheral surface of the cooling drum.

Also, the present invention has an object of suppressing the generation of "dimple cracks" and suppressing the generation of "pickling unevenness" and "pickling-unevenness accompanying cracks" and is aimed at attaining the object from the viewpoint of the peripheral surface structure and/or peripheral surface material quality of a cooling drum, which greatly affect the solidifying behavior of molten steel.

Also, the present invention provides a processing method with laser light and a processing apparatus with a laser, for a cooling drum, enabling a thin slab to be stably cast over a long period of time by simultaneously suppressing the generation of "surface cracks" and "uneven luster," two major types of defects in a sheet product.

Yet further, the present invention provides a method capable of suppressing the deposition of dross by a simple technique without performing additional and complicated processing with respect to the method of forming holes on a metallic material with laser and a method capable of reliably achieving the suppression of dross by specifying the characteristics of oil or fat with respect to a simple technique of previously coating with oil or fat.

Hence, the present inventors have developed a method capable of reducing high transferred humps, slab cracks, crevices and the like to the utmost by further giving fine unevenness and fine humps to each of conventional dimples on the peripheral surface of a cooling drum, with the idea that the generation of high transferred humps and cracks on the surface of a slab may be prevented by using a cooling drum having dimples formed thereon with contact surface areas smaller than the contact surface areas of the dimples stated above and that, if unevenness larger in number than the unevenness of dimples stated above are formed, solidification can be started in more stable manner because the solidification starts from convexities large in number and cracks may thereby be prevented.

Pickling unevenness is an "unevenness" that appears on a slab surface after pickling owing to the fact that the solidification of molten steel is delayed in portions with deposited scum and, as a result, solidified structure of the portion with deposited scum differs from solidified structure around it. Therefore, it is supposed that the solidifying behavior of molten steel on the surface of a cooling drum is greatly related to the generation of "pickling-unevenness accompanying cracks." The present inventors made an examination into the solidification behavior of a thin slab on which "pickling-unevenness accompanying cracks" were generated as shown in FIG. 2. It has become clear that the "pickling-unevenness accompanying cracks" are generated basically in a place where thermal resistance of a boundary face between a cooling drum and molten steel is changed by the inflow and deposition of scum, which causes a difference in thickness of a formed solidifying shell between a portion with deposited scum and a portion without it, and more specifically, in a portion where a degree of inequality in the thickness of the solidifying shell exceeds 20%.

FIG. 3 shows the mechanism of its generation schematically. In a portion on which scum 7 is deposited, thermal resistance in a boundary face between a cooling drum 1 and molten steel 15 changes to delay the solidification of the molten steel, and therefore the thickness of a solidifying shell 8 becomes thinner than the thickness of the solidifying shell in other portions. By a multiplier action of the scum 7 with a gas gap 10 formed between the scum 7 and the concave face of a dimple 9, "strain" is generated and accumulated in a boundary part (a portion of the solidifying shell unequal in thickness) between a thicker portion and a thinner portion of the solidifying shell. If the degree of inequality in the thickness of the solidifying shell exceeds 20%, a "pickling-unevenness accompanying crack 11" occurs in the boundary part as shown in FIG. 3.

As stated above, the existence of the gas gap 10 formed between the scum 7 and the concave face of the dimple 9 is also related to the generation and accumulation of "strain" causing the "pickling-unevenness accompanying crack 11," and therefore, the present inventors made an examination into the relation between a change in solidification behavior (with "dimple depth" used as an index to represent this change) and the state of generation of "dimple crack" and "pickling-unevenness accompanying crack" (with "crack length" used as an index to represent the state of generation) by changing the "depth" of a dimple to change the solidification behavior of molten steel.

The result is shown in FIG. 4. As is evident from FIG. 4, when the depth (μm) of dimples is made shallower, the generation of "dimple cracks" can be prevented but the generation of "pickling-unevenness accompanying crack" is accelerated, on the contrary.

As stated above, the present inventors have found that the generation or the suppression of generation of "pickling-unevenness accompanying crack" and that of "dimple cracks" are in a trade-off relation in view of the relation with the depth of dimples formed on the peripheral surface of a cooling drum.

FIG. 5 shows the mechanism of generation of "dimple cracks" schematically. Solidification nuclei are generated in a portion of molten steel contacting with the rim of a dimple 9 (see "12" in the figure), from which solidification starts. When a convexity 13 formed by molten steel invading into the concavity of the dimple 9 solidifies, the solidification is uneven on dimple-by-dimple comparison, and this unevenness causes uneven stress/strain to be accumulated on a dimple-by-dimple basis owing to this uneven stress/strain, a "dimple crack 14" is generated.

When the convexity 13 of molten steel solidifies, the solidification of a portion on which scum 7 is deposited is naturally delayed because the scum acts as thermal resistance. In this case, the uneven stress/strain stated above is relaxed by the delayed solidification.

The knowledge obtained from the result of the examination stated above is summed up as follows:

(a) Molten steel contacts with the rim of a dimple while it makes no contact or partial contact (does not make complete contact) with the bottom of the dimple because of the existence of a gas gap.

(b) Molten steel contacting with the rim of a dimple solidifies faster than molten steel not contacting with the rim.

(c) If a gas gap exists between molten steel and a dimple, the gas gap acts as thermal resistance to delay nucleus generation, thereby delaying the solidification of the molten steel.

(d) Solidification of molten steel is uneven on dimple-by-dimple comparison, and uneven stress/strain owing to this unevenness is accumulated on a dimple-by-dimple basis. This is the cause of "dimple crack."

(e) If a gas gap exists between molten steel with scum deposited thereon and a dimple, the scum and gas gap act as thermal resistance to further delay the solidification of the molten steel. As a result, a difference is made in thickness between a portion of a solidifying shell with scum deposited thereon and a portion thereof without scum, and uneven stress/strain is accumulated in a thickness boundary part. This is the cause of "pickling-unevenness accompanying crack."

(f) If the "depth of dimples" is shallower, the height of molten steel invasion into the concavity of a dimple (the height of a convexity) is lower, and therefore the dimple-by-dimple accumulation of uneven stress/strain is relaxed, thus suppressing the generation of "dimple cracks," while the accumulation of uneven stress/strain owing to solidification delay based on the scum and gas gap is accelerated, thereby causing "pickling unevenness" and "pickling-unevenness accompanying cracks" to frequently occur.

(g) If the "depth of dimples" is deeper, the height of molten steel invasion into the concavity of a dimple (the height of a convexity) is higher, and therefore the dimple-by-dimple accumulation of uneven stress/strain is accelerated, thus causing "dimple cracks" to frequently occur, while the accumulation of uneven stress/strain owing to solidification delay based on the scum and gas gap is relaxed, thereby suppressing the generation of "pickling unevenness" and "pickling-unevenness accompanying cracks."

Since it is apparent that both "pickling unevenness" and "pickling-unevenness accompanying crack" are closely associated with the "solidification behavior of molten steel," the present inventors conceived, based on the information obtained, the idea that, if sufficient "dimple depth" was secured to suppress the generation of "pickling unevenness" and "pickling-unevenness accompanying crack" and, on the premise of this "dimple depth," if the surface of the dimple was provided with functions of;

(x) delaying the solidification of molten steel contacting with the rims of the dimples, and of (y) accelerating the solidification of molten steel contacting with the bottoms of the dimples, then uneven stress/strain generated and accumulated on a dimple-by-dimple basis might be reduced and both the generation of "pickling-unevenness crack" and the generation of "dimple crack" might be prevented.

Using the idea described above, the present inventors studied in every way for a surface shape fulfilling the functions (x) and (y) stated above with respect to dimples to be formed on the peripheral surface of a cooling drum. As a result, the following knowledge was obtained:

(A) If "roundness" of a prescribed shape is given to the rim of each dimple or if "fine holes" of a prescribed shape are formed on the rim of each dimple, the solidification of molten steel contacting with the rims of the dimples can be delayed.

When "roundness" is given to, or "fine holes" are formed on, the rim of each dimple, molten steel easily contacts with the bottoms of dimples under the static pressure of the molten steel and the screw-down force of a cooling drum, and solidifies with generated solidification nuclei used as starting points. In addition, the following knowledge was obtained:

(B) If "fine humps," "fine holes," or "fine unevenness" of a prescribed shape are formed on the bottom of each dimple, the generation of solidification nuclei is accelerated and the solidification of molten steel progresses faster.

Based on the information obtained, the present inventors conceived the idea that, if "dimple depth" enough to suppress "dimple crack" was first secured and, on the premise of this "dimple depth," if the surface of each dimple was provided with functions of;

(W) preventing the formation of a gas gap acting as thermal resistance, (X) delaying the solidification of molten steel contacting with the rim of each dimple, and (Y) accelerating the solidification of molten steel contacting with the bottom of each dimple, then uneven stress/strain accumulated in a thickness boundary part of a solidifying shell based on solidification delay of a portion with scum deposited thereon might be reduced and resultantly both the generation of "pickling-unevenness crack" and the generation of "dimple crack" might be suppressed.

With the idea stated above, the present inventors made an intensive study/research on a surface fulfilling the function of (W) stated above with respect to dimples to be formed on the peripheral surface of a cooling drum. As a result, the following knowledge was obtained:

(C) If a substance having high wettability with scum exists on the surface of a cooling drum, the scum makes close contact with the surface, thus resisting the formation of a gas gap.

Usually, the surface of a cooling drum is given Ni plating. It has become clear that Ni—W alloy is suitable as the substance having high wettability with scum.

When the formation of gas gap is suppressed and "roundness" is given to, and "fine holes" are formed on, the rim of each dimple, molten steel easily contacts with the bottoms of the dimples under the screw-down force and solidifies with generated solidification nuclei used as starting points. In addition, the following knowledge was obtained;

(D) If "fine humps" are previously formed on the bottom of a dimple, the generation of solidification nuclei is accelerated and the solidification of molten steel progresses faster.

The present invention has been made on the basis of the knowledge stated above and on the ascertainment of desirable relations among the shape of dimples, the shape of "roundness" and "fine holes" formed on the rim of each dimple, and the shape of "fine humps" formed on the bottom of each dimple.

The gist of the present invention related to a cooling drum for thin slab continuous casting is as follows:

(1) A cooling drum for metal cast strip by continuous casting, characterized in that: dimples of a prescribed shape are formed on the peripheral surface of the cooling drum, adjacent to each other at the rims of said dimples; and fine humps, fine holes or fine unevenness of a prescribed shape are formed at the rims of said dimples and/or on the indented surfaces of said dimples.

(2) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; and fine humps 1 to 50 μm in height and 5 to 200 μm in diameter of circle equivalent are formed on the indented surfaces of said dimples.

(3) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; and fine holes 5 μm or more in depth and 5 to 200 μm in diameter of circle equivalent are formed on the indented surfaces of said dimples.

(4) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; and fine unevenness 1 to 50 μm in average depth and 10 to 200 μm in diameter of circle equivalent are formed on the indented surfaces of said dimples.

(5) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; and fine humps 1 to 50 μm in height and 30 to 200 μm in diameter of circle equivalent are formed at the rims of said dimples adjacent to each other.

(6) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; fine humps 1 to 50 μm in height and 30 to 200 μm in diameter of circle equivalent are formed at the rims of said dimples adjacent to each other; and also fine humps 1 to 50 μm in height and 5 to 200 μm in diameter of circle equivalent are formed on the indented surfaces of said dimples.

(7) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; fine humps 1 to 50 μm in height and 30 to 200 μm in diameter of circle equivalent are formed at the rims of said dimples adjacent to each other; and fine holes 5 μm or more in depth and 5 to 200 μm in diameter of circle equivalent are formed on the indented surfaces of said dimples.

(8) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; fine humps 1 to 50 μm in height and 30 to 200 μm in diameter of circle equivalent are formed at the rims of said dimples adjacent to each other; and fine unevenness 1 to 50 μm in average depth and 10 to 200 μm in diameter of circle equivalent are formed on the indented surfaces of said dimples.

(9) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; and fine holes 5 μm or more in depth and 5 to 200 μm in diameter of circle equivalent are formed at the rims of said dimples.

(10) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; fine holes 5 μm or more in depth and 5 to 200 μm in diameter of circle equivalent are formed at the rims of said dimples; and fine humps 1 to 50 μm in height and 5 to 200 μm in diameter of circle equivalent are formed on the indented surfaces of said dimples.

(11) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; and fine holes 5 μm or more in depth and 5 to 200 μm in diameter of circle equivalent are formed at the rims and on the indented surfaces of said dimples.

(12) A cooling drum for metal cast strip by continuous casting, characterized in that: dimples 40 to 200 μm in average depth and 0.5 to 3 mm in diameter of circle equivalent are formed on the peripheral surface of the cooling drum, adjacent to each other at the rims of said dimples; fine holes 5 μm or more in depth and 5 to 200 μm in diameter of circle equivalent are formed at the rims of said dimples; and fine unevenness 1 to 50 μm in average depth and 10 to 200 μm in diameter of circle equivalent are formed on the indented surfaces of said dimples.

(13) A cooling drum for metal cast strip by continuous casting, characterized in that: dimples of a prescribed shape are formed on the peripheral surface of the cooling drum, adjacent to each other at the rims of said dimples; and fine unevenness and fine humps are formed at the rims of said dimples and/or on the indented surfaces of said dimples.

(14) A cooling drum for metal cast strip by continuous casting according to the item (13), characterized in that said dimples of a prescribed shape are 40 to 200 μm in average depth and 1.0 to 4.0 mm in average diameter of circle equivalent.

(15) A cooling drum for metal cast strip by continuous casting according to the item (13) or (14), characterized in that the average depth of said fine unevenness is 1 to 50 μm and the height of said fine humps is 1 to 50 μm; and also the height of said fine humps is smaller than the average depth of said fine unevenness.

(16) A cooling drum for metal cast strip by continuous casting according to any one of the items (13) to (15), characterized in that: said fine unevenness are formed by spraying alumina grit; and said fine humps are formed by the intrusion of the fragments of the alumina grit.

(17) A cooling drum for metal cast strip by continuous casting, characterized in that: dimples 1.0 to 4.0 mm in average diameter and 40 to 200 μm in average depth are formed on the peripheral surface of the cooling drum, adjacent to each other at the rims of said dimples; and fine unevenness 10 to 50 μm in average diameter and 1 to 50 μm in average depth and fine humps 1 to 50 μm in height formed by the intrusion of the fragments of the alumina grit are formed at the rims of said dimples and/or on the indented surfaces of said dimples.

(18) A cooling drum for metal cast strip by continuous casting, characterized in that: dimples of a prescribed shape are formed on the peripheral surface of the cooling drum, adjacent to each other at the rims of said dimples; and the region where the dimples 20 μm or less in average depth exist consecutively at a distance of 1 mm or more accounts for 3% or less.

(19) A cooling drum for metal cast strip by continuous casting, characterized in that: dimples 1.0 to 4.0 mm in average diameter and 40 to 170 μm in average depth are formed on the peripheral surface of the cooling drum, adjacent to each other at the rims of said dimples; and the region where the dimples 20 μm or less in average depth exist consecutively at a distance of 1 mm or more accounts for 3% or less.

(20) A cooling drum for metal cast strip by continuous casting, characterized in that: dimples 40 to 200 μm in average depth and 0.5 to 3 mm in diameter of circle equivalent are formed on the plated peripheral surface of the cooling drum, adjacent to each other at the rims of said dimples; and a film, containing a substance more excellent than Ni in wettability with scum, is formed on said peripheral surface.

(21) A cooling drum for metal cast strip by continuous casting, characterized in that: dimples 40 to 200 μm in average depth and 0.5 to 3 mm in diameter of circle equivalent are formed on the plated peripheral surface of the cooling drum, adjacent to each other at the rims of said dimples; fine humps 1 to 50 μm in height and 5 to 200 μm in diameter of circle equivalent are formed on the indented surfaces of said dimples; and a film, containing a substance more excellent than Ni in wettability with scum, is formed on said peripheral surface.

(22) A cooling drum for metal cast strip by continuous casting, characterized in that: dimples 40 to 200 μm in average depth and 0.5 to 3 mm in diameter of circle equivalent are formed on the plated peripheral surface of the cooling drum, adjacent to each other at the rims of said dimples; and fine humps 1 to 50 μm in height and 30 to 200 μm in diameter of circle equivalent, where a film, containing a substance more excellent than Ni in wettability with scum, is formed, are formed at the rims of said dimples adjacent to each other.

(23) A cooling drum for metal cast strip by continuous casting, characterized in that: dimples 40 to 200 μm in average depth and 0.5 to 3 mm in diameter of circle equivalent are formed on the plated peripheral surface of the cooling drum, adjacent to each other at the rims of said dimples; fine humps 1 to 50 μm in height and 30 to 200 μm in diameter of circle equivalent are formed at the rims of said dimples adjacent to each other; and also fine humps 1 to 50 μm in height and 5 to 200 μm in diameter of circle equivalent, where a film, containing a substance more excellent than Ni in wettability with scum, is formed, are formed on the indented surfaces of said dimples.

(24) A cooling drum for metal cast strip by continuous casting, characterized in that: dimples 40 to 200 μm in average depth and 0.5 to 3 mm in diameter of circle equivalent are formed on the plated peripheral surface of the cooling drum, adjacent to each other at the rims of said dimples; fine holes 5 μm or more in depth and 5 to 200 μm in diameter of circle equivalent are formed at the rims of said dimples; and also fine humps 1 to 50 μm in height and 5 to 200 μm in diameter of circle equivalent, where a film, containing a substance more excellent than Ni in wettability with scum, is formed, are formed on the indented surfaces of said dimples.

(25) A cooling drum for metal cast strip by continuous casting according to any one of the items (20) to (24), characterized in that said substances more excellent than Ni in wettability with scum are oxides of the elements composing the molten steel which is continuously cast.

(26) A cooling drum for metal cast strip by continuous casting according to any one of the items (20) to (24), characterized in that said substances more excellent than Ni in wettability with scum are oxides of the elements composing the plated layer on the peripheral surface of the cooling drum.

(27) A cooling drum for metal cast strip by continuous casting according to item (20) or (21), characterized in that said film containing a substance more excellent than Ni in wettability with scum is a film formed by the oxidation of the plated layer on the peripheral surface of the cooling drum.

(28) A cooling drum for metal cast strip by continuous casting according to the item (20) or (21), characterized in that said film containing a substance more excellent than Ni in wettability with scum is a film formed by the deposition of oxides generated by the oxidation of component elements in molten steel on the plated layer on the peripheral surface of the cooling drum.

(29) A cooling drum for metal cast strip by continuous casting according to any one of the items (20) to (24), (27) and (28), characterized in that said plated layer contains an element or elements more susceptible to oxidation than Ni.

(30) A cooling drum for metal cast strip by continuous casting according to any one of the items (20) to (24), (27) and (29), characterized in that said plated layer contains one or more of W, Co, Fe and Cr.

(31) A cooling drum for metal cast strip by continuous casting, characterized in that: the thermal conductivity of the base material of the drum is not less than 100 W/m·K; an intermediate layer 100 to 2,000 μm in thickness having the coefficient of thermal expansion of 0.50 to 1.20 times that of said drum base material and Vickers hardness Hv of not less than 150 is coated on the surface of said drum base material; a hard plated layer 1 to 500 μm in thickness having Vickers hardness Hv of not less than 200 is applied on the outermost surface; further on the surface, dimples 200 to 2,000 μm in diameter and 80 to 200 μm in depth are formed so as to contact each other or adjacent to each other; and fine holes 50 to 200 μm in diameter and 30 μm or more in depth are formed so as to have the pitch of 100 to 500 μm but not to contact each other.

(32) A cooling drum for metal cast strip by continuous casting according to the item (31), characterized in that: said drum base material is copper or copper alloy; said intermediate layer is a plated layer consisting of Ni, Ni—Co, Ni—Co—W or Ni—Fe; and said hard plated layer on the outermost surface consists of any one of Ni—Co—W, Ni—W, Ni—Co, Co, Ni—Fe, Ni—Al and Cr.

(33) A cooling drum for metal cast strip by continuous casting according to the item (31) or (32), characterized in that: said dimples are formed by shot blasting; and said fine holes are formed by pulsed laser material processing.

(34) A method of processing a cooling drum for metal cast strip by continuous casting by processing the peripheral surface of the cooling drum used for continuously casting a thin slab, characterized in that: when fine holes 50 to 200 μm in diameter and not less than 50 μm in depth are formed so as to have the pitch of 100 to 500 μm but not to contact each other by irradiating Q-switched $CO_2$ laser light to the surface layer of the cooling drum, the pulse energy of Q-switched $CO_2$ laser light is 40 to 150 mJ, total time span is 30 to 50 μsec and the condensed diameter of the laser beam is 50 to 150 μm.

(35) A method of processing a cooling drum for metal cast strip by continuous casting according to the item (34), characterized by forming dimples 200 to 3,000 μm in diameter and 80 to 250 μm in depth on the surface layer of said drum so as to contact each other or adjacent to each other before said laser light is irradiated.

(36) A method of processing a cooling drum for metal cast strip by continuous casting according to the item (34), characterized in that: the surface layer of the cooling drum before said laser light is irradiated has a smooth curved face.

(37) A method of processing a cooling drum for metal cast strip by continuous casting according to the item (35) or (36), characterized by forming a plated layer consisting of any one or the combination of Ni, Ni—Co, Ni—Co—W, Ni—Fe, Ni—W, Co, Ni—Al and Cr on the surface of said cooling drum either before or after the irradiation of said laser light.

(38) An apparatus for processing a cooling drum for metal cast strip by continuous casting characterized by: being provided with; a drum rotating device which rotates a cooling drum for thin slab continuous casting at a prescribed constant rate, a Q-switched $CO_2$ laser oscillator which outputs light having pulse energy of 50 to 150 mJ and total time span of 30 to 50 μsec at the pulse repetition frequency of 6 kHz, a laser beam scanning apparatus which scans said cooling drum in the direction of the rotation axis with a laser beam output from said oscillator, a condenser which condenses the laser beam into a diameter of 50 to 150 μm, and a copying controller which measures the crown of said cooling drum on-line and, based on the signals, controls the spacing between said condenser and the surface of the cooling drum to a constant distance: and forming fine holes having a prescribed diameter and depth at a constant interval all over the surface of said cooling drum.

(39) A method of forming holes on a metallic material with laser light, wherein holes are formed by coating one of oils and fats as a coating material on the to-be-processed surface of said metallic material before the holes are formed on the metallic material with a laser beam and then irradiating pulsed laser light, characterized by using a coating material having the absorption coefficient of not more than 10 $mm^{-1}$ at the irradiated laser wavelength and determining the thickness of the coating material so that the transmittance of the laser light by the coated layer is not less than 50%.

(40) A method of forming holes on a metallic material with laser light according to the item (39), characterized in that said metallic material is a plated layer which covers the peripheral surface of a cooling drum for thin slab continuous casting.

(41) A method of continuously casting a metal cast strip characterized by: pouring molten steel onto the peripheral surfaces of cooling drum for thin slab continuous casting, which rotates in one direction, according to any one of the items (1) to (12) and (20) to (30), cooling and solidifying said molten steel on the peripheral surfaces of said cooling drums, and continuously casting a thin slab.

(42) A method of continuously casting a metal cast strip characterized by: forming a molten steel pool on the peripheral surfaces of a pair of cooling drums for thin slab continuous casting, which are disposed parallel with each other and which rotate in the opposite directions, according to any one of the items (1) to (12) and (20) to (30), cooling and solidifying said molten steel poured into said pool on the peripheral surfaces of said cooling drums, and continuously casting a thin slab.

(43) A method of continuously casting a metal cast strip characterized by: forming a molten steel pool on the peripheral surfaces of a pair of cooling drums, which are disposed parallel with each other and which rotate in the opposite directions, according to any one of the items (13) to (17), covering said molten steel pool with an atmosphere of non-oxidizing gas soluble in the molten steel or the mixture of non-oxidizing gas soluble in the molten steel and non-oxidizing gas insoluble in the molten steel, cooling and solidifying said molten steel poured into said pool on the peripheral surfaces of said cooling drums, and continuously casting a thin slab.

(44) A method of continuously casting a metal cast strip characterized by: forming a molten steel pool on the peripheral surfaces of a pair of cooling drums for thin slab continuous casting, which are disposed parallel with each other and which rotate in the opposite directions, according to the item (18) or (19), covering said molten steel pool with an atmosphere of non-oxidizing gas soluble in the molten steel or the mixture of non-oxidizing gas soluble in the molten steel and non-oxidizing gas insoluble in the molten steel, cooling and solidifying said molten steel poured into said pool on the peripheral surfaces of said cooling drums, and continuously casting a thin slab.

(45) A method of continuously casting a metal cast strip characterized by: forming a molten steel pool on the peripheral surfaces of a pair of cooling drums for thin slab continuous casting, which are disposed parallel with each other and which rotate in the opposite directions, according to any one of the items (31) to (33), cooling and solidifying said molten steel poured into said pool on the peripheral surfaces of said cooling drums, and continuously casting a thin slab.

(46) A method of continuously casting a metal cast strip according to the item (45), characterized by forming fine holes, by processing, while said cooling drums do not contact molten steel.

(47) A thin slab which is produced by continuously casting molten steel using cooling drums for metal cast strip by continuous casting according to any one of the items (1) to (33), characterized in that: molten steel commences its solidification with solidification nuclei generated at the portions of molten steel contacting the rims of the dimples on the peripheral surfaces of said cooling drums as starting points, and then solidifies with solidification nuclei generated at the portions of molten steel contacting the fine humps, fine holes or fine unevenness on the surfaces of said dimples as starting points.

(48) A thin slab according to the item (47), characterized in that the starting points of solidification nuclei generated at the portions of molten steel contacting the rims of said dimples are formed in the shape of the circle 0.5 to 3 mm in diameter of circle equivalent.

(49) A thin slab according to the item (47) or (48), characterized in that the starting points of solidification nuclei generated at the portions of molten steel contacting said fine humps, fine holes or fine unevenness are formed at the interval of 250 μm or less.

(50) A thin slab which is produced by continuously casting molten steel using cooling drums for metal cast strip by continuous casting according to any one of the items (1) to (33), characterized in that: reticular connected depressions formed by the contact of molten steel with the rims of the dimples on the peripheral surfaces of said cooling drums and the consequent solidification of the molten steel exist on the surfaces of the thin slab; and fine depressions and/or fine humps exist in each of the regions partitioned by said reticular connected depressions.

(51) A thin slab according to the item (50), characterized in that each of the regions partitioned by said reticular connected depressions is a region 0.5 to 3 mm in diameter of circle equivalent.

(52) A thin slab according to the item (50) or (51), characterized in that fine depressions and/or fine humps exist at the interval of 250 μm or less in each of the regions partitioned by said reticular connected depressions.

(53) A thin slab according to any one of the items (50) to (52), characterized in that fine depressions and/or fine humps exist at the bottom of said reticular connected depressions.

(54) A thin slab which is produced by continuously casting molten steel using cooling drums for metal cast strip by continuous casting according to any one of the items (1) to (33), characterized in that: molten steel commences its solidification with solidification nuclei generated along the reticular connected depressions formed at the portions of molten steel contacting the rims of the dimples on the peripheral surfaces of said cooling drums as starting points and with the shape of said reticular connected depressions being maintained, and then solidifies with solidification nuclei generated at the portions of molten steel contacting the fine humps, fine holes or fine unevenness on the indented surfaces of said dimples as starting points.

(55) A thin slab according to the item (54), characterized in that each of the regions partitioned by said reticular connected depressions is a region 0.5 to 3 mm in diameter of circle equivalent.

(56) A thin slab according to the item (54) or (55), characterized in that the starting points of solidification nuclei generated at the portions of molten steel contacting said fine humps, fine holes or fine unevenness are formed at the interval of 250 μm or less.

BEST MODE FOR CARRYING OUT THE INVENTION

The present invention will be explained in more detail.

1) A first embodiment of the present invention, which includes various sub-embodiments, will be described.

The fundamental technological principle of the invention stated above is to form fine humps, fine holes or fine unevenness on the rims of dimples and/or on the surfaces of the dimples with respect to a cooling drum wherein dimples of a prescribed shape are formed adjacent to each other at the rims of said dimples on the peripheral surface of the cooling drum.

According to the knowledge stated above, a function of delaying the solidification of molten steel is provided by forming fine humps or fine holes on the rims of the dimples and a function of accelerating the solidification of molten steel is provided by forming fine humps, fine holes, or fine unevenness on the surfaces of the dimples.

Figure 6:
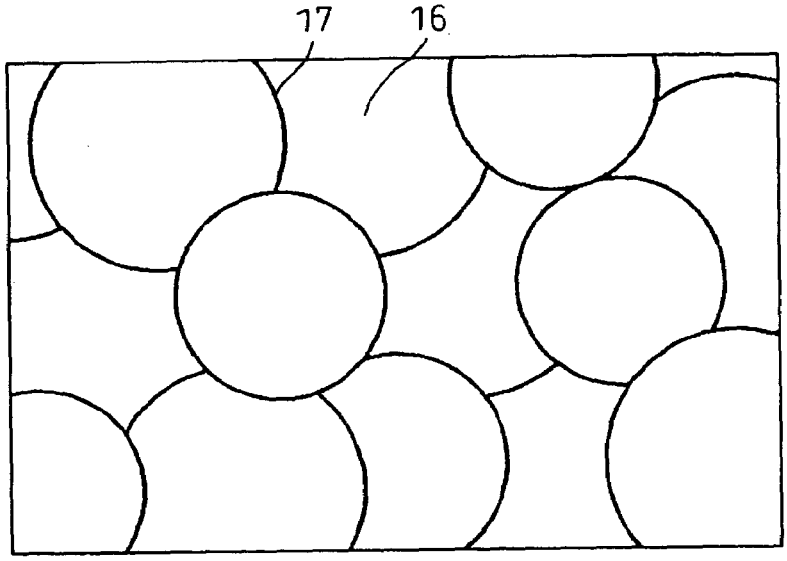
FIG. 6 is an illustration schematically showing the appearance wherein dimples are formed adjacent to each other at the rims of the dimples on the peripheral surface of a cooling drum. (a) shows the surface appearance of the dimples, and (b) shows the cross-sectional appearance of the dimples.
Figure 6:
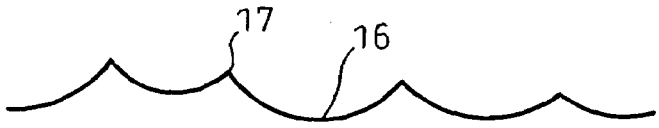

FIG. 6 is an illustration schematically showing appearances wherein dimples 16 are formed adjacent to each other at the rims 17 of the dimples on the peripheral surface of a cooling drum. FIG. 6(*a*) is a schematic illustration showing the surface shape of the dimples; solid lines in FIG. 6(*a*) show the rims of the dimples. A cross section of the surface shape is schematically shown in FIG. 6(*b*).

As shown in FIG. 6(*b*), the rims of dimples as formed are sharp. When a large number of fine humps are formed on the rims, the fine humps are formed in such a manner as to be continuously connected to each other at the narrow sharp-shaped rims, and therefore the rims of the dimples are given "roundness."

Figure 7:
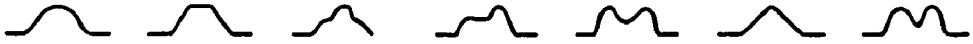
FIG. 7 is an illustration schematically showing an example of the cross-sectional appearance of "fine humps."

FIG. 7 is an illustration schematically showing an example of the cross-sectional shape of "fine humps." The "fine humps" shown in FIG. 7 are formed in such a manner as to be continuously connected to each other on the rims of the dimples, thereby giving "roundness" to the rims of the dimples.

The dimple rims with "roundness" stated above act to delay the generation of solidification nuclei in molten steel contacting with the rims and thereby delay the solidification progress of the molten steel. The dimple rims with "roundness" described above act to accelerate the invasion of molten steel into the bottoms of the dimples. As a result, the molten steel easily contacts with the bottoms of the dimples under the static pressure of the molten steel and the screw-down force of the cooling drum.

When "fine holes" are formed on the sharp rims of the dimples, the sharp shapes disappear and slow-cooling parts that hold gas are formed. Hence, the dimple rims having the "fine holes" act to delay the generation of solidification nuclei in molten steel contacting with the rims and thereby delay the progress of solidification of the molten steel.

Figure 8:
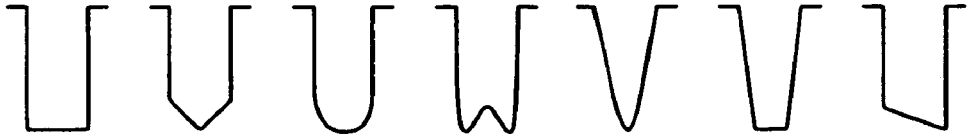
FIG. 8 is an illustration schematically showing an example of the cross-sectional appearance of "fine holes."

FIG. 8 is an illustration schematically showing an example of the cross-sectional shape of the "fine holes." By forming the "fine holes" shown in FIG. 8 on the rims of the dimples, the sharp shapes of the rims disappear.

The existence of the "fine holes" on the dimple rims accelerates the invasion of molten steel into the bottoms of the dimples, and hence the molten steel easily contacts with the bottoms of the dimples under the static pressure of the molten steel and the screw-down force of the cooling drum.

When "fine unevenness" are formed on the rims of the dimples, both the function of the "roundness" and the function of the "fine holes" are together provided.

Meanwhile, the "fine humps," "fine holes," or "fine unevenness" formed on the bottom surface of dimples act to accelerate the generation of solidification nuclei in molten steel contacting with the surfaces, thereby accelerating the solidification of the molten steel.

Figure 9:
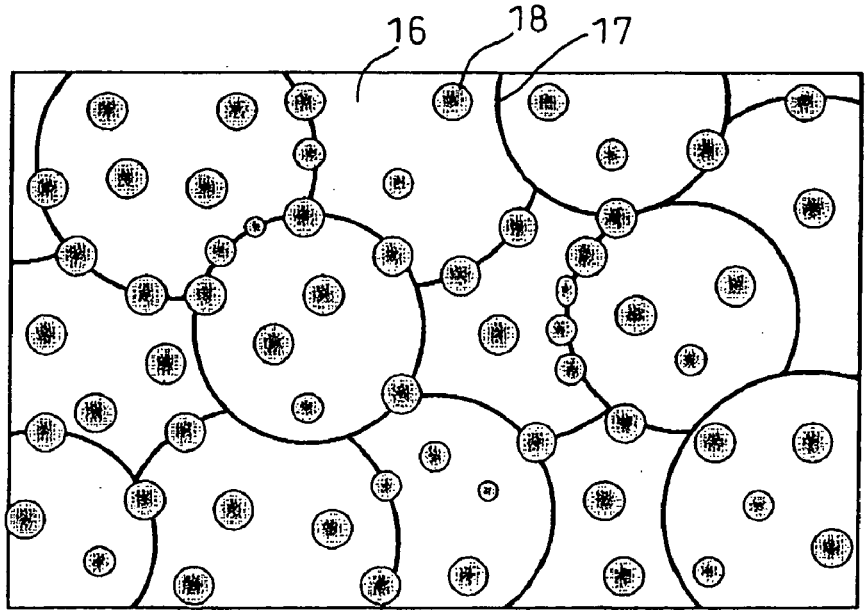
FIG. 9 is an illustration flatwise and schematically showing the appearance wherein "fine humps" are formed on the peripheral surface of a cooling drum.
Figure 10:
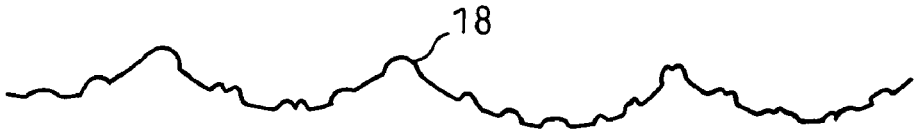
FIG. 10 is an illustration schematically showing the section of the appearance wherein "fine humps" are formed on the peripheral surface of a cooling drum.
Figure 11:
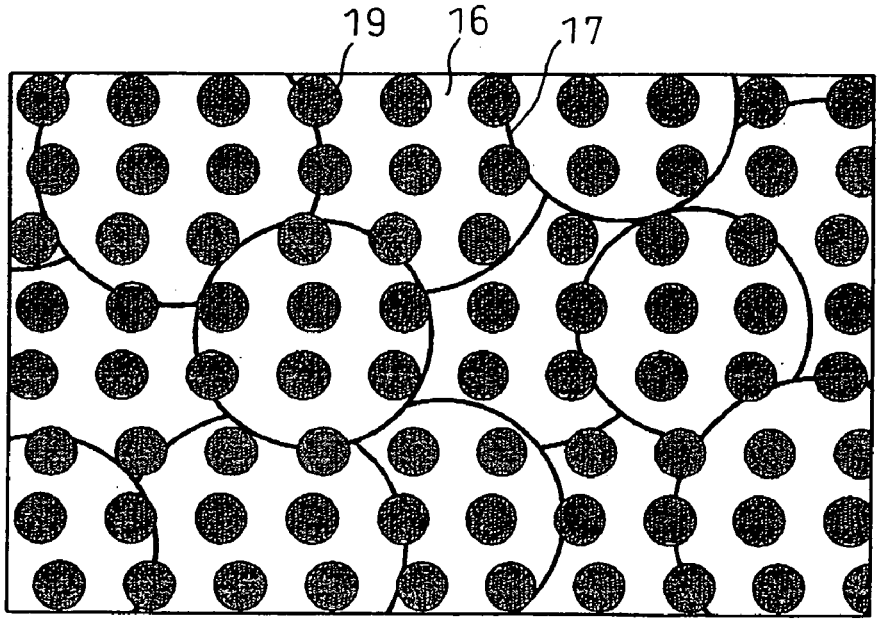
FIG. 11 is an illustration flatwise and schematically showing the appearance wherein "fine holes" are formed on the peripheral surface of a cooling drum.
Figure 12:
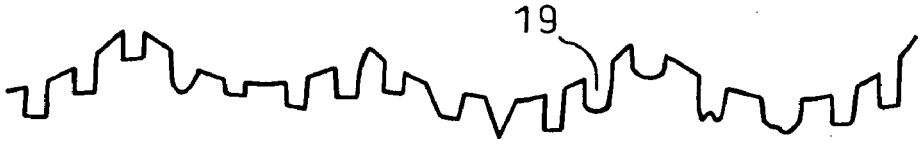
FIG. 12 is an illustration schematically showing the section of the appearance wherein "fine holes" are formed on the peripheral surface of a cooling drum.

FIGS. 9 and 10 are illustrations schematically showing appearances wherein "fine humps 18" are formed on the peripheral surface of a cooling drum, and FIGS. 11 and 12 are illustrations schematically showing appearances wherein "fine holes 19", are formed on the peripheral surface of a cooling drum.

As stated above, a cooling drum for thin slab continuous casting of the present invention (hereunder referred to as "cooling drum of the present invention") secures sufficient "dimple depth" to suppress the generation of "pickling unevenness" and "pickling-unevenness accompanying cracks," and moreover has the functions of delaying the solidification of molten steel at the rims of the dimples while accelerating the invasion of molten steel into the bottoms of the dimples, and accelerating the solidification of the molten steel invading and contacting with the surfaces at the bottom surfaces of the dimples.

Accordingly, in a cooling drum of the present invention, "solidification behavior" on the peripheral surface of the cooling drum is equalized and therefore uneven stress/strain (causing "dimple cracks") generated and accumulated on a dimple-by-dimple basis is reduced.

In a cooling drum of the present invention, even if scum is entrapped between the cooling drum and molten steel to delay the solidification of molten steel portions with scum deposited thereon and a solidifying shell formed is made thinner at the portions with scum deposited thereon, the degree of inequality of the solidifying shell thickness is limited to 20% or less and therefore "strain" (causing "pickling-unevenness accompanying cracks"), that is generated and accumulated in unequal thickness portions of the solidifying shell, is reduced.

In a cooling drum of the present invention, it is preferable that dimples 40 to 200 μm in average depth and 0.5 to 3 mm in diameter of circle equivalent are formed adjacent to each other at the rims of the dimples on the peripheral surface of the cooling drum (see FIG. 6).

If the average depth of the dimple is less than 40 μm, a macroscopic stress/strain relaxation effect of the dimples cannot be obtained and therefore its lower limit is set at 40 μm. On the other hand, if the average depth of the dimples is more than 200 μm, the invasion of molten steel into the bottoms of the dimples becomes insufficient, and therefore its upper limit is set at 200 μm.

It is preferable that the size of the dimples is 0.5 to 3 mm in diameter of circle equivalent. If this diameter is less than 0.5 mm, the invasion of molten steel into the bottoms of the dimples becomes insufficient, and therefore its upper limit is set at 0.5 mm. On the other hand, if the diameter of circle equivalent is more than 3 mm, the accumulation of stress/strain on a dimple-by-dimple basis becomes large to make it easy to generate dimple cracks, and therefore its upper limit is set at 3 mm.

Moreover, it is preferable that "fine humps," "fine holes," or "fine unevenness" each having a required shape are formed on the surface of the dimples of the shape stated above. The shapes required of them are explained hereunder.

(a) Fine Humps

Fine humps 1 to 50 μm in height and 5 to 200 μm in diameter of circle equivalent are formed on the surfaces of dimples of the shape stated above.

If the height is less than 1 μm, the humps cannot make sufficient contact with molten steel to inhibit the generation of solidification nuclei and, therefore, its lower limit is set at 1 μm. On the other hand, if the height is more than 50 μm, the solidification of molten steel is delayed at the bottoms of the humps to cause the inequality of a solidifying shell in the dimples and, therefore, its upper limit is set at 50 μm.

If the diameter of circle equivalent is less than 5 μm, cooling of the humps becomes insufficient to inhibit the generation of solidification nuclei and, therefore, its lower limit is set at 5 μm. On the other hand, if the diameter of circle equivalent is more than 200 μm, molten steel portions insufficiently contacting with the humps are generated to make the generation of solidification nuclei unequal and, therefore, its upper limit is set at 200 μm.

(b) Fine Holes

Fine holes 5 μm or more in depth and 5 to 200 μm in diameter of circle equivalent are formed on the surfaces of dimples of the shape stated above.

If the depth is less than 5 μm, the generation of air gaps at fine hole portions becomes insufficient and the generation of solidification nuclei on dimple surfaces excluding the fine hole portions cannot be reliably achieved and, therefore, its lower limit is set at 5 μm.

If the diameter of circle equivalent is less than 5 μm, a cooling relaxation effect at the fine hole portions cannot be sufficiently exerted and the generation of solidification nuclei can not be limited to dimple surfaces excluding the fine hole portions and, therefore, its lower limit is set at 5 μm. On the other hand, if the diameter of circle equivalent is more than 200 μm, molten steel invades even into the fine hole portions, the molten steel having invaded thereinto solidifies to bind a solidifying shell, which causes strain to concentrate and accelerates the generation of cracks, and therefore its upper limit is set at 200 μm.

(c) Fine Unevenness

Fine unevenness 1 to 50 μm in average depth and 10 to 200 μm in diameter of circle equivalent are formed on the surfaces of dimples of the shape stated above.

If the average depth is less than 1 μm, solidification nuclei are not generated at the unevenness portions, and therefore its lower limit is set at 1 μm. On the other hand, if the average depth is more than 50 μm, solidification at the bottom portions of the unevenness is delayed to cause inequality of the solidifying shell in the dimples, and therefore its upper limit is set at 50 μm.

If the diameter of circle equivalent is less than 10 μm, solidification nuclei are not generated at the unevenness portions, and therefore its lower limit is set at 10 μm. On the other hand, if the diameter of circle equivalent is more than 200 μm, some portions of molten steel do not make sufficient contact with the unevenness portions to cause inequality in the generation of solidification nuclei, and therefore its upper limit is set at 200 μm.

Further, in the cooling drum of the present invention, it is preferable to form fine humps of a required shape adjacent to each other on the rims of dimples to give "roundness" to the rims, or to form "fine holes" of a required shape on the rims, the dimples being "40 to 200 μm in average depth and 0.5 to 3 mm in diameter of circle equivalent" and being formed adjacent to each other at the rims of the dimples on the peripheral surface of the cooling drum. The shapes required of them are now explained.

(d) Fine Humps

Fine humps 1 to 50 μm in height and 30 to 200 μm in diameter of circle equivalent are formed adjacent to each other on the rims of dimples of the shape stated above.

If the height is less than 1 μm, the effect of delaying the generation of solidification nuclei at the rims of the dimples can not be obtained, and therefore its lower limit is set at 1 μm. On the other hand, if the height is more than 50 μm, the invasion of molten steel into the bottoms of the dimples becomes insufficient, and therefore, its upper limit is set at 50 μm.

If the diameter of circle equivalent is less than 30 μm, the effect of delaying the generation of solidification nuclei at the rims of the dimples can not be obtained, and therefore its lower limit is set at 30 μm. On the other hand, if the diameter of circle equivalent is more than 200 μm, the stress/strain relaxation effect of the dimples can not be obtained, and therefore its upper limit is set at 200 μm.

(e) Fine Holes

Fine holes 5 μm or more in depth and 5 to 200 μm in diameter of circle equivalent are formed on the rims of dimples of the shape stated above.

If the depth is less than 5 μm, the formation of air gaps at the fine hole portions becomes insufficient and the effect of delaying the generation of solidification nuclei cannot be obtained, and therefore its lower limit is set at 5 μm.

If the diameter of circle equivalent is less than 5 μm, solidification nuclei are generated in the proximity of the rims other than the fine hole portions and the effect of accelerating the invasion of molten steel into the bottom portions of the dimples cannot be obtained and, therefore, its lower limit is set at 5 μm. On the other hand, if the diameter of circle equivalent is more than 200 μm, the apparent height of the dimple rims is lowered and the effect of relaxing stress/strain cannot be obtained and, therefore, its upper limit is set at 200 μm.

In the present invention, the peripheral surface structure of a cooling drum can be formed by appropriately combining the "fine humps," "fine holes," and "fine unevenness" of (a) to (e) stated above according to the kind of steel, a desired plate thickness, and quality. A cooling drum of the present invention can be used for both single-roll type continuous casting and twin-roll type continuous casting.

Now, a thin slab is explained that is continuously cast by single-roll type continuous casting or twin-roll type continuous casting using a cooling drum of the present invention.

A thin slab of the present invention is made basically in such a manner that molten steel starts to solidify from the originating points of solidification nuclei generated in molten steel portions contacting with the rims of the dimples on the peripheral surface of a cooling drum and then solidifies from the originating points of solidification nuclei generated in molten steel portions contacting with the fine humps, fine holes, or fine unevenness on the surfaces of the dimples stated above.

If the diameter of circle equivalent of the dimples on the peripheral surface of the cooling drum is 0.5 to 3 mm, the originating points of solidification nuclei in molten steel portions contacting with the rims of the dimples are generated along the rims, that is, in a ring shape of 0.5 to 3 mm in diameter of circle equivalent.

It is preferable that the originating points of solidification nuclei generated in molten steel portions contacting with "fine humps," "fine holes," or "fine unevenness" on the surfaces of the dimples are generated at intervals of 250 μm or less.

In other words, it is preferable that "fine humps," "fine holes," or "fine unevenness" at most 200 μm in diameter of circle equivalent are formed at intervals of 250 μm or less on the surfaces of the dimples stated above to accelerate the generation of the originating points of solidification nuclei stated above.

In a thin slab of the present invention, it sometimes happens that "reticular connected depressions" are formed on its surface, and along with this, "fine depressions" and/or "fine humps" are formed in each of regions partitioned by the "reticular connected depressions," which is caused by the fact that molten steel solidifies in contact with the "rims" and "bottom surfaces" of dimples on the peripheral surface of a cooling drum.

The "fine depressions" and/or "fine humps" described above and formed on the surface of the thin slab correspond to "fine holes" or "fine unevenness" in the event that they are formed on the rims of dimples on the peripheral surface of a cooling drum of the present invention.

If the diameter of circle equivalent of the dimples on the peripheral surface of the cooling drum of the present invention is 0.5 to 3 mm, then each of the regions partitioned by the "reticular connected depressions" is a region 0.5 to 3 mm in diameter of circle equivalent corresponding to the diameter of circle equivalent of the dimples.

In each of the regions partitioned by the reticular connected depressions stated above, "fine depressions" and/or "fine humps" are formed by contacting with the fine humps, fine holes, or fine unevenness on the surfaces of the dimples on the peripheral surface of the cooling drum. It is preferable that these "fine depressions" and/or "fine humps" exist at intervals of 250 μm or less.

Most preferably, a thin slab of the present invention is made in such a manner that molten steel starts to solidify from the originating points of solidification nuclei generated along the reticular connected depressions formed on molten steel portions contacting with the rims of the dimples on the peripheral surface of a cooling drum while maintaining the shape of the reticular connected depressions and then solidifies from the originating points of solidification nuclei generated in molten steel portions contacting with the "fine humps," "fine holes," or "fine unevenness" on the surfaces of the dimples described above.

Further preferably, in a thin slab described above, each of the regions partitioned by the reticular connected depressions is a region 0.5 to 3 mm in diameter of circle equivalent and/or the originating points of solidification nuclei generated in molten steel portions contacting with the fine humps, fine holes, or fine unevenness stated above are generated at intervals of 250 μm or less.

Examples of the present invention are explained below. However, the present invention is not restricted to the peripheral surface structures of cooling drums and the conditions of continuous casting used in the examples, and to the shapes/structures of thin slabs acquired by the peripheral surface structures and under the conditions of continuous casting.

EXAMPLE 1

SUS304 stainless steels were cast into strip-shaped thin slabs 3 mm in thickness by a twin drum type continuous caster and then the slabs were cold-rolled to produce sheet products 0.5 mm in thickness. In order to cast the stainless steels into the strip-shaped thin slabs stated above, the peripheral surface of a cooling drum 1,330 mm in width and 1,200 mm in diameter was processed under the conditions shown in Table 1. The "dimples" in Table 1 were formed by shot blasting.

The surface quality of the finally acquired sheet products is shown in Tables 1, 2 (continued from Table 1), and 3 (continued from Table 2).

Cracks and uneven luster were judged by visual observation after the thin slabs were cold-rolled, pickled, and annealed. Structures of the slabs were judged by microscope observation after their surfaces were polished and etched. Roughness of their surfaces was measured by a three-dimensional roughness gage.

TABLE 1

| No. | Dimple Depth (μm) | Dimple Diameter (mm) | Shape of dimple rim Shape | Shape of dimple rim Height, Depth (μm) | Shape of dimple rim Height, Diameter (μm) | Shape of dimple surface Shape | Shape of dimple surface Height, Depth (μm) | Shape of dimple surface Height, Diameter (μm) | Starting point of solidification nuclei generation: Diameter of ring-shaped starting point (mm) | Starting point of solidification nuclei generation: Starting point interval within ring-shaped starting point (μm) |
|---|---|---|---|---|---|---|---|---|---|---|
| 1 | 40 | 1 | — | | | Hump | 1 | 50 | 1 | 200 |
| 2 | 100 | 2 | — | | | Hump | 50 | 100 | 2 | 100 |
| 3 | 150 | 0.8 | — | | | Hump | 30 | 5 | 0.8 | 250 |
| 4 | 200 | 2 | — | | | Hump | 40 | 200 | 2 | 150 |
| 5 | 100 | 2 | — | | | Fine hole | 5 | 40 | 2 | 200 |
| 6 | 40 | 3 | — | | | Fine hole | 100 | 150 | 3 | 150 |
| 7 | 200 | 0.5 | — | | | Fine hole | 40 | 10 | 0.5 | 200 |
| 8 | 150 | 2 | — | | | Fine hole | 60 | 200 | 2 | 250 |
| 9 | 50 | 1 | — | | | Fine unevenness | 1 | 50 | 1 | 150 |
| 10 | 200 | 1.5 | — | | | Fine unevenness | 50 | 100 | 1.5 | 200 |
| 11 | 80 | 2 | — | | | Fine unevenness | 20 | 10 | 2 | 150 |
| 12 | 150 | 2 | — | | | Fine unevenness | 40 | 200 | 2 | 200 |

| No. | Slab surface shape: Diameter of reticular depression (mm) | Slab surface shape: Depression interval within reticular depression (μm) | Quality: Dimple crack | Quality: Pickling-unevenness accompanying crack | Quality: Pickling unevenness |
|---|---|---|---|---|---|
| 1 | 1 | 200 | ◎ | ○ | ○ |
| 2 | 2 | 100 | ◎ | ◎ | ◎ |
| 3 | 0.8 | 250 | ○ | ◎ | ◎ |
| 4 | 2 | 150 | ○ | ◎ | ◎ |
| 5 | 2 | 200 | ◎ | ◎ | ◎ |
| 6 | 3 | 150 | ◎ | ○ | ○ |
| 7 | 0.5 | 200 | ○ | ◎ | ◎ |
| 8 | 2 | 250 | ◎ | ◎ | ◎ |
| 9 | 1 | 150 | ◎ | ○ | ○ |
| 10 | 1.5 | 200 | ○ | ◎ | ◎ |
| 11 | 2 | 150 | ◎ | ◎ | ◎ |
| 12 | 2 | 200 | ○ | ◎ | ◎ |

TABLE 2

(continued from Table 1)

| No. | Dimple Depth (μm) | Dimple Diameter (mm) | Shape of dimple rim Shape | Shape of dimple rim Height, Depth (μm) | Shape of dimple rim Height, Diameter (μm) | Shape of dimple surface Shape | Shape of dimple surface Height, Depth (μm) | Shape of dimple surface Height, Diameter (μm) | Starting point of solidification nuclei generation: Diameter of ring-shaped starting point (mm) | Starting point of solidification nuclei generation: Starting point interval within ring-shaped starting point (μm) |
|---|---|---|---|---|---|---|---|---|---|---|
| 13 | 50 | 1 | Hump | 1 | 150 | — | | | 1 | 270 |
| 14 | 140 | 2 | Hump | 50 | 80 | — | | | 2 | 260 |

TABLE 2-continued (continued from Table 1)

| | | | | | | | | | | |
|---|---|---|---|---|---|---|---|---|---|---|
| 15 | 100 | 0.5 | Hump | 20 | 30 | — | | | 0.5 | 310 |
| 16 | 80 | 1.5 | Hump | 8 | 200 | — | | | 1.5 | 280 |
| 17 | 120 | 1 | Hump | 1 | 100 | Hump | 1 | 50 | 1 | 150 |
| 18 | 150 | 2 | Hump | 50 | 150 | Hump | 50 | 150 | 2 | 160 |
| 19 | 100 | 1.8 | Hump | 30 | 30 | Hump | 20 | 5 | 1.8 | 110 |
| 20 | 140 | 3 | Hump | 5 | 200 | Hump | 30 | 200 | 3 | 210 |
| 21 | 60 | 2.5 | Hump | 1 | 70 | Fine hole | 5 | 50 | 2.5 | 80 |
| 22 | 150 | 2.8 | Hump | 50 | 130 | Fine hole | 100 | 100 | 2.8 | 50 |
| 23 | 100 | 2.2 | Hump | 40 | 30 | Fine hole | 150 | 10 | 2.2 | 100 |
| 24 | 80 | 2.5 | Hump | 10 | 200 | Fine hole | 50 | 200 | 2.5 | 250 |
| 25 | 110 | 3 | Hump | 50 | 80 | Fine unevenness | 20 | 120 | 3 | 200 |
| 26 | 100 | 1.2 | Hump | 1 | 140 | Fine unevenness | 50 | 60 | 1.2 | 130 |
| 27 | 80 | 2.8 | Hump | 20 | 30 | Fine unevenness | 1 | 10 | 2.8 | 90 |
| 28 | 100 | 1.6 | Hump | 9 | 200 | Fine unevenness | 30 | 200 | 1.6 | 250 |

| | Slab surface shape | | Quality | | |
|---|---|---|---|---|---|
| | Diameter | Depression interval | | | |
| No. | of reticular depression (mm) | within reticular depression (μm) | Dimple crack | Pickling-unevenness accompanying crack | Pickling unevenness |
| 13 | 1 | 270 | ○ | ◎ | ○ |
| 14 | 2 | 260 | ○ | ◎ | ◎ |
| 15 | 0.5 | 310 | ○ | ◎ | ◎ |
| 16 | 1.5 | 280 | ○ | ◎ | ◎ |
| 17 | 1 | 150 | ◎ | ◎ | ◎ |
| 18 | 2 | 160 | ◎ | ◎ | ◎ |
| 19 | 1.8 | 110 | ◎ | ◎ | ◎ |
| 20 | 3 | 210 | ◎ | ◎ | ◎ |
| 21 | 2.5 | 80 | ◎ | ◎ | ○ |
| 22 | 2.8 | 50 | ◎ | ◎ | ◎ |
| 23 | 2.2 | 100 | ◎ | ◎ | ◎ |
| 24 | 2.5 | 250 | ◎ | ◎ | ◎ |
| 25 | 3 | 200 | ◎ | ◎ | ◎ |
| 26 | 1.2 | 130 | ◎ | ◎ | ◎ |
| 27 | 2.8 | 90 | ◎ | ◎ | ◎ |
| 28 | 1.6 | 250 | ◎ | ◎ | ◎ |

TABLE 3

(continued from Table 2)

| | Dimple | | Shape of dimple rim | | | Shape of dimple surface | | | Starting point of solidification nuclei generation | |
|---|---|---|---|---|---|---|---|---|---|---|
| No. | Depth (μm) | Diameter (mm) | Shape | Height, Depth (μm) | Diameter (μm) | Shape | Height, Depth (μm) | Diameter (μm) | Diameter of ring-shaped starting point (mm) | Starting point interval within ring-shaped starting point (μm) |
| 29 | 60 | 2 | Fine hole | 5 | 200 | — | | | 2 | 260 |
| 30 | 80 | 1 | Fine hole | 150 | 10 | — | | | 1 | 300 |
| 31 | 200 | 2.5 | Fine hole | 50 | 10 | — | | | 2.5 | 270 |
| 32 | 150 | 2 | Fine hole | 100 | 200 | — | | | 2 | 280 |

TABLE 3-continued (continued from Table 2)

| | | | | | | | | | | |
|---|---|---|---|---|---|---|---|---|---|---|
| 33 | 160 | 1 | Fine hole | 5 | 15 | Hump | 1 | 20 | 1 | 180 |
| 34 | 190 | 3 | Fine hole | 100 | 50 | Hump | 50 | 100 | 3 | 150 |
| 35 | 60 | 2.6 | Fine hole | 80 | 10 | Hump | 20 | 5 | 2.6 | 100 |
| 36 | 120 | 2.5 | Fine hole | 20 | 200 | Hump | 30 | 200 | 2.5 | 250 |
| 37 | 80 | 1.8 | Fine hole | 5 | 10 | Fine hole | 5 | 90 | 1.8 | 150 |
| 38 | 200 | 2 | Fine hole | 100 | 200 | Fine hole | 100 | 170 | 2 | 200 |
| 39 | 150 | 0.7 | Fine hole | 50 | 10 | Fine hole | 60 | 10 | 0.7 | 50 |
| 40 | 100 | 1.5 | Fine hole | 10 | 100 | Fine hole | 20 | 200 | 1.5 | 220 |
| 41 | 90 | 2.3 | Fine hole | 5 | 200 | Fine unevenness | 1 | 190 | 2.3 | 220 |
| 42 | 150 | 1.8 | Fine hole | 50 | 100 | Fine unevenness | 50 | 60 | 1.8 | 100 |
| 43 | 80 | 1.2 | Fine hole | 100 | 10 | Fine unevenness | 20 | 10 | 1.2 | 80 |
| 44 | 180 | 2.6 | Fine hole | 150 | 50 | Fine unevenness | 30 | 200 | 2.6 | 250 |
| Comparative example 1 | 50 | 1.2 | — | | | — | | | 1.2 | None |
| Comparative example 2 | 100 | 1.2 | — | | | — | | | 1.2 | None |
| Comparative example 3 | 150 | 1.2 | — | | | — | | | 1.2 | None |

| | Slab surface shape | | Quality | | |
|---|---|---|---|---|---|
| | Diameter | Depression interval | | | |
| No. | of reticular depression (mm) | within reticular depression (μm) | Dimple crack | Pickling-unevenness accompanying crack | Pickling unevenness |
| 29 | 2 | 260 | ○ | ◎ | ○ |
| 30 | 1 | 300 | ○ | ◎ | ◎ |
| 31 | 2.5 | 270 | ○ | ◎ | ◎ |
| 32 | 2 | 280 | ○ | ◎ | ◎ |
| 33 | 1 | 180 | ◎ | ◎ | ◎ |
| 34 | 3 | 150 | ◎ | ◎ | ◎ |
| 35 | 2.6 | 100 | ◎ | ◎ | ○ |
| 36 | 2.5 | 250 | ◎ | ◎ | ◎ |
| 37 | 1.8 | 150 | ◎ | ◎ | ◎ |
| 38 | 2 | 200 | ◎ | ◎ | ◎ |
| 39 | 0.7 | 50 | ◎ | ◎ | ◎ |
| 40 | 1.5 | 220 | ◎ | ◎ | ◎ |
| 41 | 2.3 | 220 | ◎ | ◎ | ◎ |
| 42 | 1.8 | 100 | ◎ | ◎ | ◎ |
| 43 | 1.2 | 80 | ◎ | ◎ | ◎ |
| 44 | 2.6 | 250 | ◎ | ◎ | ◎ |
| Comparative example 1 | 1.2 | None | ○ | X | X |
| Comparative example 2 | 1.2 | None | ○ | X | X |
| Comparative example 3 | 1.2 | None | X | ○ | ○ |

2) A second embodiment of the present invention, which includes various sub-embodiments, will be described.

In order to prevent surface cracks of a thin slab, it is necessary to slow-cool a solidifying shell by forming a gas gap between a cooling drum and the solidifying shell, to cause solidification to start from the peripheral portions of transferred humps by forming the humps transferred by dimples on the surface of the slab, and to equalize the solidification in the width direction. Meanwhile, in the event that the thin slab is rolled on an in-line basis after it is cast, rolled-in scale defects are generated in the rolled thin slab and the defects remain in the sheet product after it is cold-rolled.

The rolled-in scale defects are preferentially generated in portions with higher transferred humps among the portions of transferred humps, that is, portions corresponding to deeper dimples among the dimples formed on the peripheral surface of the cooling drum. In the event that the thin slab is not rolled on an in-line basis after it is cast, no rolled-in scale defects are generated, but the transferred humps do not disappear and their traces remain even after it is cold-rolled.

Dimples formed on the peripheral surface of the cooling drum are worn away by extended casting and that causes a shorter service life of the cooling drum. It was found out that, in order to suppress the rolled-in scale defects caused by the transferred humps and the shorter service life caused by the wear of the dimples, dimples having a small difference between the maximum depth and the average depth were effective, and it was made clear that the range of dimple depth distribution could be smaller if the range (the maximum diameter–the minimum diameter) of grain diameter distribution of the shot was made smaller.

In shot blasting, shot satisfying the expression, the maximum diameter≦the average diameter+0.30 mm, were used, and, in order to acquire a desired average depth in dimple depth distribution, the average diameter of used shot was increased or the blast pressure in shot blasting was increased when the hardness of the peripheral surface of a cooling drum was high.

Figure 13:
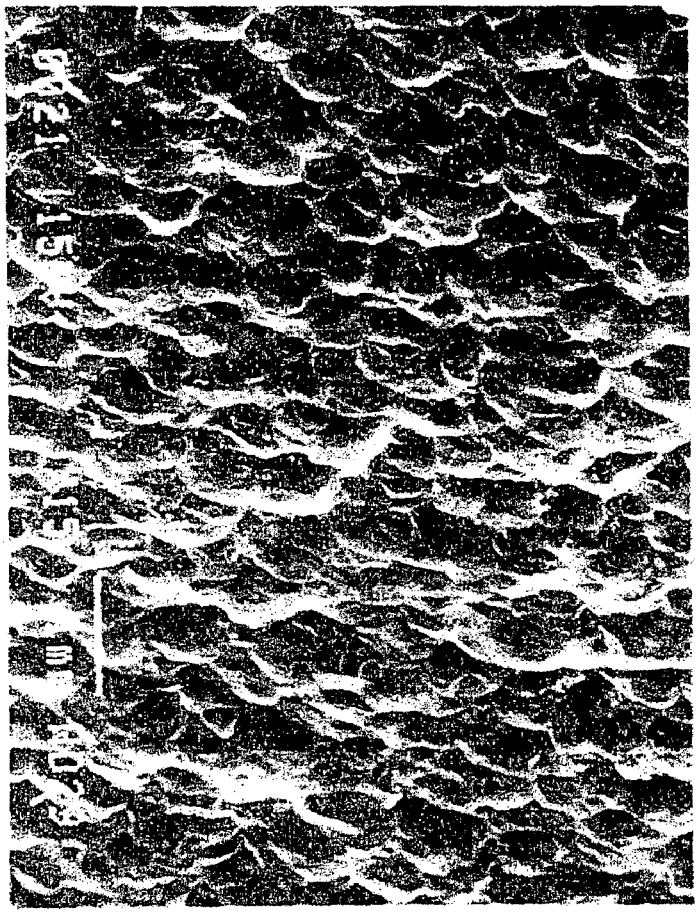
FIG. 13 is a view showing the result of observing (photographing) (under 15 magnifications) a replica with 45° diagonally by an electron microscope after the replica is taken from the dimples on the peripheral surface of a conventional cooling drum.
Figure 14:
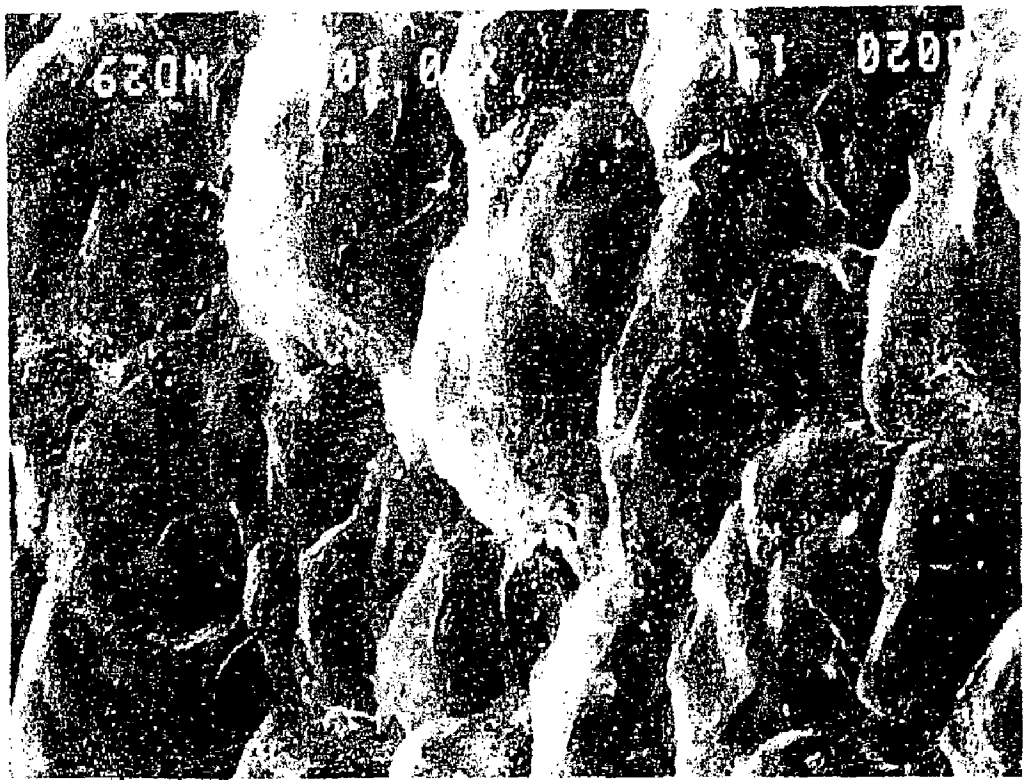
FIG. 14 is a view showing the result of observing (photographing) (under 50 magnifications) a replica with 45° diagonally by an electron microscope after the replica is taken from the dimples on the peripheral surface of a conventional cooling drum.

However, fine surface cracks were still generated on the surface of a slab cast by using a cooling drum with dimples formed thereon based on the facts stated above. Because of this, the present inventors observed the then available dimples in detail. The result thereof is shown in FIGS. 13 and 14. FIGS. 13 and 14 show the roughness of the surface obtained by forming dimples 2.1 mm in average diameter and 130 μm in average depth on the peripheral surface of a cooling drum using conventional shot blasting which is the most commonly used method, taking a replica of the dimples on the peripheral surface of the cooling drum, and then observing (photographing) the replica obliquely at an angle of 45° under a magnification of 15 times (FIG. 13) and 50 times (FIG. 14) with an electron microscope.

In FIGS. 13 and 14, the roughness of dimples is clear and the diameter of dimples reaches 4,000 μm and the depth thereof exceeds 100 μm. In such dimples, because they are large in both diameter and depth, fast cooling portions and slow cooling portions exist in a mixed state when a solidifying shell is formed. This naturally causes an excessively slow cooling phenomenon to occur in the concavity of dimples formed on the peripheral surface of a cooling drum, and on the other hand, a fast cooling phenomenon to occur in the convexity thereof.

Further, in a solidifying phenomenon during casting, since solidification starts from portions in contact with dimples, difference between fast cooling and slow cooling becomes excessively large at portions where the diameter or depth of the dimples is large and thus fine cracks tend to be easily generated on a dimple-by-dimple basis.

The present inventors formed fine unevenness 10 to 50 μm in average diameter and 1 to 50 μm in average depth and fine humps 1 to 50 μm in height generated by the intrusion of alumina grit fragments on the peripheral surface of a cooling drum by forming dimples 1.0 to 4.0 mm in average diameter and 40 to 170 μm in average depth on the peripheral surface of the cooling drum and then by spraying very fine alumina grit of tens to hundreds of microns, in average diameter, on the dimples.

In this event, some of the alumina grit collides with the peripheral surface of the drum to form dimples and some is broken at the moment of the collision into fragments which stick into the peripheral surface of the drum and remain as fragments intruded in the peripheral surface of the drum to form acute-angled or obtuse-angled fine humps. Accordingly, fine unevenness and fine humps are formed additionally in the conventional dimples having large diameters and large depths. The fine unevenness are of 10 to 50 μm in average diameter and 1 to 50 μn in average depth and the fine humps are of 1 to 50 μm in height.

Figure 15:
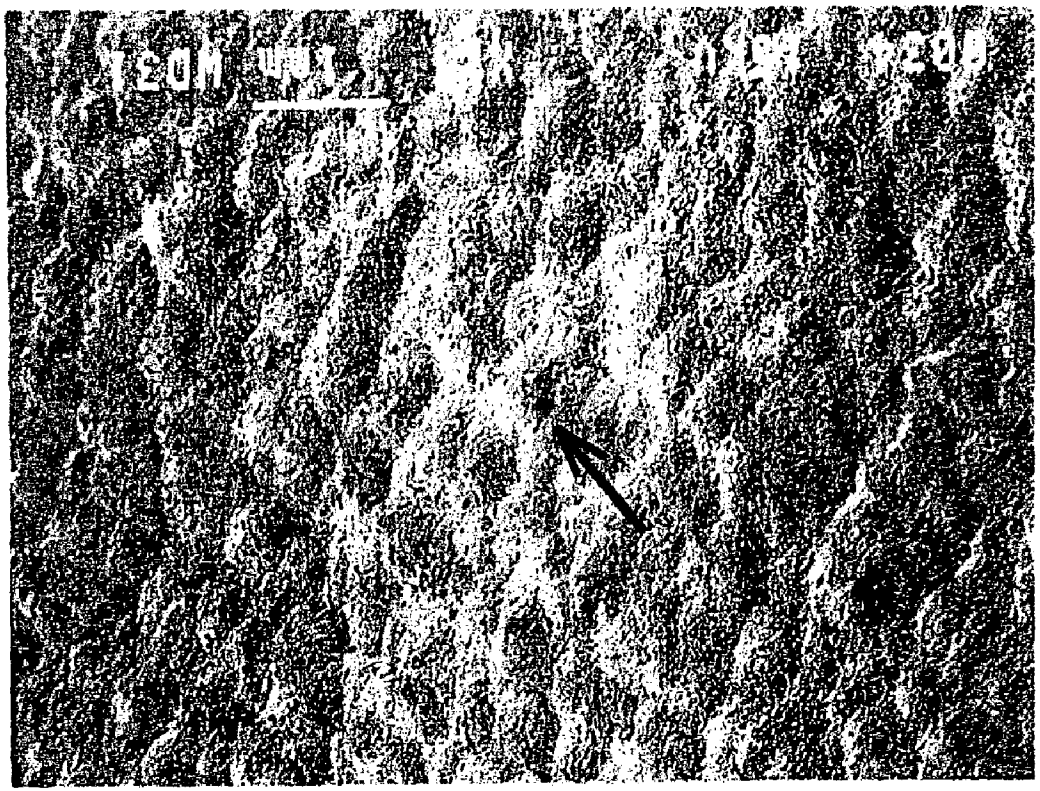
FIG. 15 is a view showing the result of observing (photographing) (under 15 magnifications) a replica with 45° diagonally by an electron microscope after the replica is taken from the dimples on the peripheral surface of a cooling drum according to the present invention.
Figure 16:
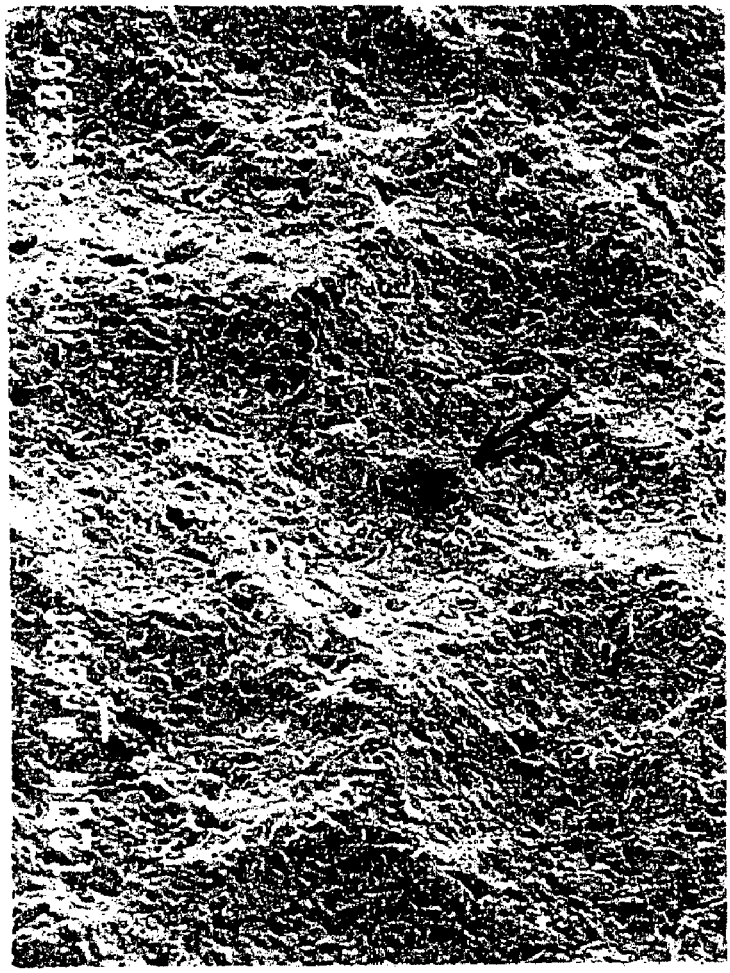
FIG. 16 is a view showing the result of observing (photographing) (under 50 magnifications) a replica with 45° diagonally by an electron microscope after the replica is taken from the dimples on the peripheral surface of a cooling drum according to the present invention.
Figure 17:
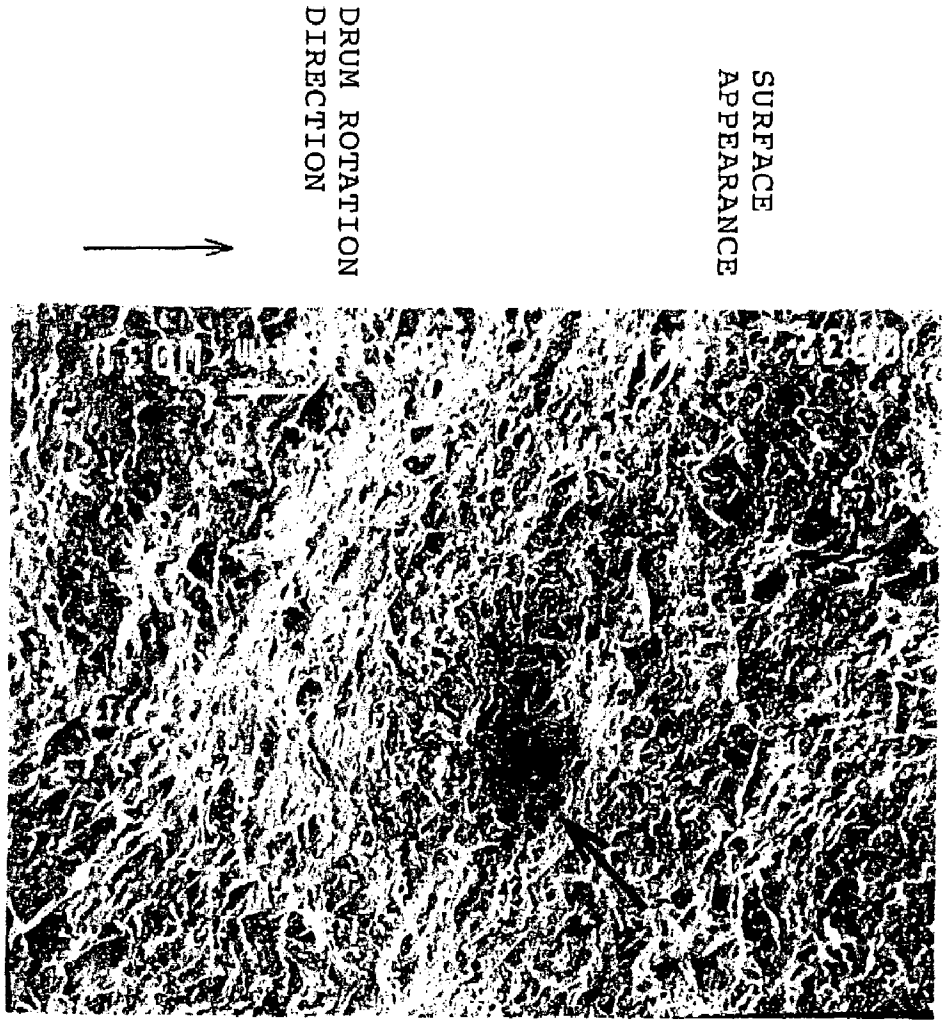
FIG. 17 is a view showing the result of observing (photographing) (under 100 magnifications) a replica 45° diagonally with an electron microscope after the replica is taken from the dimples on the peripheral surface of a cooling drum according to the present invention.

FIGS. 15, 16 and 17 show the results (surface ruggedness) of the observation in which a replica is taken from the dimples thus formed on the peripheral surface of the cooling drum, and then the replica is observed (photographed) obliquely at an angle of 45° under a magnification of 15 times (FIG. 15), 50 times (FIG. 16) and 100 times (FIG. 17) with an electron microscope. The state of the fine unevenness formed in the dimples can be seen in FIGS. 15 (15 times) and 16 (50 times).

In FIG. 17 (100 times), a portion into which an alumina grit segment intrudes can be seen as indicated by an arrow. In the case of such dimples, since solidification starts not only from the dimples but also from the convexities of the fine unevenness and from the fine humps, the distributions of fast cooling portions and slow cooling portions are narrowed and thus cooling can be more equalized when a solidifying shell is formed.

In the present invention, alumina grit of tens to hundreds of μm is used to form fine unevenness of the size stated above. If the size of the alumina grit is less than tens of μm, the fine unevenness are hardly formed and grit fragments forming fine humps become too small to acquire the effect of forming humps. On the other hand, if the size is more than hundreds of μm, it exceeds the size (40 to 200 μm in average depth) of the previously formed dimples and grit fragments become excessively large. For this reason, the size of alumina grit used is set at tens to hundreds of μm. Preferably, the alumina grit is about 50 to 100 μm in size.

The size of dimples formed by an ordinary shot blasting method, a photoetching method, laser material processing, or the like, is enough for the size of dimples first formed according to the present invention, and it is preferable that the size is 1.0 to 4.0 mm in average diameter and 40 to 200 μm in average depth. Further it is preferable that the size of fine unevenness further formed by spraying alumina grit of tens to hundreds of μm on the surfaces of the dimples formed in such a size is 10 to 50 μm in average diameter and 1 to 50 μm in average depth, and moreover the size of fine unevenness is equal to or less than the average depth of ordinary dimples.

Fine humps formed according to the present invention are of 1 to 50 μm in height. For the formation of fine unevenness, though alumina grit is used, a plating method using a solution comprising one or more of Ni, Co, Co—Ni alloy, Co—W alloy, and Co—Ni—W alloy or a flame spraying method is also applicable.

According to the present invention, as stated above, the solidification starting points of molten steel are dispersed more finely than in the case of ordinary dimples by further forming fine unevenness or fine humps formed by the intrusion of fine alumina grit fragments in the ordinary dimples formed by an ordinary method, and thus the generation of fine cracks on a slab during its cooling can be reliably prevented.

EXAMPLE 2

Examples will be explained hereunder. In the present invention, casting was performed by using aforementioned cooling drums under an atmosphere of a non-oxidizing gas soluble in molten steel, or the mixture of a non-oxidizing gas soluble in molten steel and a non-oxidizing gas insoluble in molten steel, and the dimples of the cooling drums according to the present invention were transferred to the cast slab.

As shown in Table 4, dimples 1.5 to 3.0 mm in average diameter and 30 to 250 μm in average depth were formed as the base dimples on the peripheral surface of a copper-made cooling drum 1,000 mm in diameter by a conventional shot blasting method. The comparative examples were the cases of the cooling drums wherein: the base dimples were formed by a shot blasting method and applied as they were; the depth of base dimples was exceedingly small or large; or the diameter or depth of fine unevenness, even if they were formed, or the height of fine humps was outside the range specified by the present invention.

On the other hand, in the example of the present invention, fine unevenness 10 to 50 μm in average diameter and 1 to 50 μm in average depth were formed by additionally blasting alumina grit about 50 to 100 μm in size onto above-mentioned base dimples and simultaneously fine humps 1 to 50 μm in height were formed by intruding the fragments of above-mentioned alumina grit into the surface of the fine unevenness. The results are also shown in above-mentioned Table 4.

base dimples was exceedingly small and, further, neither fine unevenness nor fine humps were formed, large slab cracks of 17.0 mm/m$^2$ occurred.

It is considered that this is attributed to the lack of a sufficient slow cooling effect because the depth of the base dimples is exceedingly small. Further, similarly, in the comparative example of No. 6, although fine unevenness and fine humps were formed, the depth of the base dimples was exceedingly small, and therefore large slab cracks of 15.0 mm/m$^2$ occurred. In this comparative example, it is considered that, as the depth of the base dimples is exceedingly small, the effects of the fine unevenness and the fine humps are not exhibited.

Further, in the comparative example of No. 9, the average depth of the base dimples was 250 μm and exceedingly large and, in combination with the influence of absence of fine unevenness and fine humps, slab cracks of 5.0 mm/m$^2$ occurred. In the comparative example of No. 10, though fine unevenness and fine humps were formed in the dimples as large as 250 μm in depth, the base dimples were excessively deep, and the effects of the fine unevenness and the fine humps were not exhibited. Therefore, slab cracks of 3.0 mm/m$^2$ occurred.

TABLE 4

| | Base dimple | | Fine unevenness | | | | |
|---|---|---|---|---|---|---|---|
| No. | Average depth (μm) | Average diameter (mm) | Diameter (μm) | Depth (μm) | Height of fine hump (μm) | Incidence of crack (mm/m$^2$) | Remarks |
| 1 | 130 | 2.1 | None | | | 0.2 | Comparative example |
| 2 | 130 | 2.1 | 10–50 | 1–50 | 1–50 | 0.0 | Invented example |
| 3 | 130 | 2.1 | 1–5 | 1–50 | 1–50 | 0.1 | Comparative example |
| 4 | 130 | 2.1 | 10–50 | <1 | <1 | 0.1 | Comparative example |
| 7 | 100 | 2.0 | None | | | 0.3 | Comparative example |
| 8 | 100 | 2.0 | 10–50 | 1–50 | 1–50 | 0.0 | Invented example |
| 5 | 30 | 1.5 | None | | | 17.0 | Comparative example |
| 6 | 30 | 1.5 | 10–50 | 1–50 | 1–50 | 15.0 | Comparative example |
| 9 | 250 | 3.0 | None | | | 5.0 | Comparative example |
| 10 | 250 | 3.0 | 10–50 | 1–50 | 1–50 | 3.0 | Comparative example |

In Table 4, Nos. 2 and 8 are the examples of the present invention, and the remaining Nos. 1, 3 to 7, 9 and 10 are all comparative examples. In Nos. 2 and 8 of the examples of the present invention, no cracks occurred on slab surface.

On the other hand, in the comparative examples of Nos. 1 and 7 wherein the conventional base dimples were applied as they were, cracks occurred at the incidence of 0.2 mm/m$^2$ and 0.3 mm/m$^2$ respectively. In the example of No. 3, since the diameter of the fine unevenness was exceedingly small, slab cracks of 0.1 mm/m$^2$ occurred although fine unevenness were formed.

In the example of No. 4 wherein the depth of the fine unevenness was exceedingly small and also the height of the fine humps was exceedingly small, slab cracks of 0.1 mm/m$^2$ occurred. In the example of No. 5, as the depth of the 3) A third embodiment of the present invention, which includes various sub-embodiments, will be described.

Up to now, dimples on the peripheral surface of a cooling drum have been formed by a processing means such as shot blasting, photoetching or laser material processing, having an average diameter of 1.0 to 4.0 mm, the maximum diameter of 1.5 to 7.0 mm, an average depth of 40 to 170 μm, and the maximum depth of 50 to 250 μm based on the long term research and actual operation results. However, fine surface cracks have still occurred on the surface of a cast slab as described in the preceding paragraph 2). To cope with that, the present inventors observed the state of the conventional dimples further in detail. As a result of the observation, it was found that a super cooling phenomenon of molten steel took place and fine cracks occurred in a cast slab wherein the portions between adjoining dimples had a trapezoidal shape and moreover the portions were transferred in the region having the mutual distance of 1 mm or more.

Namely, it was discovered that some of the convexities of ruggedness inevitably became trapezoidal by a conventional processing method when forming dimples by shot blasting and, because of this, above-mentioned cracks and crevices occurred on a cast slab, and therefore, it was important to reduce the trapezoidal convexities, to increase the density of dimples and, further, to form dimples with narrower intervals between adjoining dimples on the peripheral surface of a cooling drum.

Then, the present inventors discovered that slab cracks could be eliminated by: measuring surface ruggedness with a two-dimensional roughness gage after dimples were formed; approximating the incidence of the trapezoidal portions to the incidence of the area where the plateau of the ruggedness existed continuously over a distance of 2 mm or more; defining the incidence of said area as the defective waveform rate, and then controlling the defective waveform rate to 3% or less, preferably to 2.5% or less.

Further, the present inventors discovered that, for solving the problem, it was necessary to control the diameter of shot blasting grit, which conventionally varied in size, within the range of 1.5 to 2.5 mm when it was used for shot blasting, and to optimize the nozzle shape and the blasting pressure when shot blasting was applied.

Figure 4:
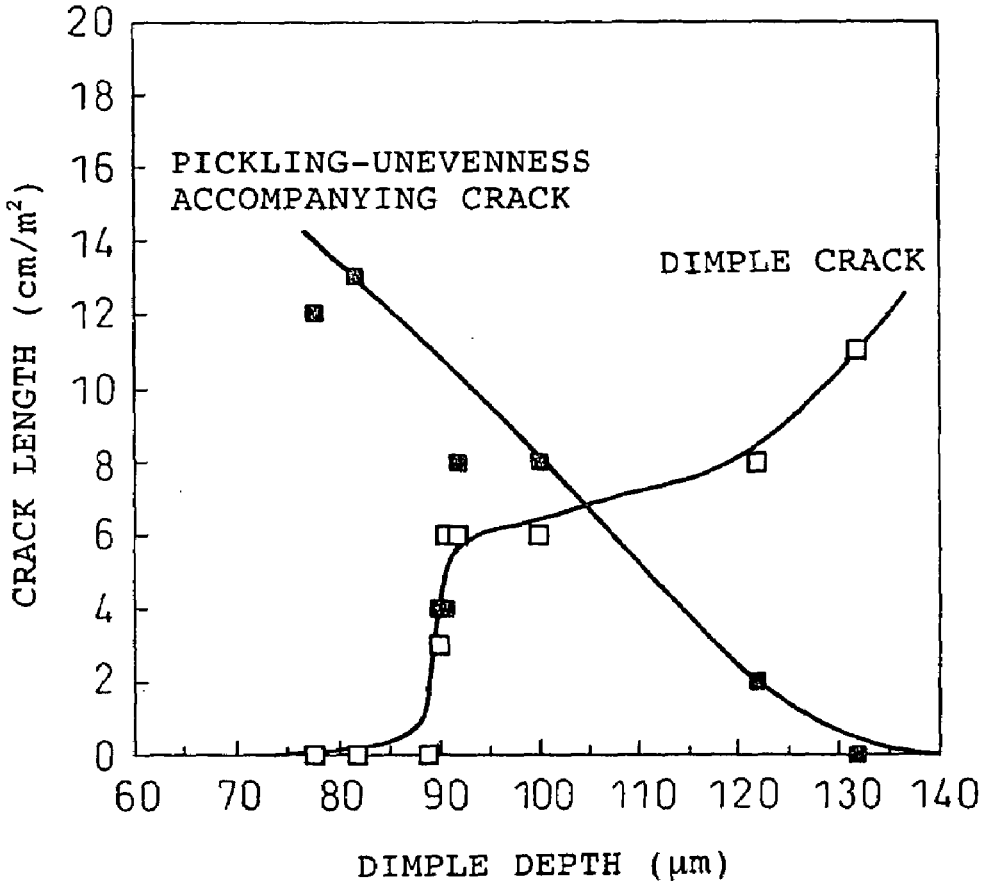
FIG. 4 is a graph showing the relation between "dimple depth" (appearance of solidification) and "crack length" (generation status) of "dimple crack" and "pickling-unevenness accompanying crack."
Figure 5:
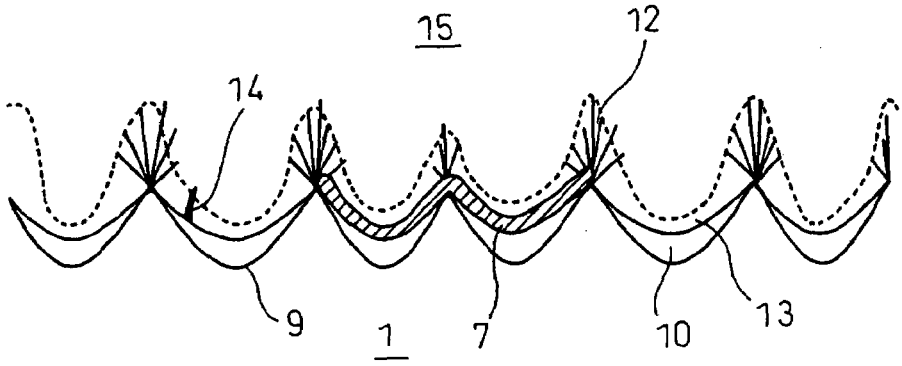
FIG. 5 is an illustration schematically showing the generation mechanism of the "dimple crack."
Figure 18:
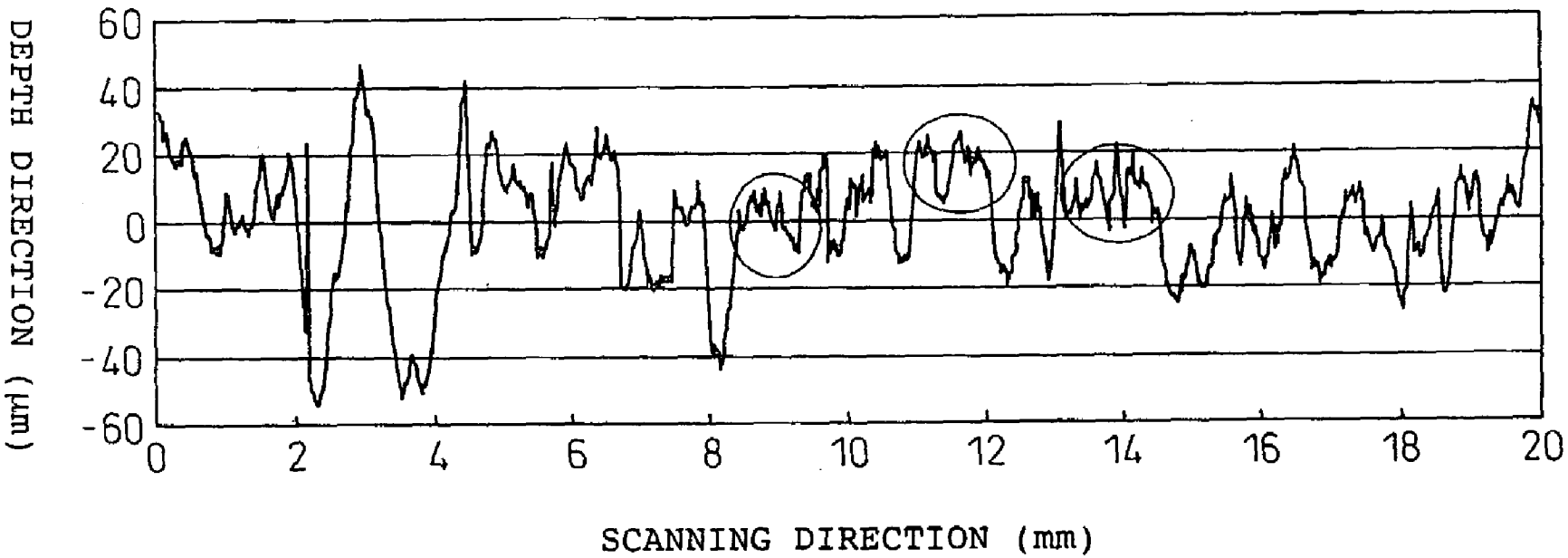
FIG. 18 is a graph showing a part of the result (appearance percentage of plateau portions: 7.5%) of measuring the dimples on the peripheral surface of a conventional cooling drum with a two-dimensional roughness gage.
Figure 19:
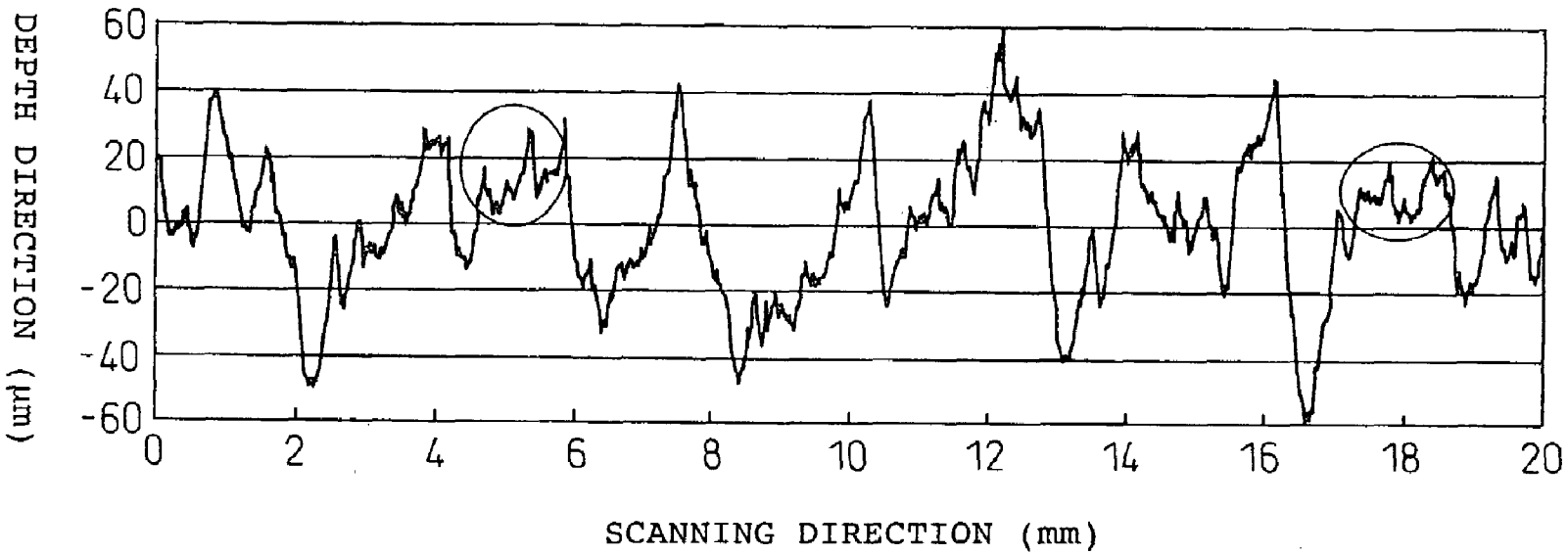
FIG. 19 is a graph showing a part of the result (appearance percentage of plateau portions: 4.2%) of measuring the dimples on the peripheral surface of a conventional cooling drum with a two-dimensional roughness gage.
Figure 20:
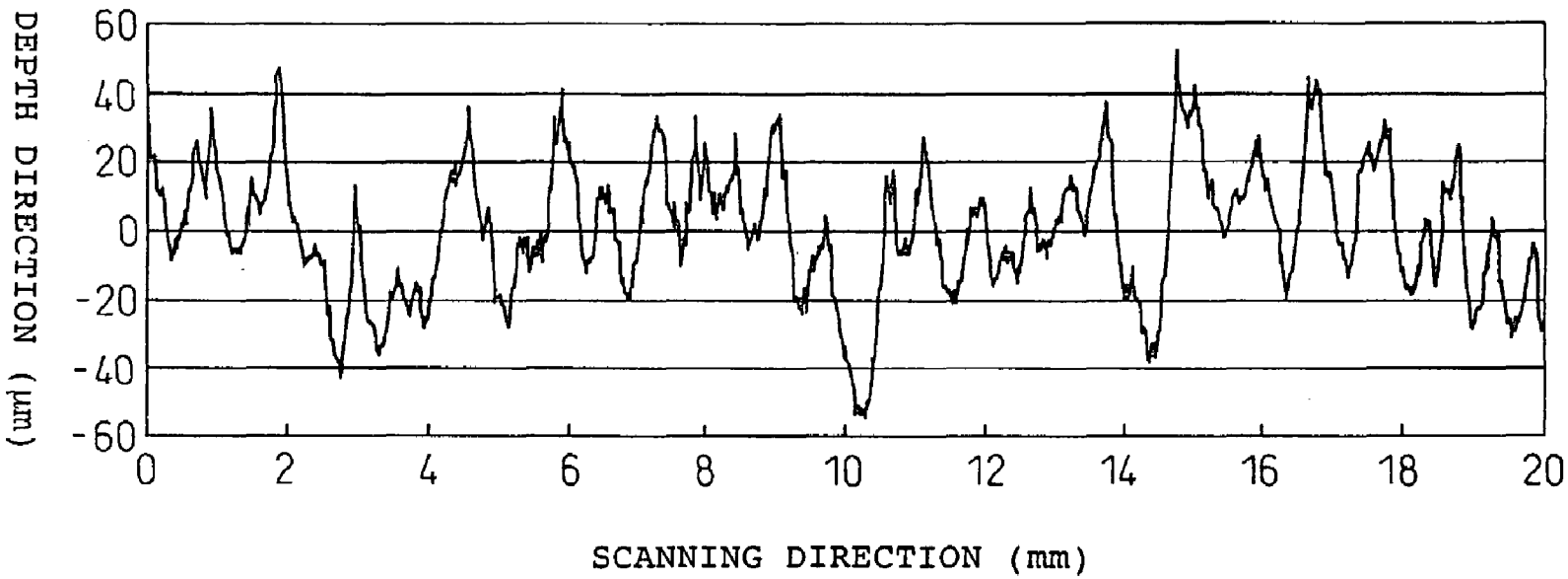
FIG. 20 is a graph showing a part of the result (appearance percentage of plateau portions: 1.1%) of measuring the dimples on the peripheral surface of a cooling drum according to the present invention with a two-dimensional roughness gage.

FIGS. 18, 19 and 20 show some parts of the results of measuring the surface ruggedness of cooling drums, after dimples are formed, with a two-dimensional roughness gage. The incidence of the trapezoidal portions, namely, the incidence of the area where the plateau of the ruggedness exists continuously over a distance of 2 mm or more, against the entire measured length of 180 mm accounts for 7.5% in FIG. 18 and 4.2% in FIG. 19. In these cases, fine cracks occurred on the cast slab. Encircled portions in FIGS. 18 and 19 indicate defective waveforms. On the other hand, in FIG. 20, the aforementioned incidence of the trapezoidal portions is 1.1%, and the occurrence of fine cracks on the cast slab was scarcely observed. Here, in order to determine an incidence to the order of several percents, measured length should be at least 50 mm, more preferably 100 mm or more.

Solidification starting points of molten steel can be finely dispersed and fine cracks of cast slabs that occur during cooling can certainly be prevented by: using the aforementioned cooling drum according to the present invention; casting molten steel under an atmosphere of a non-oxidizing gas soluble in molten steel, or the mixture of a non-oxidizing gas soluble in molten steel and a non-oxidizing gas insoluble in molten steel; and transferring the dimples of the cooling drum formed according to the present invention to the surface of the cast slab.

EXAMPLE 3

Examples will be explained hereunder. In the present invention, continuous casting was performed by using the aforementioned cooling drums under an atmosphere of a non-oxidizing gas soluble in molten steel, or the mixture of a non-oxidizing gas soluble in molten steel and a non-oxidizing gas insoluble in molten steel, and the dimples of the cooling drums according to the present invention were transferred to the cast slab.

As shown in Table 5, various dimples within the range of 30 to 250 μm in average depth and 1.5 to 3.0 mm in average diameter were formed, as the base dimples on the peripheral surface of a copper-made cooling drum 1,000 mm in diameter, by spraying the shot blasting grit 1.5 to 2.5 mm in diameter, and then the defective waveform rate and the incidence of cracks were measured. The results are also shown in Table 5.

In Table 5, examples of Nos. 3, 4 and 8 are of the present invention, and the remaining Nos. 1, 2, 5 to 7, 9 and 10 are all comparative examples. In the examples of the present invention of Nos. 3, 4 and 8, the slab cracks were not observed at all. On the other hand, in the comparative examples of Nos. 1 and 2, the defective waveform rate was as high as 7.5% and 4.2% respectively, and therefore, slab cracks having crack incidence of 0.5 mm/m$^2$ and 0.2 mm/m$^2$ respectively occurred.

In the comparative examples of Nos. 5 and 7, the defective waveform rate was as high as 4.2% and 4.5% respectively, and for that reason, slab cracks having crack incidence of 17.0 mm/m$^2$ and 0.3 mm/m$^2$ respectively occurred. The example of No. 5, in particular, shows a case in which the slow cooling effect was insufficient because the base dimples were exceedingly shallow.

Further, in the comparative example of No. 6, a high crack incidence of 15.0 mm/m$^2$ was exhibited with the defective waveform rate being as low as 1.1%. This is attributed to, similarly to the case of No. 5, exceedingly shallow dimples and an insufficient slow cooling effect.

In the comparative examples of Nos. 9 and 10, the defective waveform rate was 4.5% and 2.2% respectively, and slab cracks having crack incidence of 5.0 mm/m$^2$ and 3.0 mm/m$^2$ respectively occurred. This was because the base dimples were exceedingly deep and therefore cracks, caused by uneven cooling, developed within each dimple.

TABLE 5

| | Base dimple | | Defective | | |
|---|---|---|---|---|---|
| Example No. | Average depth (μm) | Average diameter (mm) | waveform rate (%) | Incidence of crack (mm/m$^2$) | Remarks |
| 1 | 130 | 2.1 | 7.5 | 0.5 | Comparative example |
| 2 | 130 | 2.1 | 4.2 | 0.2 | Comparative example |
| 3 | 130 | 2.1 | 2.9 | 0.0 | Invented example |
| 4 | 130 | 2.1 | 1.1 | 0.0 | Invented example |
| 7 | 100 | 2.0 | 4.5 | 0.3 | Comparative example |
| 8 | 100 | 2.0 | 0.9 | 0.0 | Invented example |
| 5 | 30 | 1.5 | 4.2 | 17.0 | Comparative example |
| 6 | 30 | 1.5 | 1.1 | 15.0 | Comparative example |
| 9 | 250 | 3.0 | 4.5 | 5.0 | Comparative example |
| 10 | 250 | 3.0 | 2.2 | 3.0 | Comparative example |

4) A fourth embodiment of the present invention, which includes various sub-embodiments, will be described.

Aforementioned cooling drum for thin slab continuous casting according to the present invention (hereinafter referred to as a "cooling drum according to the present invention") is based on the fundamental technical thought that dimples 40 to 200 μm in average depth and 0.5 to 3 mm in diameter of circle equivalent are formed adjacent to each other at the rims of the dimples on the plated peripheral surface of the drum and a film containing a substance more excellent than Ni in the wettability with scum is formed on said peripheral surface.

This means to provide the peripheral surface of the cooling drum with the function capable of suppressing as much as possible the formation of heat resisting gas gaps between said peripheral surface and molten steel by forming a film, containing a substance more excellent than Ni in wettability with scum, on the plated peripheral surface of the drum according to above-mentioned knowledge.

When a solidification shell is formed on the peripheral surface of a cooling drum, if gas gaps are not present, solidification unevenness sufficient to induce "pickling-unevenness accompanying crack" is not generated between the solidification shell of the portion of molten steel free of scum and the solidification shell of the portion of the molten steel into which scum flows and adheres, even though the forming of the solidification shell is delayed at the latter portion.

Usually, in order to make a cooling rate slower and the service life of a cooling drum longer (to suppress the occurrence of surface crevices due to thermal stress), applied to the surface of a cooling drum for thin slab continuous casting is a plated layer of Ni which has lower thermal conductivity than Cu and is hard and excellent in resistance to thermal stress, and it is preferable that said plated layer contains any one or more of the elements more prone to oxidize than Ni, for example, W, Co, Fe or Cr.

In a cooling drum according to the present invention, a film containing a substance more excellent than Ni in wettability with scum is further formed on the surface of the drum to improve the wettability with scum, while maintaining the slow cooling effect and the service life prolonging effect at the drum surface.

Since scum is a coagulation of oxides of the elements composing molten steel, oxides of the elements composing molten steel to be continuously cast are preferred as a substance more excellent than Ni in the wettability with scum.

A film containing a substance more excellent than Ni in wettability with scum may be either a film of oxides of the elements composing molten steel coated on the plated peripheral surface of the cooling drum by means of spraying, roll coating or the like, or a film formed by the deposition of oxides generated by the oxidization of the composition elements of molten steel on the plated peripheral surface of the cooling drum during operation.

Further, above-mentioned substance more excellent than Ni in the wettability with scum may be the oxides of the elements composing the plated layer on the peripheral surface of the cooling drum. This is because the oxides generated by the oxidation of the plated layer on the peripheral surface of the cooling drum by the heat of molten steel are more excellent than said plated layer in the wettability with scum.

Therefore, it is not necessary to form a film of the oxides of the elements composing the plated layer on the peripheral surface of the cooling drum intentionally, and the oxides of the plated layer formed on the peripheral surface of the cooling drum by the heat of molten steel during operation may be left as they are and utilized.

In a cooling drum according to the present invention, dimples 40 to 200 μm in average depth and 0.5 to 3 mm in diameter of circle equivalent are formed adjacent to each other at the rims of the dimples.

The average depth of dimples is limited to 40 to 200 μm. If the average depth is less than 40 μm, a macroscopic stress/strain relaxation effect can not be obtained, and therefore the lower limit is set at 40 μm. On the other hand, if the average depth exceeds 200 μm, the penetration of molten steel to the bottom of the dimples becomes insufficient and the unevenness of the dimples increases and, therefore, the upper limit is set at 200 μm.

The size of the dimples is limited to 0.5 to 3 mm in diameter of circle equivalent. If the diameter is less than 0.5 mm, the penetration of molten steel to the bottom of the dimples becomes insufficient and the unevenness of the dimples increases, and therefore the lower limit is set at 0.5 mm. On the other hand, if the diameter of circle equivalent exceeds 3 mm, the accumulation of stress and strain within each dimple increases and the dimples become more susceptible to cracks, and therefore the upper limit is set at 3 mm. In a cooling drum according to the present invention, the dimples of above-mentioned shape are formed so as to adjoin each other at the rims of the dimples.

Each of the dimples thus formed can disperse the stress and strain exerted on a solidified shell, and it becomes possible to reduce the macroscopic stress and strain exerted on a solidified shell.

A formed pattern of above-mentioned dimples is shown in FIG. 6.

In a cooling drum according to the present invention, it is preferable to form fine humps 1 to 50 μm in height and 5 to 200 μm in diameter of circle equivalent on the surfaces of the dimples of aforementioned dimension. These fine humps can promote the solidification of molten steel contacting with the surfaces of the dimples.

Further, the shapes of the "fine humps" are shown in FIG. 7.

If the height of the fine humps is less than 1 μm, the humps are unable to contact with molten steel sufficiently, solidification nuclei are not generated and the solidification of molten steel cannot be promoted and, therefore, the lower limit is set at 1 μm. On the other hand, if the height exceeds 50 μm, the solidification of molten steel at the bottom of the humps is delayed and the unevenness of solidified shell is developed within a dimple and, therefore, the upper limit is set at 50 μm.

Further, if the diameter of circle equivalent is less than 5 μm, cooling at the humps becomes insufficient and solidification nuclei are not generated, and therefore the lower limit is set at 5 μm. On the other hand, if the diameter of circle equivalent exceeds 200 μm, the portions of molten steel insufficiently contacting with the humps appear and the generation of solidification nuclei becomes uneven, and therefore the upper limit is set at 200 μm.

Further, the above-mentioned fine humps are coated with a film containing a substance more excellent than Ni in wettability with scum.

Further, in a cooling drum according to the present invention, above-mentioned fine humps coated with a film containing a substance more excellent than Ni in wettability with scum may be fine humps on which oxides generated by the oxidization of the elements composing molten steel are deposited. The deposition of the oxides generated by the oxidization of the elements composing molten steel on above-mentioned fine humps enhances the wettability of the fine humps with scum, promotes the generation of greater amount of starting points of solidification nuclei at the contact portions of molten steel with said fine humps, and expedites the solidification of molten steel.

In a cooling drum according to the present invention, it is preferable that fine humps 1 to 50 μm in height and 30 to 200 μm in diameter of circle equivalent, coated with a film containing a substance more excellent than Ni in wettability with scum, are formed adjacent to each other on the rims of the dimples of aforementioned shape.

Although the rims of the as-formed dimples have sharp shapes, it is possible to furnish said rims with "roundness" by forming a number of above-mentioned fine humps in such a manner that they exist adjacent to each other. By this "roundness," the generation of solidification nuclei is delayed in the molten steel contacting with the rims of the dimples, and the progress of solidification becomes slow. Further, the rims of the dimples with above-mentioned roundness serve to promote the penetration of molten steel into the concavities of the dimples. As a result, molten steel can reach and contact with the bottom of the dimples more easily under a static pressure of the molten steel and the screw-down force of the cooling drum.

If the height of the fine humps is less than 1 μm, the effect of delaying the generation of solidification nuclei at the rims of the dimples is not obtained, and therefore the lower limit is set at 1 μm. On the other hand, if the height exceeds 50 μm, the penetration of molten steel to the bottom of the dimples becomes insufficient and, therefore, the upper limit is set at 50 μm.

Further, if the diameter of circle equivalent is less than 30 μm, the effect of delaying the generation of solidification nuclei at the rims of the dimples is not obtained, and therefore the lower limit is set at 30 μm. On the other hand, if the diameter of circle equivalent exceeds 200 μm, the stress/strain relaxation effect of the dimples themselves is not obtained and, therefore, the upper limit is set at 200 μm.

Further, it is preferable to form, instead of the fine humps, "fine holes" 5 μm or more in depth and 5 to 200 μm in diameter of circle equivalent on the rims of the as-formed dimples having sharp shapes. By the formation of the "fine holes," the sharp shapes of the rims of the dimples are eliminated, and at the same time, slow cooling portions (air gaps) are formed, and therefore, the rims of the dimples with the "fine holes" serve to delay the generation of the solidification nuclei in the molten steel contacting with said rims, and to delay the progress of solidification. Further, the rims of the dimples with the "fine holes" serve to promote the penetration of molten steel into the concavities of the dimples. As a result, molten steel can reach and contact the bottom of the dimples more easily under a static pressure of the molten steel and the screw-down force of the cooling drum.

The shapes of the "fine holes" are shown in FIG. 8.

If the depth of the fine holes is less than 5 μm, the formation of air gaps is insufficient at the portions of the fine holes and the effect of delaying the generation of solidification nuclei is not obtained and, therefore, the lower limit is set at 5 μm.

Further, if the diameter of circle equivalent is less than 5 μm, solidification nuclei are generated in the vicinities of the rims except the fine hole portions, and the effect of promoting the penetration of molten steel to the bottom of the dimples is not obtained and, therefore, the lower limit is set at 5 μm. On the other hand, if the diameter of circle equivalent exceeds 200 μm, the apparent height of the rims of the dimples becomes lower and the stress/strain relaxation effect is not obtained and, therefore, the upper limit is set at 200 μm.

In a cooling drum according to the present invention, it is possible to form the peripheral surface configuration as appropriate according to steel grade, prescribed thickness and quality by combining aforementioned fine humps and fine holes properly. What characterizes it most is forming a film containing a substance more excellent than Ni in wettability with scum on said peripheral surface.

Namely, a cooling drum according to the present invention is a cooling drum which has been improved, from the viewpoints of the peripheral surface configuration and the peripheral surface material, in order to suppress both of the occurrence of "dimple cracks" and the occurrence of "pickling unevenness" and "pickling-unevenness accompanying cracks," and to produce high quality thin slabs and final sheet products with higher yields.

Further, a cooling drum according to the present invention is applicable to either a single drum type continuous caster or a twin drum type continuous caster.

Examples of the present invention will be explained hereunder. However, the present invention is limited in no way by the peripheral surface configurations, the peripheral surface materials and the continuous casting conditions employed in the examples.

EXAMPLE 4

SUS304 stainless steels were cast into strip-shaped thin slabs of 3 mm in thickness by a twin drum type continuous caster, and the slabs were cold-rolled to produce sheet products of 0.5 mm in thickness. When casting above-mentioned slabs, the outer cylinder 1,330 mm in width and 1,200 mm in diameter of a cooling drum was copper-made, a Ni plated layer of 1 mm in thickness was coated on the peripheral surface of the outer cylinder, and then a coating layer shown in Table 6 was formed thereon.

Here, the dimples listed in Table 6 were formed by shot blasting.

Cracks and uneven luster were visually judged after cold-rolling, pickling and annealing the thin slabs.

TABLE 6

| | Dimple | | Shape of dimple rim | | | Shape of dimple surface | | | Drum surface coating | |
|---|---|---|---|---|---|---|---|---|---|---|
| | | | | Height, | | | Height, | | Coating material on Ni | |
| No. | Depth (μm) | Diameter (mm) | Shape | Depth (μm) | Diameter (μm) | Shape | Depth (μm) | Diameter (μm) | plated layer | Composition of film |
| 1 | 40 | 1 | — | | | — | | | — | MnO |
| 2 | 100 | 2 | — | | | — | | | — | MnO—FeO—$SiO_2$ |
| 3 | 150 | 0.8 | — | | | — | | | — | MnO—FeO—$SiO_2$—$Cr_2O_3$ |
| 4 | 200 | 2 | — | | | — | | | — | MnO—FeO—$SiO_2$—$Cr_2O_3$ |

TABLE 6-continued

| | | | | | | | | | | |
|---|---|---|---|---|---|---|---|---|---|---|
| 5 | 100 | 2 | — | | | — | | | Ni—W | $WO_2$ |
| 6 | 40 | 3 | — | | | — | | | Cr | $Cr_2O_3$ |
| 7 | 200 | 0.5 | — | | | — | | | Ni—W | $WO_2$ |
| 8 | 150 | 2 | — | | | — | | | Cr | $Cr_2O_3$ |
| 9 | 50 | 1 | — | | | — | | | Ni—Co | CoO |
| 10 | 200 | 1.5 | — | | | — | | | Ni—Fe | FeO |
| 11 | 80 | 2 | — | | | — | | | Mn | MnO |
| 12 | 150 | 2 | — | | | — | | | Ni—W | MnO—FeO—$SiO_2$—$WO_2$ |
| 13 | 50 | 1 | — | | | Hump | 1 | 150 | — | MnO—FeO—$SiO_2$—$Cr_2O_3$ |
| 14 | 140 | 2 | — | | | Hump | 50 | 100 | — | MnO |
| 15 | 100 | 0.5 | — | | | Hump | 20 | 5 | Ni—W | $WO_2$ |
| 16 | 80 | 1.5 | — | | | Hump | 30 | 200 | Ni—W | $WO_2$ |
| 17 | 120 | 1 | — | | | Hump | 50 | 100 | Cr | $Cr_2O_3$ |
| 18 | 150 | 2 | — | | | Hump | 10 | 50 | Ni—W | MnO—FeO—$SiO_2$—$WO_2$ |
| 19 | 100 | 1.8 | Hump | 20 | 100 | — | | | — | MnO—FeO—$SiO_2$—$Cr_2O_3$ |
| 20 | 140 | 3 | Hump | 5 | 50 | — | | | Ni—W | $WO_2$ |
| 21 | 60 | 2.5 | Hump | 50 | 30 | — | | | — | MnO—FeO—$SiO_2$ |
| 22 | 150 | 2.8 | Hump | 1 | 200 | — | | | Ni—Co | CoO |
| 23 | 100 | 2.2 | Hump | 30 | 150 | — | | | Mn | MnO |
| 24 | 80 | 2.5 | Hump | 1 | 150 | Hump | 10 | 5 | Cr | $Cr_2O_3$ |
| 25 | 110 | 3 | Hump | 50 | 30 | Hump | 1 | 100 | Ni—Fe | FeO |
| 26 | 100 | 1.2 | Hump | 30 | 100 | Hump | 5 | 200 | — | MnO—FeO—$SiO_2$ |
| 27 | 80 | 2.8 | Hump | 20 | 200 | Hump | 50 | 50 | — | MnO—FeO—$SiO_2$—$Cr_2O_3$ |
| 28 | 100 | 1.6 | Hump | 50 | 200 | Hump | 20 | 150 | Ni—W | MnO—FeO—$SiO_2$—$WO_2$ |
| 29 | 60 | 2 | Fine hole | 50 | 5 | Hump | 1 | 10 | — | MnO—FeO—$SiO_2$—$Cr_2O_3$ |
| 30 | 80 | 1 | Fine hole | 100 | 10 | Hump | 20 | 100 | Ni—Co | MnO—FeO—$SiO_2$—CoO |
| 31 | 200 | 2.5 | Fine hole | 10 | 50 | Hump | 10 | 5 | Cr | $Cr_2O_3$ |
| 32 | 150 | 2 | Fine hole | 5 | 200 | Hump | 30 | 200 | Ni—W | $WO_2$ |
| 33 | 160 | 1 | Fine hole | 80 | 100 | Hump | 50 | 50 | — | MnO |
| Comparative example | 50 | 1.2 | — | | | — | | | — | — |

| | Drum surface coating | | Quality | | |
|---|---|---|---|---|---|
| | | | | Pickling- | |
| No. | Method of forming film | Wettability with scum | Dimple crack | unevenness accompanying crack | Pickling unevenness |
| 1 | Spraying | ○ | ◎ | ○ | ○ |
| 2 | Roll coating | ○ | ◎ | ○ | ○ |
| 3 | Deposition | ○ | ○ | ○ | ○ |
| 4 | Evaporation of molten steel component | ○ | ○ | ○ | ○ |
| 5 | Spraying | ○ | ◎ | ○ | ○ |
| 6 | Roll coating | ○ | ◎ | ○ | ○ |
| 7 | Oxidization of plated layer | ○ | ○ | ○ | ○ |
| 8 | Oxidization of plated layer | ○ | ◎ | ○ | ○ |
| 9 | Oxidization of plated layer | ○ | ◎ | ○ | ○ |
| 10 | Oxidization of plated layer | ○ | ○ | ○ | ○ |
| 11 | Oxidization of plated layer | ○ | ◎ | ○ | ○ |
| 12 | Evaporation of molten steel component and oxidization of plated layer | ○ | ○ | ◎ | ○ |
| 13 | Deposition | ○ | ○ | ◎ | ◎ |
| 14 | Spraying | ○ | ○ | ◎ | ◎ |
| 15 | Spraying | ○ | ○ | ◎ | ◎ |
| 16 | Oxidization of plated layer | ○ | ○ | ◎ | ◎ |
| 17 | Roll coating | ○ | ◎ | ○ | ○ |
| 18 | Evaporation of molten steel component and oxidization of plated layer | ○ | ◎ | ◎ | ◎ |
| 19 | Evaporation of molten steel component | ○ | ◎ | ◎ | ◎ |
| 20 | Spraying | ○ | ◎ | ◎ | ◎ |
| 21 | Roll coating | ○ | ◎ | ◎ | ○ |
| 22 | Oxidization of plated layer | ○ | ◎ | ○ | ◎ |
| 23 | Oxidization of plated layer | ○ | ◎ | ◎ | ◎ |
| 24 | Roll coating | ○ | ◎ | ◎ | ◎ |
| 25 | Oxidization of plated layer | ○ | ◎ | ◎ | ◎ |
| 26 | Roll coating | ○ | ◎ | ◎ | ◎ |
| 27 | Deposition | ○ | ◎ | ◎ | ◎ |
| 28 | Evaporation of molten steel component and oxidization of plated layer | ○ | ◎ | ◎ | ◎ |
| 29 | Evaporation of molten steel component | ○ | ○ | ○ | ◎ |
| 30 | Evaporation of molten steel | ○ | ○ | ◎ | ◎ |

TABLE 6-continued

| | | | | | |
|---|---|---|---|---|---|
| | component and oxidization of plated layer | | | | |
| 31 | Oxidization of plated layer | ○ | ○ | ◎ | ◎ |
| 32 | Spraying | ○ | ○ | ◎ | ◎ |
| 33 | Spraying | ○ | ◎ | ◎ | ◎ |
| Comparative example | — | x | x | x | x |

5) A fifth embodiment of the present invention, which includes various sub-embodiments, will be described.

Figure 21:
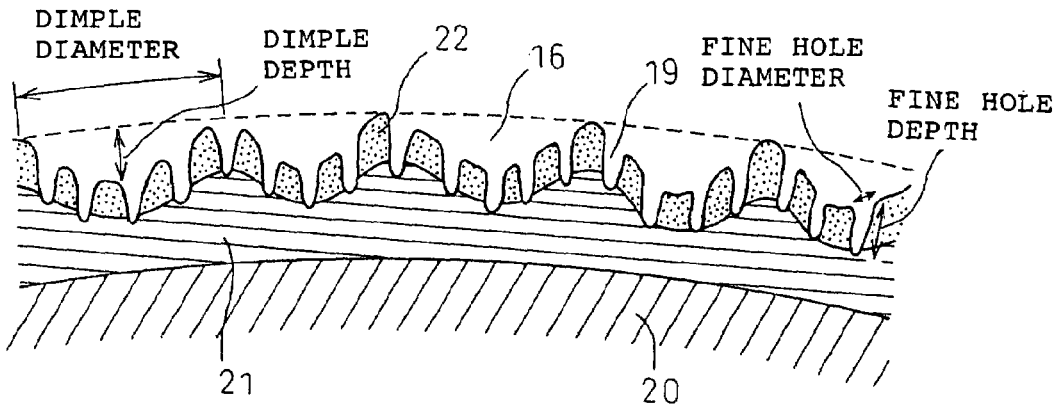
FIG. 21 is an illustration showing the appearance of the surface of a cooling drum for continuous casting according to the present invention. (a) is a sectional view showing the vicinity of the surface in an enlarged state, and (b) is a plan view showing the ruggedness of the surface with the depth of the color.
Figure 21:
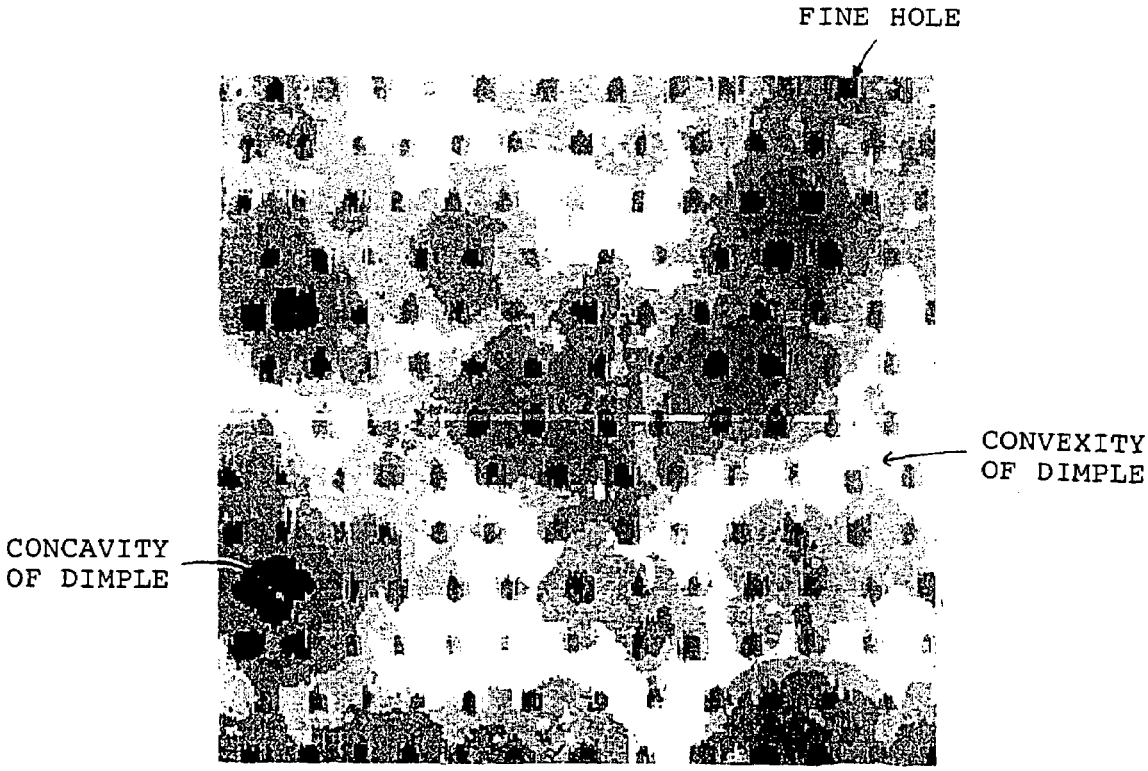

FIG. 21 includes: (a) a sectional view showing the peripheral surface layer of a cooling drum according to the present invention in an enlarged state; and (b) a plan view showing the ruggedness of the surface with the depth of the color. The constituent requirements of a cooling drum according to the present invention and the reasons specifying them will be explained hereunder in detail based on FIG. 21.

The base material 20 of a drum is required to have a thermal conductivity of 100 W/m·K or more for maintaining the temperature of the drum low, suppressing the generation of thermal stress, and prolonging the service life. Since the thermal conductivity of copper or copper alloy is 320 to 400 W/m·K, the copper or copper alloy is most suited to a drum base material.

It is possible to reduce the shearing stress attributed to the thermal stress caused by the difference in the coefficient of thermal expansion between the intermediate layer 21 and the drum base material 20, and to prevent the peeling off of the intermediate layer 21 by limiting the coefficient of thermal expansion of the intermediate layer 21 of the drum surface to less than 1.2 times that of the drum base material 20. If above-mentioned difference in the coefficients of thermal expansion is 1.2 times or more, the intermediate layer 21 peels off within a short period of time due to the thermal stress, and the cooling drum becomes unserviceable. From this aspect, it is desirable that the coefficient of thermal expansion of the intermediate layer 21 and that of the drum base material 20 are identical. However, most of the materials satisfying hardness required of the intermediate layer 21 show the difference of 0.5 times or more in the coefficient of thermal expansion, and therefore the lower limit is substantially about 0.5 times.

If the Vickers hardness Hv of an intermediate layer 21 is less than 150, deformation resistance required of the intermediate layer 21 is not as good and the service life becomes short. On the other hand, if the Hv exceeds 1,000, toughness becomes low and cracks tend to occur, and therefore it is desired that the Hv of the intermediate layer 21 is less than 1,000.

The thickness of an intermediate layer 21 is required to be 100 μm or more to protect the drum base material 20 thermally, but the maximum thickness thereof is required to be 2,000 μm as a condition to avoid the excessive rise of the surface temperature of the intermediate layer 21. As a material constituting an intermediate layer 21, Ni, Ni—Co, Ni—Co—W, Ni—Fe and the like, which have a thermal conductivity of about 80 W/m·K and a capability of keeping the temperature of the drum base material 20 low, are appropriate, and the coating by the plating can stabilize the bonding strength, improve the strength and prolong the service life. Further, the plating is also desirable from the viewpoint of forming a uniform coating.

The most important material property that is required of the outermost surface 22 of the drum is abrasion resistance. The practically required minimum Vickers hardness Hv is 200. Sufficient abrasion resistance is secured if the thickness is 1 μm or more. Since a hard plated layer material has a low thermal conductivity in general, the thickness must be 500 μm or less to control the surface temperature so as not to rise exceedingly.

As a material constituting a hard plated layer, any one of Ni—Co—W, Ni—W, Ni—Co, Co, Ni—Fe, Ni—Al and Cr, where Hv of 200 or more can be obtained, is appropriate, and the coating of the intermediate layer 21 with the plated layer can stabilize the bonding strength, improve the strength and prolong the service life of the cooling drum.

The requisites for forming the dimples 16 and the fine holes (fine holes) 19 on the surface layer of the peripheral surface of a cooling drum will be explained hereunder.

Ruggedness of a long cycle in the order of 1 mm (dimples 16) is formed on the entire peripheral surface layer of a cooling drum by shot blasting method or the like. When molten steel is cast by using the cooling drum having dimples 16 of this kind, the molten steel comes in contact with the convexities of the dimples at first, and then the generation of solidification nuclei takes place, while in the mean time, in the concavities of the dimples, gas gaps are formed between the surface of the cast slab and the surface of the dimples, and the generation of solidification nuclei is delayed. The solidification-contraction stress is dispersed and relaxed by the generation of solidification nuclei at the convexities of the dimples and, therefore, the occurrence of cracks, is suppressed.

In order to achieve aforementioned object, it is necessary to clearly specify the convexities of the dimples, and for this purpose, it is necessary to form the dimples 16 so as to contact with each other or adjacent to each other (refer to FIG. 6). This is because, if the dimples 16 are formed in a condition wherein dimples do not contact with each other, the flat portions of the original surface function in the same manner as above-mentioned convexities of the dimples do, and therefore it becomes impossible to clearly specify the generation of solidification nuclei.

The diameter of the dimples is specified in relation to the occurrence of cracks attributed to the solidification-contraction stress brought forth by the delayed solidification in the concavities of the dimples, and is required to be 2,000 μm or less. Further, the lower limit of the diameter is specified in relation to the diameter of the fine holes (fine holes) 19 hereinafter referred to, and as a diameter larger than that of the fine holes (fine holes) is required, the lower limit is set at 200 μm.

The depth of the dimples is required to be 80 μm or more for forming aforementioned gas gaps. On the other hand, if the depth of the dimples is exceedingly large, the thickness of the gas gap in the concavities of the dimples increases, the formation of the solidification shell in the concavities of the dimples is delayed greatly, and the unevenness of thickness between the solidification shell at the convexity and the one in the concavity is enlarged and, then, cracks occur. Therefore, the depth of the dimples is required to be 200 μm or less. Cracks and uneven luster on a thin slab C can be effectively suppressed under a steady casting condition by forming the dimples as explained above.

However, in the casting using a cooling drum having only these dimples formed, as stated in the paragraph of "Background Art," when the casting is carried out in such a manner that oxides (scum) are carried in accompanied by the molten steel flowing in with the rotation of a cooling drum and the oxides adhere to the surface of a solidified shell of the cast slab, the unevenness of solidification may take place between the portions where scum flows in and the sound portions of the thin slab, and cracks and unevenness may occur.

To cope with the problem, the present inventors carried out experimental research in detail, and, as a result, made clear that the unevenness of the solidification was not generated even at the portions where scum was carried in by further forming fine holes (fine holes) on the dimples under a specific condition.

The present inventors discovered that the unevenness of solidification that occurred when scum flowed in between molten steel and a cooling drum was not caused by the difference between the thermal conductivity of scum and that of molten steel, but was caused by the presence of air layers formed with the entanglement of air when the scum flowed in. In this case, if fine holes (fine holes) which are fine enough to the extent where the inflow of molten steel and scum is hindered by their surface tensions exist on the surface, the above-mentioned air is aggregated at the portions of the fine holes (fine holes), and air layers are not formed.

Accordingly, even if scum flows in, the occurrence of the unevenness of solidification is suppressed. Further, thanks to the presence of fine holes, it becomes possible to specify the generation of solidification nuclei at finer intervals as explained in the aforementioned requisite for dimples, and therefore it is further possible to suppress more securely the occurrence of cracks caused by the delayed solidification at the gas gap portions. As a requisite for fine holes (fine holes) to achieve the function of this kind, the upper limit of the diameter of the hole is required to be 200 μm so as not to allow the inflow of molten steel and scum. Further, as a requisite to effectively aggregate air in the fine holes when the air is entangled, the minimum diameter of the holes is specified to be 50 μm.

Further, as for the intervals of fine holes, the holes are required not to contact with each other for aggregating air effectively and, in order to secure the generation of solidification nuclei, the center to center pitch of the holes is required to be 100 to 500 μm. Further, in order to exhibit the air aggregating function effectively and to specify the generation of solidification nuclei clearly, the depth of fine holes is required to be 30 μm or more or, more preferably, 50 μm or more.

The dimples and fine holes as mentioned above are formed by forming an intermediate layer 21 and an outermost surface 22 on a cooling drum, applying plating treatment on the outermost surface 22, and then applying, for instance, shot blasting followed by laser material processing. When the hardness of the plated layer of the outermost surface is very high and there is a possibility of the generation of cracks in the plated layer during the dimple forming, it is possible as well to form dimples, for instance, by shot blasting after forming the intermediate layer 21 by plating, and then to form the outermost surface 22 thereon, and finally to form the fine holes 19.

Figure 22:
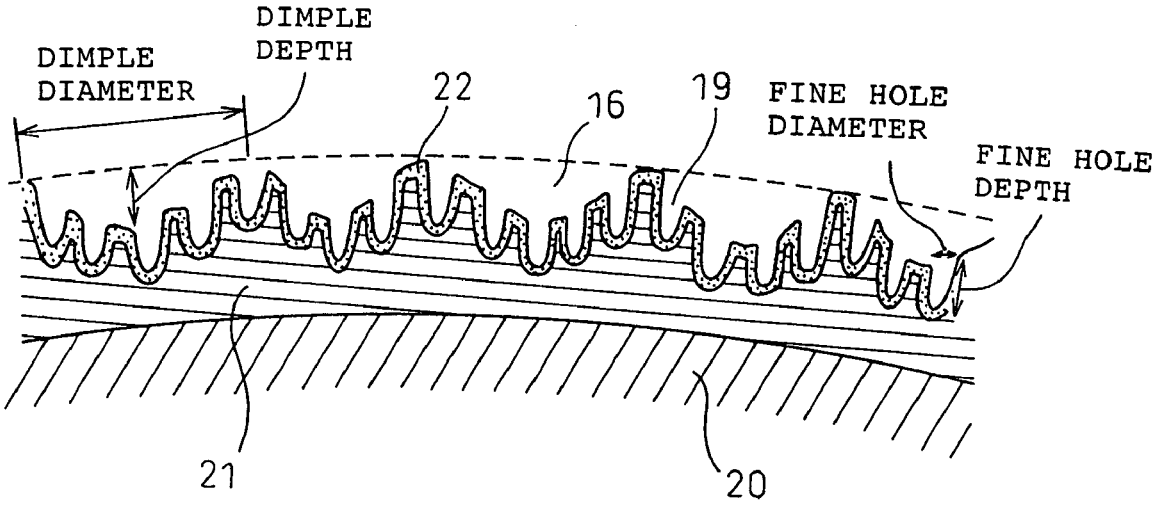
FIG. 22 is an illustration showing another appearance of the surface of a cooling drum for continuous casting according to the present invention.

Further, as shown in FIG. 22, it is also possible to form dimples 16, for instance, by shot blasting after forming an intermediate layer 21 by plating on a drum base material, then to form fine holes 19 by laser material processing, and then to form an outermost surface 22 by applying hard plating. The order of forming the outermost surface can be selected as appropriate according to the choice of a plated material.

A means to form these dimples 16 and fine holes 19 will be explained hereunder. With regard to the dimples, a shot blasting method that can three-dimensionally form a random distribution pattern of dimples is effective as a method of forming dimples overlapping each other. However, any other processing means including electric discharge machining and the like may be used as long as the means can perform a processing that satisfies the conditions specified by the present invention. With regard to a means of forming fine holes, a pulsed laser processing method that can easily perform the pattern control three-dimensionally is most appropriate. However, it is also possible to form the fine holes by other means such as photoetching method and the like.

Figure 23:
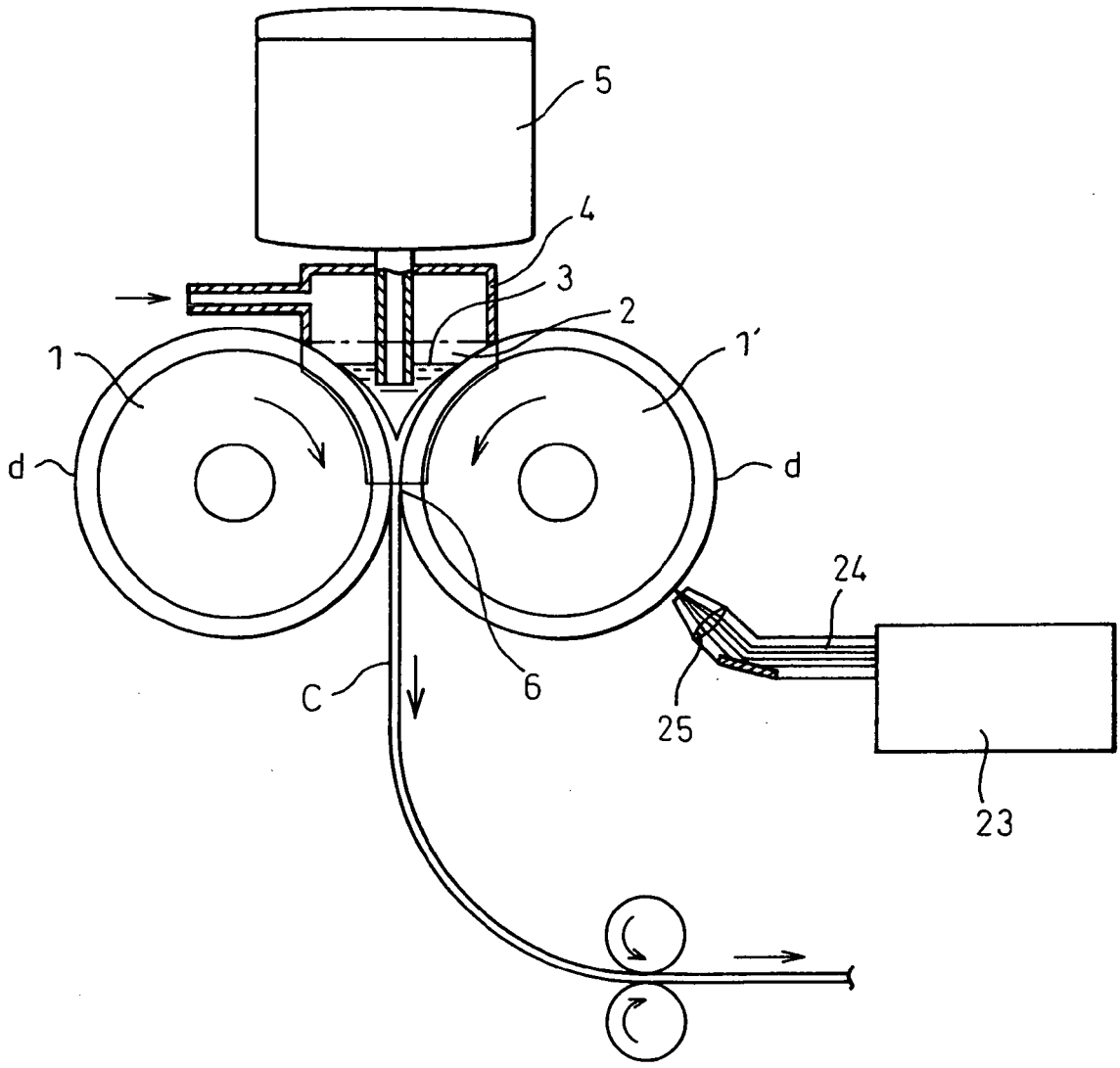
FIG. 23 is a side view of an apparatus whereby the continuous casting method according to the present invention is carried out.

In the above explanation, the explanation on a cooling drum is made assuming that the cooling drum is manufactured and used according to the conditions specified by the present invention before being used for thin slab casting. However, when a plated layer material of the outermost surface which has a possibility of the fine holes being abraded along with the progress of casting is selected, it is also possible, as shown in FIG. 23, to employ a means of continuously forming fine holes on a cooling drum, during casting, by pulsed laser processing at a certain position after the drum surface leaves the molten steel. In the configuration shown in FIG. 23, it is possible to form fine holes in the peripheral direction by condensing the pulsed laser beam 24 emitted from the laser oscillator 23 with a condenser 25 and irradiating the pulsed laser beam.

Further, it is also possible as well to form fine holes on the entire surface of the cooling drums 1 and 1', by additionally scanning the laser beams in the direction perpendicular to the drawing by laser beam scanning apparatuses not shown in the drawing.

EXAMPLE 5

Figure 1:
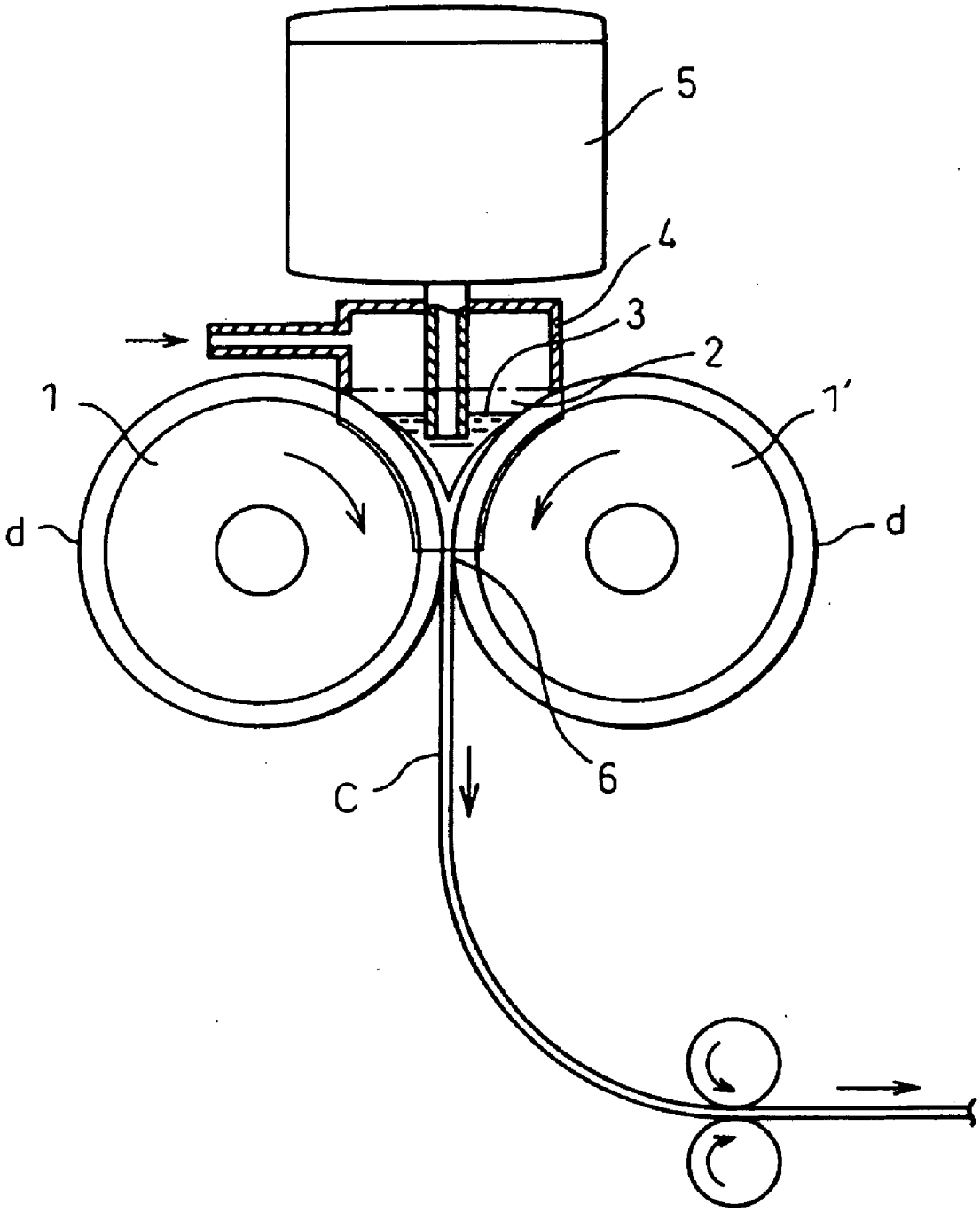
Fig.1 PRIOR ART
FIG. 1 is a side view showing a twin drum type continuous caster.
Figure 2:
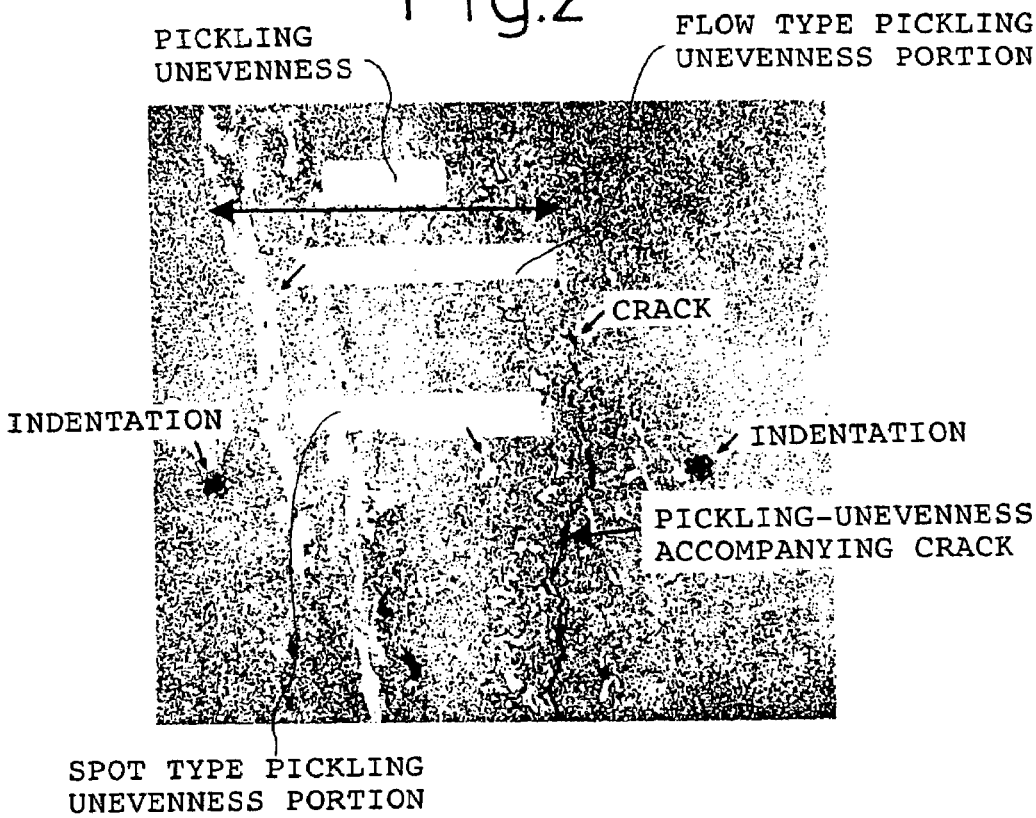
FIG. 2 is a view showing appearances of "pickling unevenness" and "pickling-unevenness accompanying crack" appeared on the surface of a continuously cast thin slab.
Figure 3:
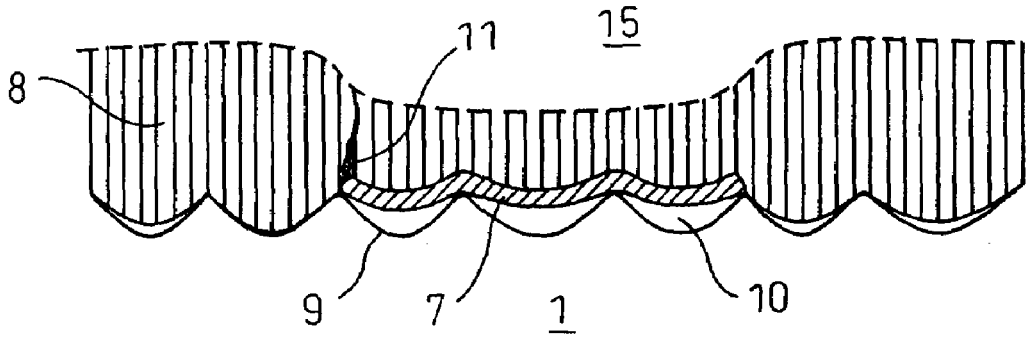
FIG. 3 is an illustration schematically showing the generation mechanism of the "pickling-unevenness accompanying crack" shown in FIG. 2.

Austenitic stainless steels (SUS304) were cast into strip-shaped thin slabs of 3 mm in thickness by a twin drum type continuous caster shown in FIG. 1 and then the slabs were hot-rolled and cold-rolled to produce sheet products of 0.5 mm in thickness. When casting the above-mentioned thin slabs, used were the cooling drums 800 mm in width and 1,200 mm in diameter on the peripheral surfaces of which intermediate layers and outermost surface layers were plated and dimples and fine holes were formed on the conditions shown in Table 7.

As a means for processing the peripheral surface layer d of a cooling drum, a shot blasting method was used to form the dimples, and a laser material processing method was used to form the fine holes. The durability of a cooling drum was evaluated by visually observing the state of abrasion of the peripheral surface layered after 20 castings had been carried out. Further, the quality of a cast slab was evaluated by visually inspecting the sheet products after cold-rolling. Nos. 1 to 8 are the examples according to the present invention. Nos. 9 and 10 are the comparative examples according to a conventional method in the cases with and without fine holes formed on the Ni-plated drum surface. In the examples according to the present invention, it was observed in all cases that the durability of the drum was excellent, the thin slabs were free of surface cracks, and sheet products after rolling were free of surface defects. In the comparative examples, the abrasion of cooling drum surface occurred during the 20 continuous castings and consequently, even under the condition of No. 9 where the cast slab quality was good in early stage, cracks occurred on the surface of the cast slabs finally, and surface defects and uneven luster were observed on the surfaces of sheet products after rolling.

TABLE 7

| | | Cooling drum material | | | | | Cooling drum surface configuration Dimple | |
|---|---|---|---|---|---|---|---|---|
| | | | Intermediate layer | | Outermost surface layer | | | |
| Condition No. | | Base material | Material | Thickness [μm] | Material | Thickness [μm] | Diameter [μm] | Depth [μm] |
| 1 | Invented example | Copper alloy | Ni | 1500 | Co | 100 | 1500 | 100 |
| 2 | | | Ni | 1500 | Ni—Co | 100 | 1500 | 100 |
| 3 | | | Ni | 1500 | Cr | 10 | 1500 | 100 |
| 4 | | | Ni | 1500 | Ni—Co—W | 20 | 1500 | 100 |
| 5 | | | Ni | 1500 | Ni—Fe | 30 | 1500 | 100 |
| 6 | | | Ni | 1500 | Ni—Al | 50 | 1500 | 100 |
| 7 | | | Co | 1500 | Ni—W | 20 | 1500 | 100 |
| 8 | | | Ni—Co | 1500 | Ni—W | 20 | 1500 | 100 |
| 9 | Comparative example | | Ni | 1500 | None | | 1500 | 100 |
| 10 | | | Ni | 1500 | None | | 1500 | 100 |

| | Cooling drum surface configuration Fine hole | | | Evaluation | | |
|---|---|---|---|---|---|---|
| | | | | | Slab quality | |
| Condition No. | Diameter [μm] | Depth [μm] | Pitch [μm] | Drum durability | Sound portion | Scum adhering portion |
| 1 | 150 | 60 | 250 | ◎ | ◎ | ○ |
| 2 | 100 | 90 | 150 | ◎ | ◎ | ○ |
| 3 | 150 | 60 | 350 | ◎ | ◎ | ○ |
| 4 | 180 | 50 | 300 | ◎ | ◎ | ○ |
| 5 | 150 | 70 | 250 | ◎ | ◎ | ○ |
| 6 | 150 | 60 | 300 | ◎ | ◎ | ○ |
| 7 | 100 | 100 | 200 | ◎ | ◎ | ○ |
| 8 | 150 | 70 | 400 | ◎ | ◎ | ○ |
| 9 | 150 | 80 | 250 | X | ◎→X | ○→X |
| 10 | None | | | X | ○→X | X |

6) A sixth embodiment of the present invention, which includes various sub-embodiments, will be described.

(A) Basis of the Surface Configuration and the Material Quality of a Cooling Drum Firstly, the constituent requirements for fine holes (fine holes) and the reasons of specifying them will be explained hereunder in detail. Generally, as stated in the paragraph of "Background Art," when the casting is carried out in such a manner that oxides (scum) are carried in accompanied by the molten steel flowing in with the rotation of a cooling drum and the oxides adhere to the surface of a solidified shell of the cast slab, the unevenness of solidification may take place between the portions where scum flows in and the sound portions of the thin slab, and cracks and unevenness may occur.

To cope with the problem, the present inventors carried out experimental research in detail and, as a result, made clear that the unevenness of the solidification was not generated even at the portions where scum was carried in by forming fine holes (fine holes) on the dimples under a specific condition.

The present inventors discovered that the unevenness of solidification that occurred when scum flowed in between molten steel and a cooling drum was not caused by the difference between the thermal conductivity of scum and that of molten steel, but was caused by the presence of air layers formed with the entanglement of air when the scum flowed in. That is, during casting, if fine holes, which are fine enough to the extent where the inflow of molten steel and scum is hindered by their surface tensions, exist on the surface, above-mentioned air is aggregated at the portions of the holes, and air layers are not formed.

Accordingly, even if scum flows in, the occurrence of the unevenness of solidification is suppressed. Further, thanks to the presence of fine holes, it becomes possible to specify the generation of solidification nuclei at finer intervals, and therefore it is further possible to suppress more securely the occurrence of cracks and unevenness.

As a requisite for fine holes to achieve the function of this kind, the upper limit of the diameter of the hole is required to be 200 μm so as not to allow the inflow of molten steel and scum. Further, as a requisite to effectively aggregate air in the fine holes when the air is entangled, the minimum diameter of the holes is specified to be 50 μm.

Further, as for the intervals of fine holes (fine holes), holes are required not to contact with each other for aggregating air effectively and, in order to securely specify the generation of solidification nuclei, the center to center pitch of the holes is required to be 100 to 500 μm.

Further, in order to exhibit the air aggregating function effectively and to specify the generation of solidification nuclei clearly, the depth of fine holes (fine holes) is required to be 50 μm or more.

If above-mentioned fine holes are formed uniformly on the entire surface of the cooling drum, the occurrence of cracks and unevenness can be effectively suppressed, and therefore the drum surface before forming fine holes or fine holes may be smooth. In the meantime, however, there is a possibility that the uniformity in forming is not secured by any external fluctuation factors (for instance, fluctuation in scanning speed during laser processing and the like). It was found that, in such a case, it was effective to form dimples under a specific condition prior to the forming of above-mentioned fine holes or fine holes.

Requisites for forming the dimples of this kind will be explained in detail hereunder. Roughness (dimples) of a long cycle in the order of 1 mm is formed on the entire peripheral surface layer of a cooling drum by shot blasting method or the like. When molten steel is cast by using the cooling drum having dimples of this kind, the molten steel comes in contact with the convexities of the dimples at first, and then the generation of solidification nuclei takes place while, in the meantime, in the concavities of the dimples, gas gaps are formed between the surface of the cast slab and the surface of the dimples, and the generation of solidification nuclei is delayed. The solidification-contraction stress is dispersed and relaxed by the generation of solidification nuclei at the convexities of the dimples, and therefore the occurrence of cracks is suppressed.

In order to achieve the aforementioned object, it is necessary to clearly specify the convexities of the dimples, and for this purpose, it is necessary to form the dimples so as to contact with each other or adjacent to each other (refer to FIG. 6).

This is because, if the dimples are formed in a condition that dimples do not contact with each other, the flat portions of the original surface function in the same manner as above-mentioned convexities of the dimples do, and therefore it becomes impossible to clearly specify the generation of solidification nuclei. The diameter of the dimples is specified in relation to the occurrence of cracks attributed to the solidification-contraction stress brought forth by the delayed solidification in the concavities of the dimples, and is required to be 3,000 μm or less.

Further, the lower limit of the diameter is specified in relation to the diameter of the fine holes, and since the diameter larger than that of the fine holes is required, the lower limit is set at 200 μm. The depth of the dimples is required to be 80 μm or more for forming aforementioned gas gaps. On the other hand, if the depth of the dimples is exceedingly large, the thickness of the gas gap in the concavities of the dimples increases, the formation of the solidification shell in the concavities of the dimples is delayed greatly, and the unevenness of thickness between the solidification shell at the convexity and the one in the concavity is enlarged, and then cracks occur. Therefore, the depth of the dimples is required to be 250 μm or less.

By forming above-explained dimples overlapping with the fine holes, thanks to the effect of the dimples, the occurrence of cracks and unevenness can be suppressed more securely even at the portions where uneven three-dimensional distribution of the fine holes takes place.

The grounds of the requisites for the material quality of a cooling drum surface will be explained hereunder in detail. In the casting of thin slabs, when a drum rotates, the drum surface is subjected to a certain heat cycle and oxides are formed on the surface because the surface is exposed to a gaseous atmosphere after passing a molten steel pool. As the layer of oxides thus formed hinders the removal of heat during cooling, it must be surely removed under the gaseous atmosphere by a means such as brushing or the like.

For this reason, the material for the surface layer is required to have excellent thermal fatigue resistance and abrasion resistance. Surface hardness can be selected and used as a representative parameter in realizing these characteristics, and in this case, the Vickers hardness is required to be 200 and more. Any one of Ni, Ni—Co, Ni—Co—W, Ni—Fe, Ni—W, Co, Ni—Al and Cr can be selected as a material satisfying the requisites.

Further, since high heat removing capability is required for a cooling drum, copper or copper alloy excellent in thermal conductivity is used as a drum base material. Therefore, the above-mentioned surface layer is coated by plating from the viewpoint of bonding strength with the drum base material and strength.

Further, either single-layered plating or multi-layered plating with a plurality of plating materials is possible. Further, as for the timing of plating, thin film plating can be provided before or after forming fine holes by laser material processing, either of which may be selected as appropriate by comparing the laser material processing capability and the surface abrasion resistance.

(B) The Basis of the Requisites for Pulsed Laser Used for Forming Fine Holes by a Laser Material Processing Method.

The basis of the requisites for pulsed laser for forming fine holes (fine holes) described in detail in aforementioned paragraph (A) by a laser material processing method will be explained in detail hereunder.

Figure 26:
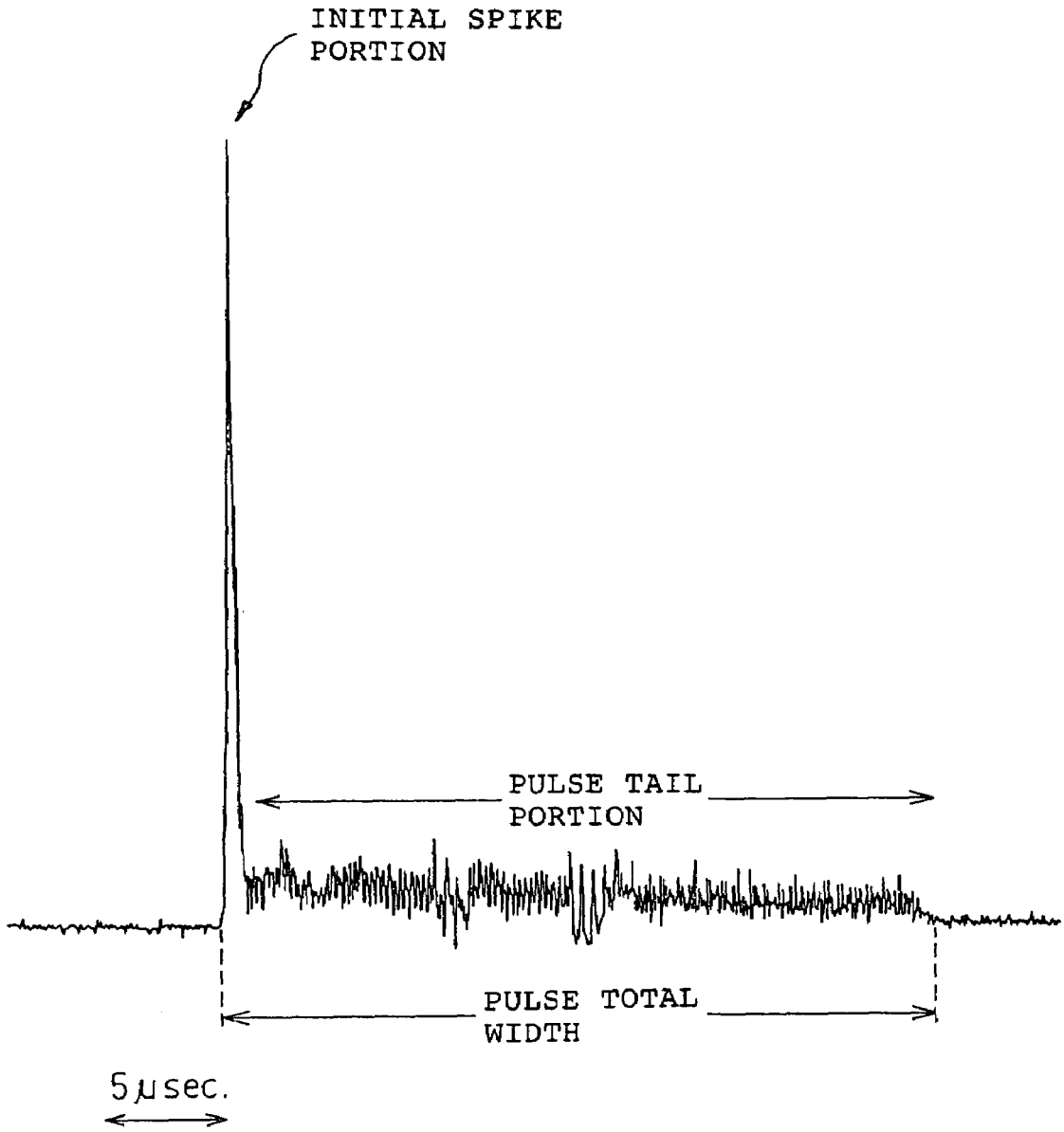
FIG. 26 is a graph showing an example of the oscillation waveform of a Q-switched $CO_2$ laser.

FIG. 26 shows a typical waveform of Q-switched $CO_2$ pulsed laser beam formed by a rotary chopper Q-switching method. In a $CO_2$ laser, $N_2$ having a high energy level relatively close to that of $CO_2$ among molecular oscillation levels is added to the laser medium to improve the oscillation efficiency.

Since $N_2$ thus added acts as an energy accumulating medium at the time of exciting discharge, and when Q-switching motion is activated by a rotary chopper or the like, the Q-switched $CO_2$ pulsed laser beam takes a waveform of an "initial spike portion" corresponding to the giant pulse of a solid laser, followed by a "pulse tail portion" that oscillates like a continuous wave caused by the shift of collision energy from $N_2$ molecules to $CO_2$ molecules.

The present inventors disclosed, for instance, in Japanese Unexamined Patent Publication No. H8-309571 that, when Q-switched $CO_2$ pulsed laser light was applied for forming holes, this pulse tail portion could contribute to forming them effectively. However at that moment, the forming of holes 10 to 50 μm in depth was the primary concern, and it was found that the forming of holes 50 μm or more in depth which was a target of the present invention could not be realized. More concretely, it was found that even if pulse energy was increased to a total time span of 20μ seconds, the increase of hole depth became saturated, and holes 50 μm or more in depth could not be formed.

Figure 27:
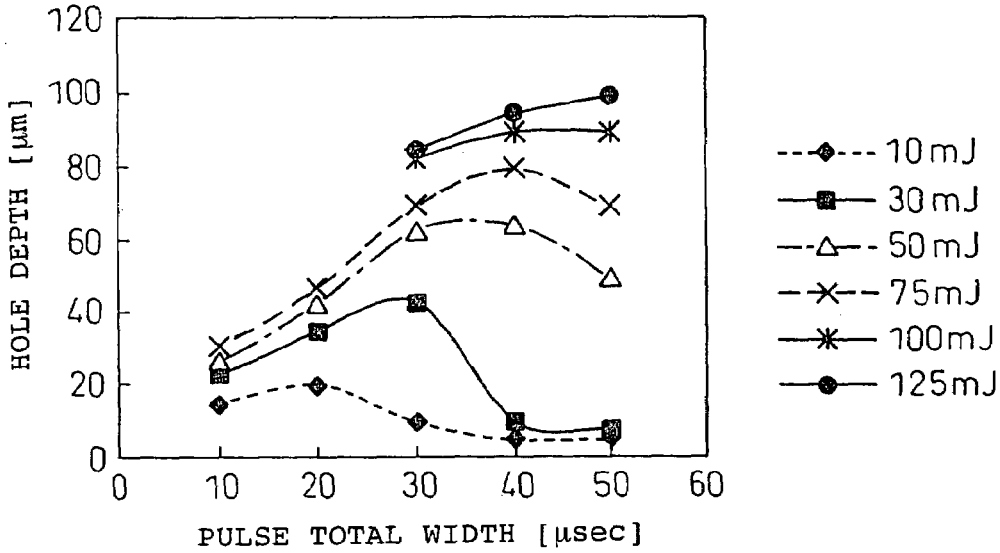
FIG. 27 shows the experimental results of forming holes with a Q-switched $CO_2$ laser on the conditions of the combinations of various kinds of pulse energy and pulse total width. (a) is a graph showing the relation between pulse total width and hole depth, and (b) is a graph showing the relation between pulse total width and hole diameter of the surface.
Figure 27:
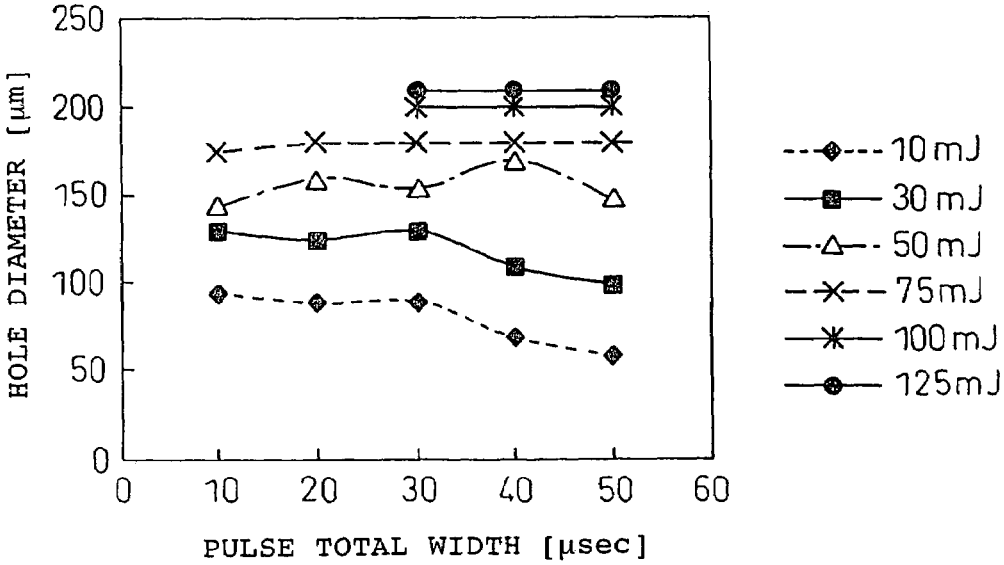

To cope with the problem, the present inventors carried out a detailed experimental research by systematically changing the combination of pulse total width and pulse energy using Ni plated samples, and found that the results shown in FIG. 27 could be obtained.

FIG. 27(*a*) shows the summarized result by taking pulse total time span on X-axis, formed hole depth on Y-axis, and pulse energy as the parameter, and (b) of the same figure shows the result summarized in a similar manner with regard to the diameter of the holes formed on the surface.

From the figure, it can be seen that the dependency of surface hole diameter on pulse total time span is low while the dependency of hole depth has a specific trend. Concretely, under a low pulse energy condition of about 10 to 30 mJ, hole depth increases monotonously with the increase of pulse total width and reaches a rim under the pulse total width of about 20 to 30μ seconds, and then, hole depth begins to decrease (known scope), and therefore, hole depth is restricted to the upper limit of 40 μm or a little more.

However, the present inventors found that, if the pulse total width was changed under the pulse energy condition of 50 mJ or more, the pulse total width that had above-mentioned rim shifted towards the longer pulse total width side.

As a result of carrying out the spectral evaluation of the plasma produced by the laser light to analyze this phenomenon, it was found that, if pulse energy was increased under the condition of short pulse total width of 30μ seconds or less, the electron density of the plasma increased greatly at the timing of initial spike, and as an influence thereof, an inverse damping radiation stage was induced at a timing of the pulse tail portion, and therefore, energy of the pulse tail portion could not be effectively supplied to the work piece to be processed.

In the mean time, if pulse energy is increased under the condition of the longer pulse total width of 30μ seconds or more, pulse energy contained in the pulse tail portion increases proportionally, and as a result, the rate of increase of output at the rim of the initial spike portion is reduced from the level under the above-mentioned condition. As a result, a great increase of free electron density in the plasma produced by the laser is suppressed, and therefore the influence of the inverse damping radiation is reduced and hole depth increases monotonously along with the increase of pulse energy.

Based on the result of the above described experiment and the interpretation of the spectral evaluation, it became clear that a pulse total width of 30μ seconds or more was necessary to achieve the object of the present invention of forming holes 50 μm or more in depth.

The upper limit of pulse total width will be explained hereunder. As indicated by a trial calculation in the paragraph "Background Art," about one hundred millions holes must be formed per cooling drum in order to achieve the object of the present invention. In order to complete the processing within a practically reasonable period, it is necessary to set the pulse oscillation repetition frequency of a Q-switched $CO_2$ laser as high as possible.

As a concrete example, assuming that a cooling drum is to be processed within the upper limit of 4 hours and typical values of the condition for forming the fine holes (fine holes) stated in aforementioned (A) are to be used, a pulse repetition frequency of about 6 kHz or more is required.

On the other hand, once the prescribed pitch of holes and the pulse repetition frequency are determined, the moving speed between holes is determined, and if the pulse total width becomes exceedingly long, the work piece moves within the pulse oscillation time span, and therefore, processing concentrated on a single spot can not be performed. As a result, there arises a problem of the surface hole diameter becoming larger and the depth becoming shallower.

To analyze this phenomenon, a study was carried out to evaluate the dependency of hole forming performance on the moving speed, and as a result, it was found that remarkable deterioration in processing performance would not occur if the amount of movement within a pulse time span was 50% or less of the surface hole diameter under the condition of the moving speed of up to 2 m/second.

Here, as the surface hole diameter is at most 200 μm as explained in the paragraph (A), a value of 50μ seconds=200 (μm)×0.5/2 (m/second) is obtained. Accordingly, this value provides the upper limit of pulse total width.

Figure 25:
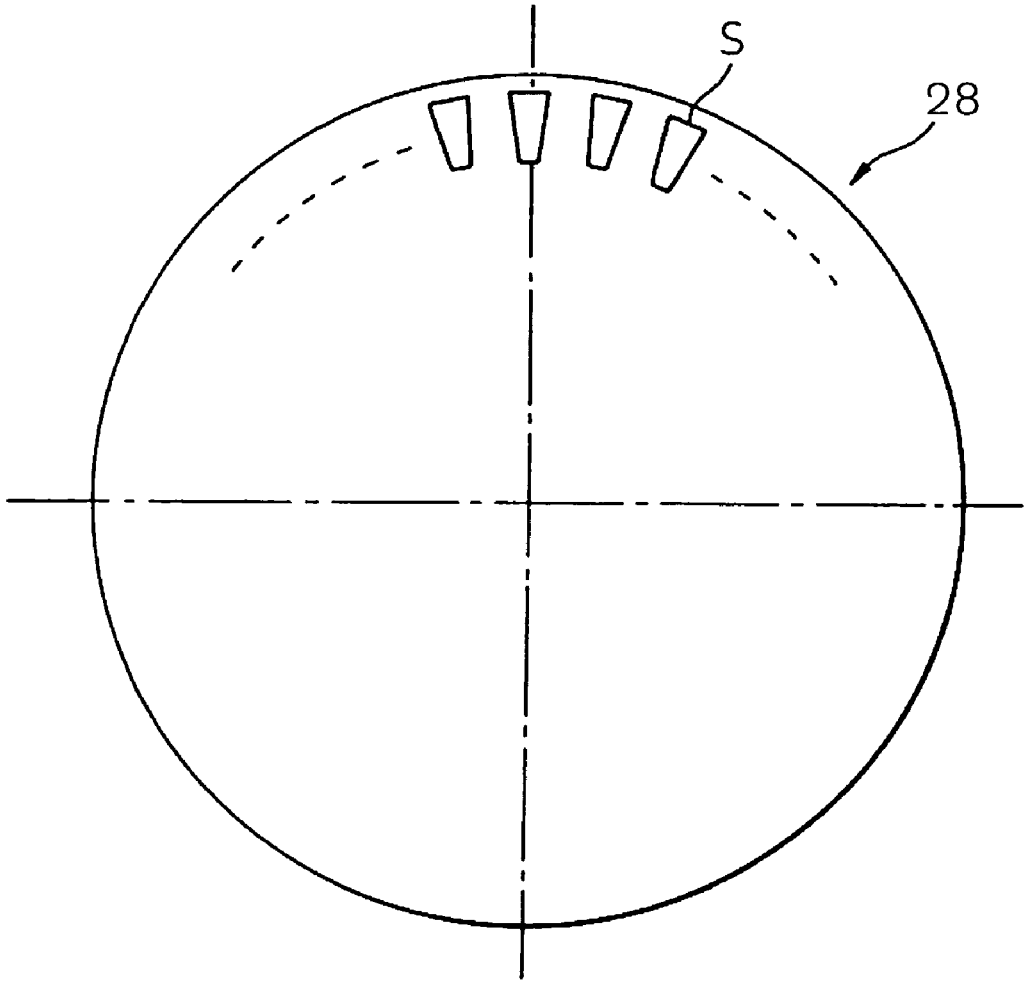
FIG. 25 is an illustration schematically showing a rotary chopper which is one of the components of a Q-switched $CO_2$ laser used for an apparatus for forming dimples of a cooling drum for thin slab continuous casting according to the present invention.

The pulse total width can be changed by changing the slit opening time span in the Q-switching method using a rotary chopper. For changing a pulse width as appropriate when changing the condition for forming fine holes (fine holes), a plurality of rotary chopper blades having different slit widths may be prepared, but it is also possible to realize various pulse total widths with single blade if a chopper blade having slits S of which the opening width varies in the radial direction, as shown in FIG. 25, is prepared.

Figure 28:
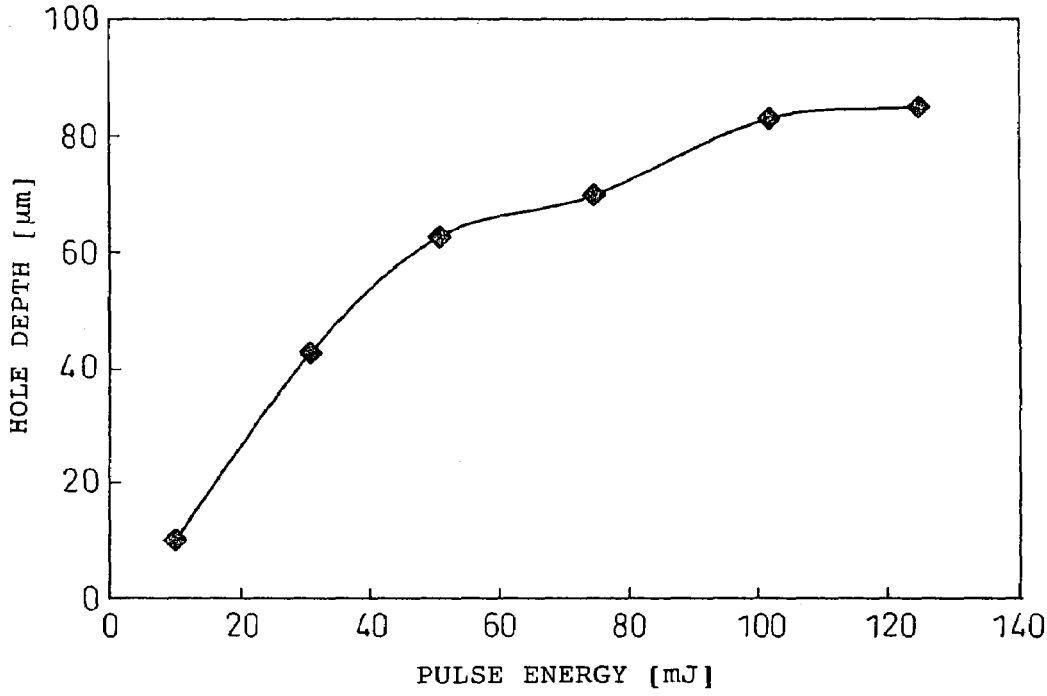
FIG. 28 is a graph showing the relation between pulse energy and hole depth, with regard to the data obtained under the condition of the pulse total width of 30 μsec out of the data in FIG. 27.

The basis of the required pulse energy will be explained hereunder. FIG. 28 is a graph showing a relation between pulse energy and hole depth with regard to the data obtained out of FIG. 27(*a*) under the condition of the pulse total width of 30μ seconds. As is obvious from the figure, pulse energy is required to be more than 40 mJ to obtain holes 50 μm or more in depth which is an object of the present invention.

In a continuous wave exciting Q-switched $CO_2$ laser, as a confocal telescope is incorporated into a resonator in the case of a rotary chopper Q-switching method, it is necessary that the energy density of the maximum available pulse energy at the confocal point is below the breakdown threshold value of the atmospheric gas. Since the maximum pulse energy obtained under this condition is 150 mJ in general, this value provides the upper limit of energy.

Here, pulse energy output can be controlled by varying the glow discharge electric energy at the time of discharge excitation. Although direct current discharge is generally used as a discharge excitation method, any other methods of continuously impressing an alternating current discharge and an RF discharge, and applying pulse modulation to the discharges, may be used.

Requisites for the condensed diameter of a laser beam which is used for processing will be explained hereunder. Surface diameter of formed holes varies, in general, depending on the condensed laser beam diameter and the amount of pulse energy supplied. As shown in FIG. 27(*b*), for example, the surface hole diameter increases monotonously as pulse energy increases when pulse energy is varied under the condition of a certain constant condensed diameter. This is because, if energy is increased in the relatively long pulse time of 30μ seconds or more, a region larger than the irradiated region specified by the condensed beam diameter is heated, melted and then evaporated by the heat transfer diffusion.

Then, an experiment of varying the pulse energy was carried out while varying the laser beam condensed diameter by preparing condensers of various focal lengths and, as a result, it was found that the range of condensed diameter of 50 to 150 μm was appropriate as the condition of condensed diameter to satisfy the condition of surface hole diameter of 50 to 200 μm and hole depth of 50 μm or more. The reasons why the upper limit of condensed diameter is 150 μm and it is smaller than that of the surface hole diameter, 200 μm, is because, as explained above, a phenomenon in which a hole diameter larger than the diameter of an actually obtained irradiated portion, takes place. Further, the lower limit is determined by the lower limit of the surface hole diameter.

EXAMPLE 6

Figure 24:
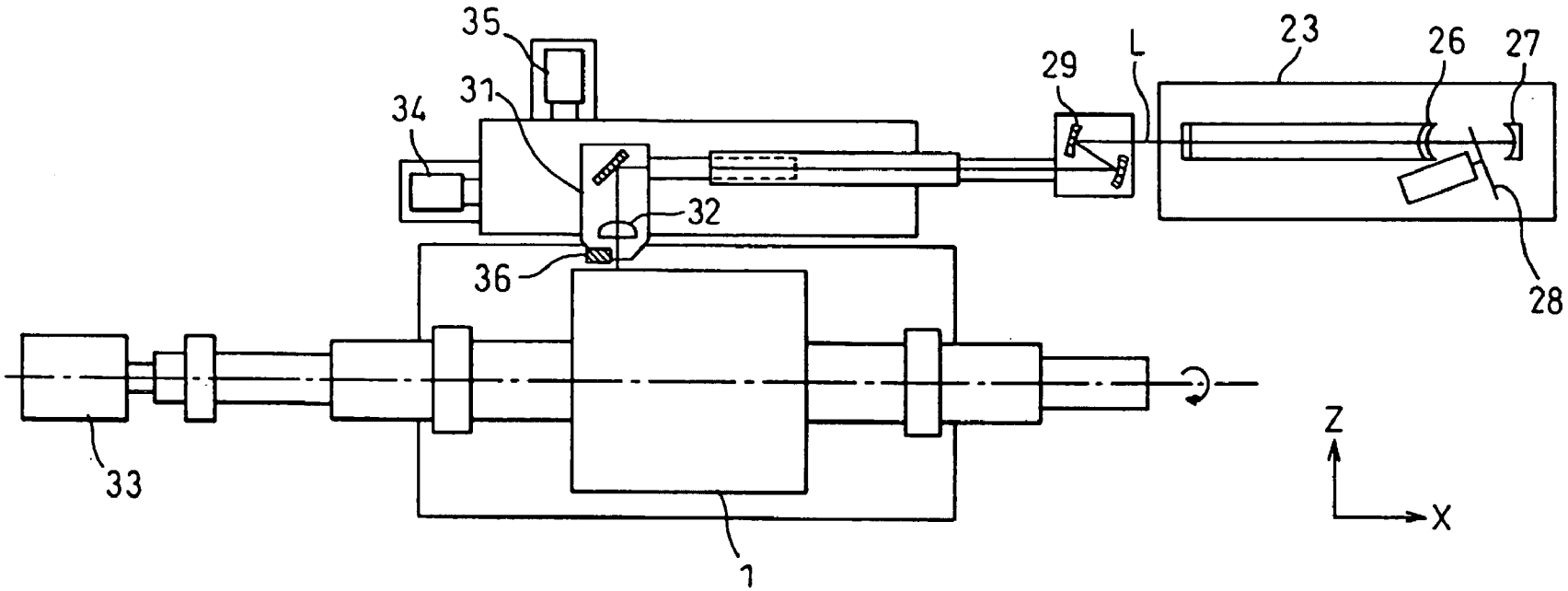
FIG. 24 is a drawing showing the configuration of an apparatus for forming dimples of a cooling drum for thin slab continuous casting according to the present invention.

FIG. 24 is a drawing showing the configuration of a laser processing apparatus employed in the present invention. The laser oscillator 23 is a Q-switched $CO_2$ laser apparatus incorporating a Q-switching apparatus behind a continuous discharge excitation laser tube having carbon dioxide gas as oscillation medium. The Q-switching apparatus consists of a confocal telescope (which consists of a telescope condenser 26 and a total reflection mirror 27) and a rotary chopper 28 (refer to FIG. 25) installed at the confocal point.

The number of revolutions of the rotary chopper 28 is 8,000 rpm, 45 slits (refer to S in FIG. 25) are formed on the chopper blade, and a series of pulses having 32 μsec. of pulse total width and 6 kHz of pulse repetition frequency are obtained. After the divergence angle of the laser beam L output by the laser oscillator 23 is corrected by a collimating mirror (a concave mirror) 29, the beam reaches a processing head 31, is condensed to a diameter of 100 μm by a ZnSe-made condenser 32 having a focal distance of 63.5 mm, and then is irradiated onto a cooling drum 1.

By rotating a cooling drum having a diameter of 1,200 mm and slightly concave crown at a constant speed of 0.4 rps with a drum rotating device 33, holes having a pitch of 250 μm are formed on the peripheral surface of the cooling drum. The laser processing head 31 moves in the direction parallel to the direction of the drum rotation axis at a speed of 100 μm/second with an X-axis direction driving apparatus 34, and holes having a pitch of 250 μm are formed also in the direction of the rotation axis. Here, since the drum has a slightly concave crown, a height copying sensor 36 of eddy-current type measures the distance between the processing head and the drum surface and, based on the result of the measurement, a Z-axis direction driving apparatus 35 moves the processing head so as to control the distance between the condenser 32 and the surface of the cooling drum 1 to a constant amount.

Figure 29:
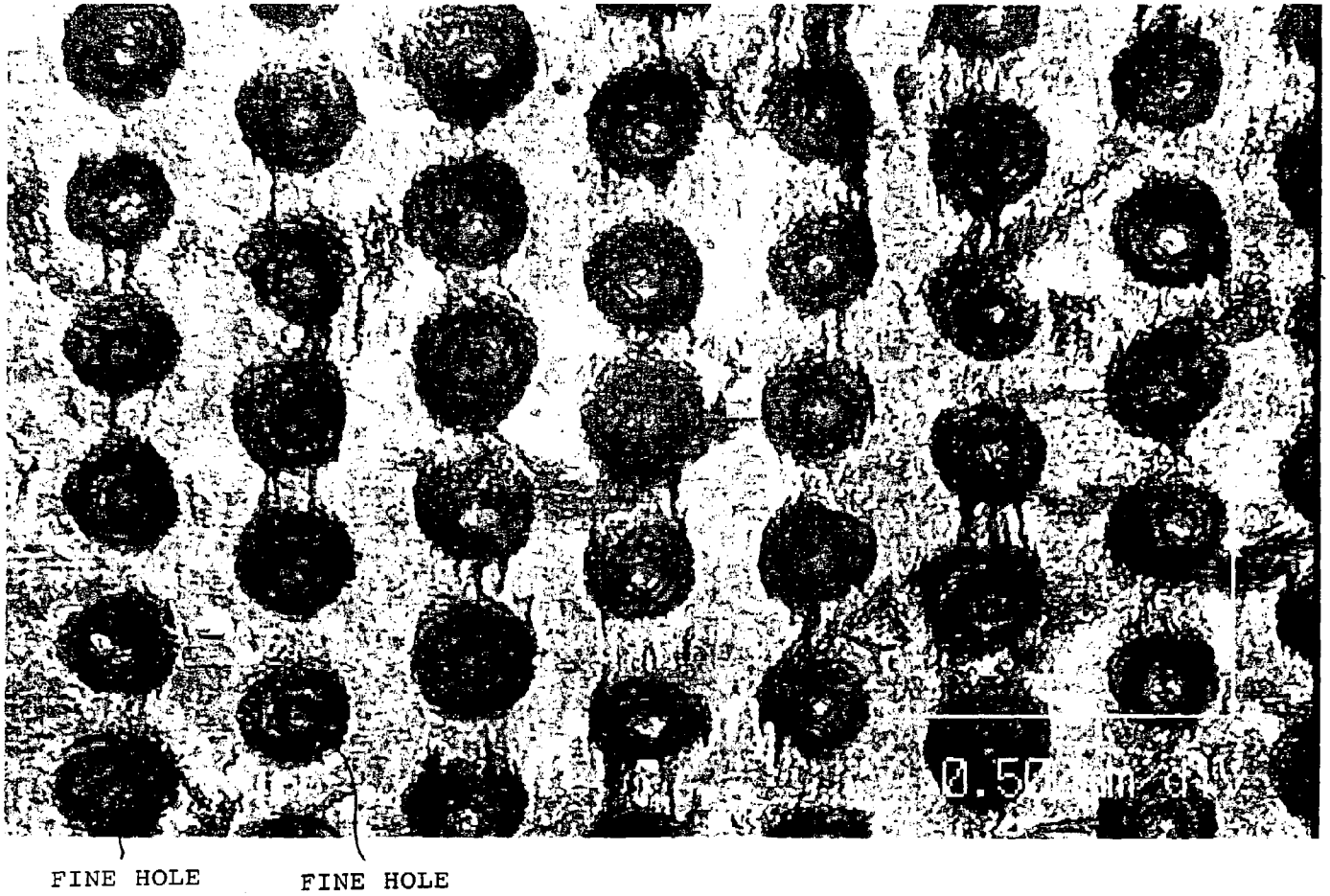
FIG. 29 is a view showing a surface appearance obtained as a result of applying a method of forming dimples of a cooling drum for thin slab continuous casting according to the present invention.

Using the above configuration, a cooling drum 1 coated with Ni—Co—W plating and having dimples formed in advance by shot blasting was processed with laser pulse energy of 90 mJ. As a result, fine holes 180 μm in surface hole diameter and 55 μm in depth with a fine hole pitch of 250 μm were formed. A surface appearance of the cooling drum subjected to the processing is shown in FIG. 29.

Austenitic stainless steels (SUS304) were cast into strip-shaped thin slabs of 3 mm in thickness by a twin drum type continuous caster shown in FIG. 1, employing the cooling drums processed according to above-mentioned method, and after the casting, the slabs were hot-rolled and then cold-rolled to produce sheet products of 0.5 mm in thickness. The quality of the cast slabs was evaluated by visually inspecting the sheet products after cold-rolling. As a result, it was observed that thin slabs were free of surface cracks, and sheet products after rolling were free of surface defects and unevenness.

As comparative examples, similar casting was performed using drums without the dimples formed by laser material processing according to the present invention, and as a result, fine cracks occurred at the positions corresponding to the portions where scum was caught and obvious unevenness was observed on the surface of the sheet products.

7) A seventh embodiment of the present invention, which includes various sub-embodiments, will be described.

Figure 30:
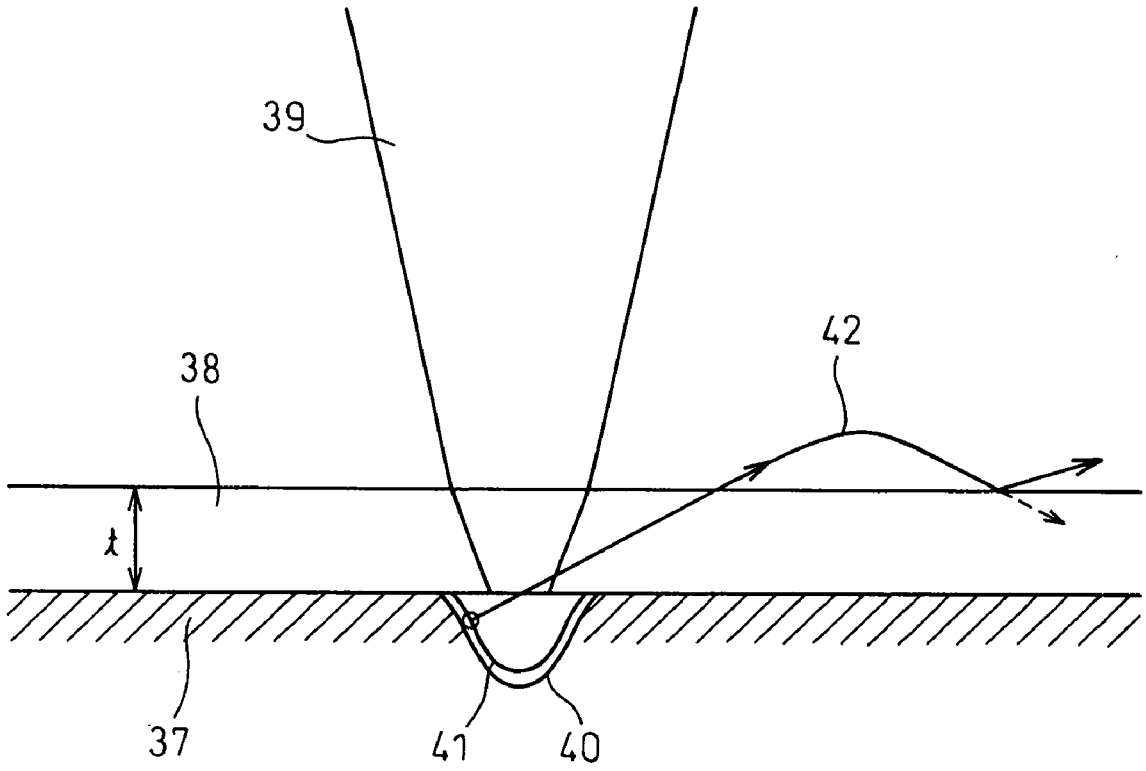
FIG. 30 is an illustration showing the processing phenomenon in a method of forming holes on a metallic material with laser according to the present invention.

A laser processing method of forming holes on metallic material applicable to the processing of a drum peripheral surface will be explained in detail hereunder. FIG. 30 is an illustration of a side view showing the process of forming a hole on a metallic material with a pulsed laser beam. A coating material 38 consisting of oils and fats is coated on the surface of a metallic material which is a to-be-processed work piece 37 (a cooling drum, for instance) beforehand. A laser beam 39 is condensed by a condenser not indicated in the figure so as to be focused on the surface of the metallic material 37, and irradiated.

At this time, the laser beam 39 reaches the surface of the metallic material 37 after being refracted at the interface of air and the coated material 38 and subjected to a certain absorption. A sublimation phenomenon takes place on the surface of the metallic material 37 caused by high momentary energy density of the laser beam 39, and thus a hole is formed.

At this time, if observed microscopically, a surface 41 of a molten phase, and an interface 40 between the molten phase and a solid phase, are formed at the bottom of the hole, and part of the molten phase which exists between both interface (41 and 40) is discharged outward as sputter 42 by a force overcoming the surface tension exerted by the reaction force of the evaporation of the metallic material 37 and the back pressure of the assist gas. Constituent portions of the sputter 42 having momentum only enough to allow them to stay in the vicinity of the hole reach the surface of the work piece being processed in molten state, and are deposited on the surface and become dross if a coating material is not applied.

On the other hand, if a coating material 38 is applied onto the surface in advance, a phenomenon takes place wherein the spatter 42 is solidified by the cooling effect of the coating material 38 before reaching the surface of the metallic material 37, or splashes far away by being reflected again caused by the poor wettability of the coating material 38 with the metal. The above is the principle of suppressing dross-deposition by applying a coating material beforehand.

Next, the present inventors carried out experimental research to clarify whether the above-mentioned principle was applicable to any kind of oils and fats. As a result, the present inventors discovered that the effect of suppressing the deposition of dross varied greatly depending on the kinds of oils and fats and the thickness of the coating. As a result of investigating the outcome of the experiment systematically, it was found that the difference in the phenomenon could be summarized by the transmittance of the laser light in the thickness direction of the coating medium.

Namely, it was found that, when absorption by the substance was large, the suppression of dross was difficult even if the coated layer thickness was thin, and that, when the coated layer thickness was thick, the suppression of dross was difficult similarly even if the medium having little absorption was used.

In order to analyze the phenomenon, time resolving spectral evaluation of the plasma generated at the time of irradiating a pulsed laser was carried out. As a result, it was found that, under the condition of coating medium with large absorption, the electron density and the electron temperature (plasma temperature) in plasma remarkably rose at an early stage of pulse generation as compared to the case under the condition of coating medium with little absorption. Further, the plasma absorbed the succeeding pulse energy after passing through an inverse damping radiation process and the electron temperature of the plasma rose with an increasing speed.

Absorption of pulse energy by plasma reduces energy reaching the surface of a metallic material which is a work piece to be processed and, simultaneously, plasma itself becomes a secondary heat source. Since the plasma rapidly expands as time elapses, the size of the secondary heat source is extraordinarily larger than the condensed diameter of the laser beam.

Consequently, portions having small amount of momentum of the sputter produced according to the process as explained in FIG. 30 are reheated by the plasma, and that leads to increasing the amount of dross deposited in the vicinity of the hole.

Based upon the above analysis, the absorption coefficients V of various mediums were evaluated, and then an experimental evaluation on the suppression of dross deposit was carried out by changing the coating thickness successively. Here, absorption coefficient μ is a value defined by the expression (1), where t is the thickness of the medium and T is the light transmittance.

$$T=\exp[-\alpha\cdot t] \quad (1)$$

The results are shown in Table 8.

TABLE 8

| Type | α [$mm^{-1}$] | t [mm] | T | State of dross deposition |
|---|---|---|---|---|
| A | 2 | 0.10 | 0.82 | ○ (No dross) |
| " | " | 0.30 | 0.55 | ○ (No dross) |
| " | " | 0.50 | 0.37 | X (Much dross) |
| B | 4 | 0.10 | 0.67 | ○ (No dross) |
| " | " | 0.18 | 0.49 | Δ (Partial dross deposition) |
| " | " | 0.30 | 0.30 | X (Much dross) |
| C | 10 | 0.05 | 0.60 | ○ (No dross) |
| " | " | 0.10 | 0.37 | X (Much dross) |
| D | 20 | 0.02 | 0.67 | X (Much dross) |
| " | " | 0.05 | 0.37 | X (Much dross) |

From above results, it was found that the requisites for oils and fats to be coated was to satisfy following expressions (2) and (3) simultaneously:

$$\text{Light transmittance at coating film } T \geqq 0.5 \quad (2),$$

$$\text{Absorption coefficient } \alpha \leqq 10\ mm^{-1} \quad (3).$$

If the light transmittance T is less than 0.5, namely, if absorption at coated material is exceedingly large, the aforementioned phenomenon takes place and the dross suppressing effect is deteriorated. Then, if the absorption coefficient μ does not satisfy the expression (3), the dross suppressing effect is deteriorated similarly even if light transmittance T is 0.5 or more.

This is because, if the absorption per unit thickness is exceedingly large, absorption at the surface of the coated layer becomes relatively large and, therefore, the growth of plasma produced by laser light becomes remarkable and above-mentioned phenomenon takes place. The above is the gist of the requisites for realizing the dross suppressing effect effectively with high degree of reproducibility.

Here, although the kinds of oils and fats to be coated are not specifically defined in the above explanation, petroleum lubricants exhibit a most appropriate effect. However, any kind of oils and fats can be selected as long as it satisfies the expressions (2) and (3).

EXAMPLE 7

Figure 31:
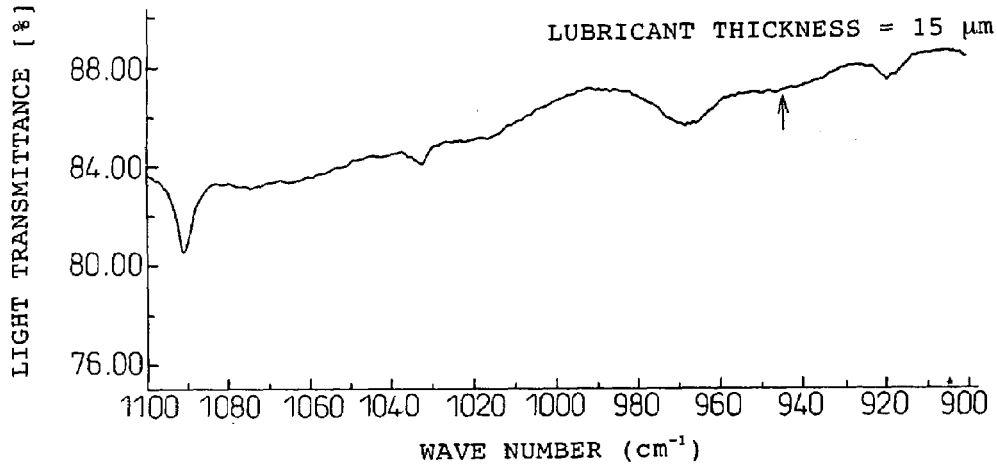
FIG. 31 shows the results of measuring the infrared transmission property of a petroleum lubricant used in the examples according to the present invention. (a) is a graph showing the result when the lubricant is 15 μm thick, and (b) is the same when the lubricant is 50 μm thick.
Figure 31:
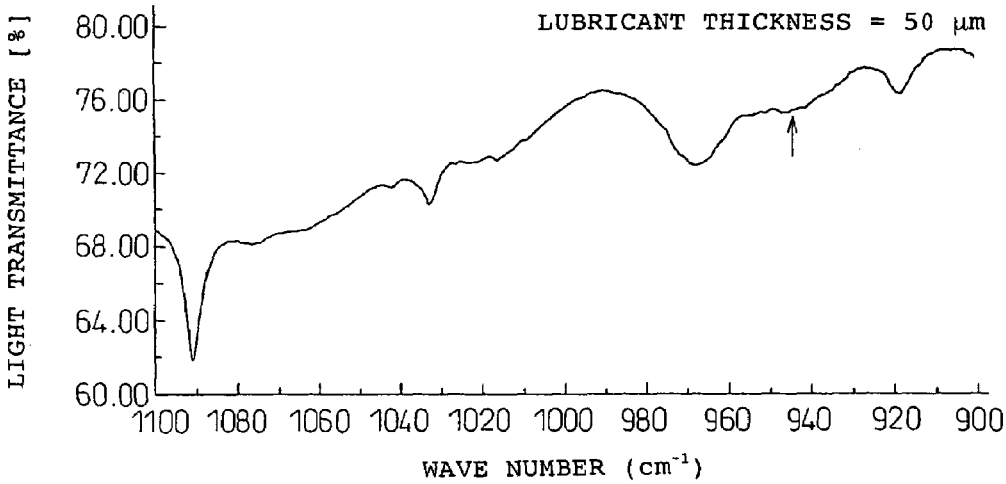

FIG. 31 shows the results of measuring the infrared spectroscopy transmittance property of a petroleum lubricant of class 3 used for the examples of the present invention; (a) shows the result in the case of lubricant thickness of 15 μm, and (b) shows the result in the case of lubricant thickness of 50 μm. Here, the results of the measurement include 7.5% of transmittance loss at the window since KBr single crystal is used as the gate material.

Since this example is a case where holes are formed by using pulsed $CO_2$ laser as will be stated hereunder, the wave number corresponding to the oscillation wavelength of 10.59 μm (10P 20 oscillation line) of the $CO_2$ laser is indicated by an arrow pointing upwards.

Figure 32:
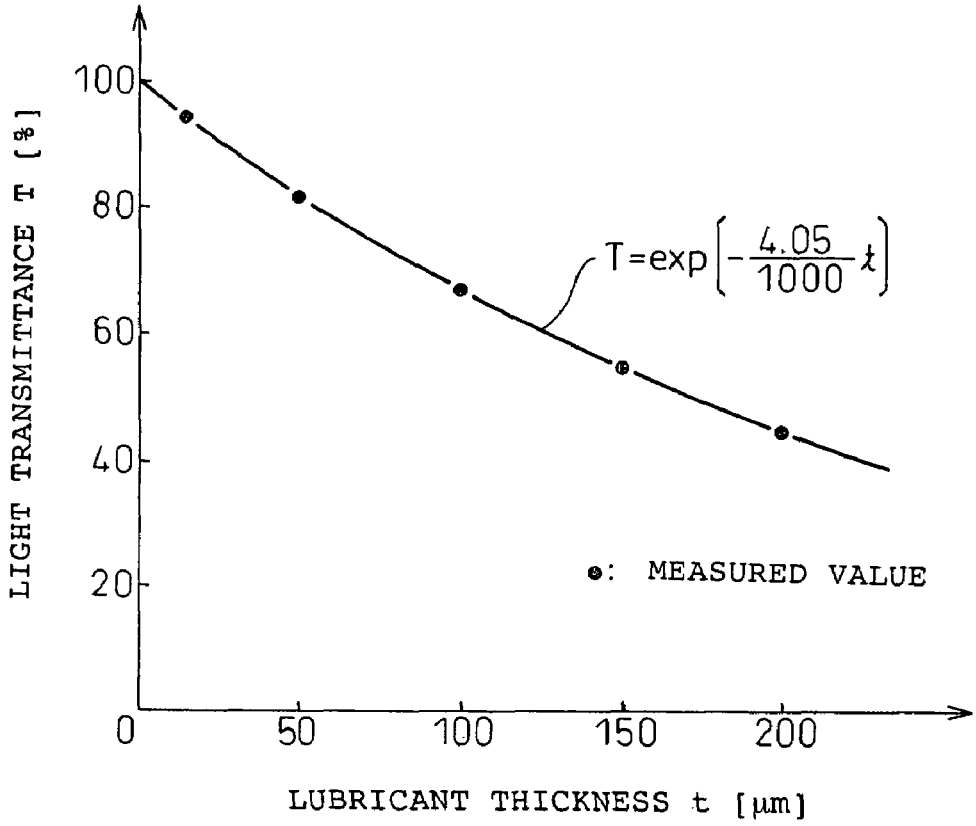
FIG. 32 is a graph showing the relation between lubricant coating thickness and light transmittance of a petroleum lubricant used in the examples according to the present invention in the case of a wavelength of 10.59 μm.

FIG. 32 is a graph showing the light transmittance of the above-mentioned coating material itself expressed as a function of lubricant thickness after obtaining said light transmittance by evaluating the transmittance property at various thickness as shown in FIG. 31, and correcting the results for the transmittance of the window material.

In the graph, black dots indicate measured values and the solid line indicates the result obtained from the expression (1) and demonstrates the appropriateness of the expression (1). Accordingly, the absorption coefficient μ of the lubricant is 4.05 $mm^{-1}$.

Hole forming on a metallic material using a lubricant having a property as shown above was performed. Ni was used as the metallic material to be processed, and a lubricant 50 μm in thickness was coated thereon. The light transmittance at the lubricant portion was 0.82 at this time.

Hole forming by Q-switched $CO_2$ pulsed laser was performed on this material. Pulse energy was set at 90 mJ, condensed diameter of the pulsed laser beam was set at 95 μm, and air was supplied as the assist gas coaxially with the laser beam at a flow rate of 20 liter/minute.

Figure 33:
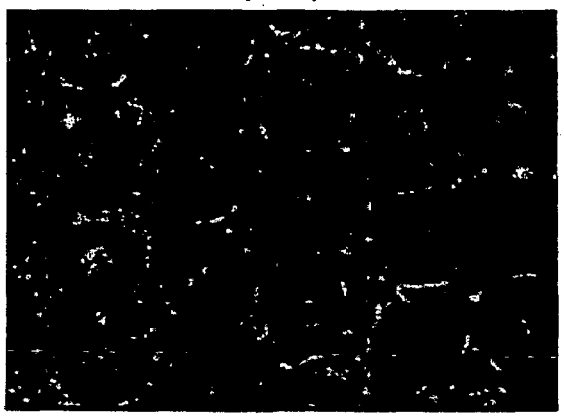
FIG. 33 shows the appearance of the surfaces on which hole forming was applied as the examples according to the present invention. (a) shows the result of no coating according to a conventional method, (b) shows the result of coating the coating material shown in FIG. 31 in the thickness of 50 μm on the conditions according to the present invention, and (c) shows the result of coating the coating material shown in FIG. 31 in the thickness of 200 μm as a condition deviating from the present invention.
Figure 33:
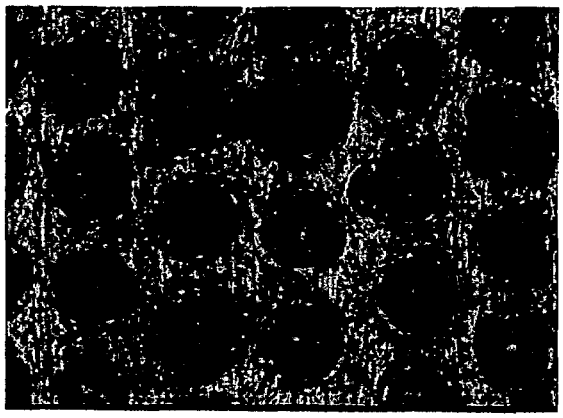
Figure 33:
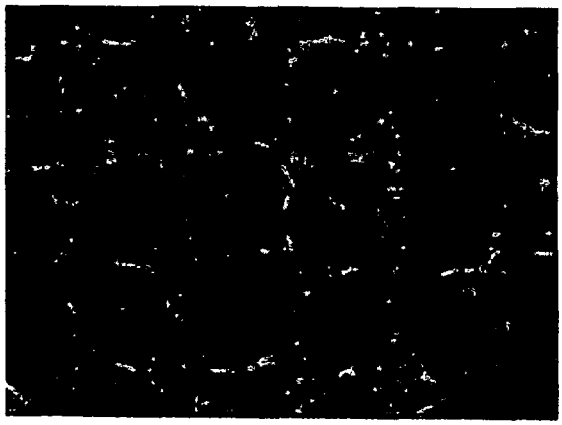

Under above-mentioned condition, fine holes 170 μm in surface hole diameter and 80 μm in depth were formed. The appearance of the surface formed under this condition is shown in FIG. 33(*b*). For comparison, the appearance of the surface formed without a lubricant coated in advance is shown in (*a*) of the same figure, and the appearance of the surface in the case where a lubricant 200 μm in thickness is coated in advance (light transmittance T=0.44) is shown in (*c*) of the same figure.

As obvious from the figure, it was found that, in the case of (*b*) where coating was applied according to the present invention, dross deposit was significantly suppressed, as opposed to the case of (*a*) where lubricant coating was not applied, and further, under the condition of (*c*) where light transmittance was less than 0.5 due to thick coating though the lubricant was the same, suppression of dross deposit became impossible, similarly to the case (*a*) without coating.

In the above example, although the case where Ni is used as a metallic material to be processed is shown as the example, it was confirmed that dross deposit can be effectively suppressed under the condition according to the present invention in the case of any other metal such as ferrous metallic material and the like, and therefore, present invention is applicable to any kind as long as it is a metallic material.

Further, in the above example, although the case where a pulsed Q-switched $CO_2$ laser is used as the laser light source for forming holes is shown, it is also possible to use other laser sources by specifying the transmittance property of the coating material in relation to the laser wavelength to the range of the present invention. For example, it is possible to use a YAG laser (wavelength: 1.06 μm), a semiconductor laser (wavelength: about 0.8 μm) and an excimer laser (wavelength: ultraviolet region) and the like.

Yet further, in the above example, although the case where fine holes 170 μm in diameter and 80 μm in depth are formed is shown, the present invention is further applicable either to forming holes with larger diameter and depth, or to forming even finer holes.

INDUSTRIAL APPLICABILITY

By the present invention, a thin slab which does not have surface defects such as surface cracks and crevices, pickling unevenness, and pickling-unevenness accompanying cracks can be produced efficiently.

Therefore, the present invention can provide a high quality stainless steel sheet excellent in surface appearance and not having an uneven luster with a good yield and at a low cost, and greatly contributes to the development of the consumer goods manufacturing industry and the construction industry, wherein stainless steels are used as materials for products and construction materials.

The invention claimed is:

1. A cooling drum for metal cast strip by continuous casting, characterized in that: dimples 40 to 200 μm in average depth and 0.5 to 3 mm in diameter of circle equivalent are formed on a plated peripheral surface of the cooling drum, adjacent to each other at rims of said dimples; and a film, containing oxides of at least one member selected from the group consisting of Ni—W, Ni—Co—W, Cr, Ni—Fe and Ni—Al, is formed on said peripheral surface.

2. A cooling drum for metal cast strip by continuous casting according to claim 1, wherein said film, containing oxides of at least one member selected from the group consisting of Ni—W and Ni—Co—W, is formed on said peripheral surface.

3. A cooling drum for metal cast strip by continuous casting according to claim 2, wherein the plated peripheral surface is a plated layer of at least one member selected from the group consisting of Ni—W and Ni—Co—W.

4. A cooling drum for metal cast strip by continuous casting according to claim 1, wherein the plated peripheral surface is a plated layer of at least one member selected from the group consisting of Ni—W, Ni—Co—W, Cr, Ni—Fe and Ni—Al.

* * * * *